US007967540B2

(12) United States Patent
Wright et al.

(10) Patent No.: US 7,967,540 B2
(45) Date of Patent: Jun. 28, 2011

(54) VERTICAL OFFLINE STAND BUILDING AND MANIPULATING SYSTEM

(75) Inventors: Monte Neil Wright, Calgary (CA); George (Guo Qiang) Hu, Calgary (CA)

(73) Assignee: Weatherford Canada Partnership, Edmonton, Alberta (CA)

( * ) Notice: Subject to any disclaimer, the term of this patent is extended or adjusted under 35 U.S.C. 154(b) by 346 days.

(21) Appl. No.: 12/285,305

(22) Filed: Oct. 1, 2008

(65) Prior Publication Data

US 2009/0185883 A1 Jul. 23, 2009

Related U.S. Application Data

(63) Continuation-in-part of application No. 11/785,446, filed on Apr. 18, 2007, now Pat. No. 7,794,192, which is a continuation-in-part of application No. 10/997,930, filed on Nov. 29, 2004, now Pat. No. 7,331,746.

(60) Provisional application No. 61/006,460, filed on Jan. 15, 2008.

(51) Int. Cl.
*E21B 19/00* (2006.01)

(52) U.S. Cl. ..... 414/22.55; 414/22.62; 166/380; 166/377; 175/52; 52/632; 52/121

(58) Field of Classification Search ..... 166/380, 166/77.52, 77.53, 377; 175/57, 85; 414/22.51, 414/22.54–22.59, 22.61, 22.63, 22.65–22.68, 414/22.71, 22.62; 52/121, 632
See application file for complete search history.

(56) References Cited

U.S. PATENT DOCUMENTS

| | | | | | |
|---|---|---|---|---|---|
| 2,966,994 | A | * | 1/1961 | Wolff | 414/22.54 |
| 3,177,944 | A | * | 4/1965 | Knights | 166/77.53 |
| RE26,284 | E | * | 10/1967 | O'Neill et al. | 175/57 |
| 3,949,818 | A | * | 4/1976 | Russell | 175/52 |
| 4,013,178 | A | | 3/1977 | Brown et al. | |
| 4,077,525 | A | | 3/1978 | Callegari et al. | |
| 4,117,941 | A | | 10/1978 | McCleskey, Jr. et al. | |

(Continued)

FOREIGN PATENT DOCUMENTS

EP 234880 A * 9/1987

(Continued)

*Primary Examiner* — Gregory W Adams
(74) *Attorney, Agent, or Firm* — Antony C. Edwards

(57) ABSTRACT

A vertical off-line stand building system includes a mast having a basal portion and an upper portion. An upper pipe elevator is mounted in the upper portion of the mast and is selectively translatable by a selecting actuable first hoist between upper raised and lowered positions. A lower pipe elevator is mounted in the basal portion of the mast and is selectively translatable by a selecting actuable second hoist between basal raised and lowered positions. A horizontal pipe support table is positioned adjacent the base of the mast. A horizontal pipe translator is mounted in the table for translating a pipe single longitudinally along the table so as to engage a first end of the pipe single with the lower pipe elevator when in its basal lowered position. The lower pipe elevator draws the first pipe into the mast through a front opening in the mast. The upper pipe elevator takes the first pipe and elevates it to the top of the mast. The lower pipe elevator raises the next pipe into the mast which is then threaded to the first pipe and the pipe stand then elevated by the upper pipe elevator so that the lower pipe elevator may add successive pipes to the pipe stand. The rear of the mast is entirely open so that the assembled pipe stand may be removed.

11 Claims, 59 Drawing Sheets

U.S. PATENT DOCUMENTS 4,274,778 A 6/1981 Putnam et al.
4,531,875 A 7/1985 Krueger
4,610,315 A * 9/1986 Koga et al. ..... 175/85
4,621,974 A 11/1986 Krueger
4,725,179 A 2/1988 Woolslayer et al.
6,343,892 B1 * 2/2002 Kristiansen ..... 405/195.1
6,821,071 B2 11/2004 Woolslayer et al.
6,976,540 B2 12/2005 Berry
6,997,265 B2 * 2/2006 Berry ..... 166/380
7,228,919 B2 6/2007 Fehres et al.
2007/0221385 A1 9/2007 Braun et al.
2008/0128167 A1 * 6/2008 Eriksen ..... 175/52

FOREIGN PATENT DOCUMENTS

WO WO 2006075914 A1 * 7/2006

* cited by examiner

VERTICAL OFFLINE STAND BUILDING AND MANIPULATING SYSTEM

CROSS REFERENCE TO RELATED APPLICATION

This is a Continuation-in-Part patent application of U.S. patent application Ser. No. 11/785,446 filed Apr. 18, 2007, now U.S. Pat. No. 7,794,192 being a Continuation-in-Part patent application of U.S. patent application Ser. No. 10/997,930 filed Nov. 29, 2004, now U.S. Pat. No. 7,331,746. This application also claims priority from U.S. Provisional Patent No. 61/006,460 filed Jan. 15, 2008 entitled Vertical Offline Stand Building System.

FIELD OF THE INVENTION

This invention relates to the field of devices for handling tubulars, pipe stands and the like, and in particular to a method and corresponding apparatus for building and manipulating vertical offline pipe stands.

BACKGROUND OF THE INVENTION

As stated by Braun in his published United States Patent Application published Sep. 27, 2007 under publication No. 2007/0221385 and entitled Apparatus and Method for Forming Stands, various ground drilling operations are known such as exploring and/or extracting oil from subterranean deposits. The drilling operation is conducted on a drill rig such as illustrated by way of example in FIGS. 1*a* and 1*b* comprising a raised drilling platform located above the drilling location. A derrick is provided on the platform to raise, support and rotate a drill string. A drill string includes a drill bit for boring into the ground. As the drilling operation continues, tubular members, commonly referred to as "tubulars" (and referred to herein alternatively as pipes or singles) are connected in an end to end manner to form a drill string. Tubulars are commonly about 30 feet in length and have opposing female and male ends. The ends are threaded in a complementary manner so that opposing male and female ends can be joined together.

The addition of a tubular to an existing drill string is a relatively time consuming and dangerous procedure. Tubulars are provided on a rack from which they are individually rolled onto a horizontal support, such as a catwalk. Both the rack and catwalk are generally located adjacent to the drilling platform with the catwalk being generally positioned perpendicular to the platform. Once on the catwalk, one end of the tubular is attached to a hoist connected either directly or indirectly to the derrick and raised to a vertical position on the drilling platform. The lower end of the tubular is then oriented over the existing drill string and connected to the terminal, surface end of thereof. Following connection of the tubular to the drill string and "torquing" to establish a tight connection, the drilling operation is continued. As indicated above, tubulars are generally about 30 feet (10 m) in length. As such, the frequency of adding tubulars to the drill string is high and, therefore, the efficiency of the drilling operation is hampered. In addition, the above described manipulation of the tubulars often requires manual handling and, therefore, increases the risks to the drill rig personnel.

In order to increase the efficiency of the drilling operation, various methods have been proposed to pre-connect at least two tubulars, to form a "stand", prior to connection to the drill string. Such a process is often referred to as "standbuilding". As will be appreciated, such pre-connection step involving two tubulars will reduce by half the number of connections required to be made to the drill string and, therefore, allows the drilling process to continue with fewer interruptions. An example of such a standbuilding procedure is provided in related U.S. Pat. Nos. 6,976,540 and 6,997,265. In these references, a tubular is rolled from a rack onto a ramp positioned adjacent the drilling platform. One end of the tubular is raised by a hoist to a vertical orientation above the drilling platform. The tubular is then inserted into an opening in the drilling platform adjacent to the existing drill string. A further tubular is then vertically hoisted and aligned above the first tubular. The opposing ends are of the two tubulars are then connected together to form a vertical, dual tubular stand. The stand is then raised and secured to the drill string. During formation of the stand, the drilling operation is continued without interruption.

Another example of a standbuilding operation is provided in U.S. Pat. No. 6,705,414. In this reference, a stand is formed on a horizontal catwalk associated with a drilling platform. According to the disclosed method, two pairs of tubulars are positioned end to end on the catwalk. A "bucking machine" is then used to join the two tubulars. The bucking machine includes jaws that grasp and axially rotate the tubulars in opposite directions so as to engage the threads on the respective ends and to torque the connection to the desired value. Two stands are formed in this manner, which are then loaded onto a "trolley". The trolley, carrying the two stands, is hoisted onto the drill rig platform and oriented vertically. The stands are then removed from the trolley and either connected to the drill string or stored in the vertical position for later connection to the drill string.

In the prior art applicant is also aware of U.S. Pat. Nos. 6,976,540 and 6,997,265 to Berry for his Method and Apparatus for Offline Standbuilding, and U.S. Pat. No. 7,228,919 to Fehres et al. for a Pivoting Pipe Handler for Off-line Make-up of Drill Pipe Joints.

Berry in his patents discloses a method and apparatus for moving pipe on a rig floor between a number of different stations. Pipe handling equipment interacts between an off-floor rack, a preparation opening, a borehole, and a storage area such that tubular joints are loaded onto the drill floor, prepared at the preparation opening, loaded onto or off the storage rack, and connected to a drill string while drilling in simultaneously conducted at the borehole. In one embodiment, joints of drill pipe or other tubulars are moved from the v-door of the rig and delivered into a pair of preparation openings for building stands while drilling activities continue at well center. The system may include a stand building truss device comprising a vertical truss mounted inside the derrick in a position where it can access the v-door pick-up point and preparation openings using a powered slew about a vertical access. Other embodiments are taught such as providing an iron roughneck for making up connections between the tubulars which roughneck has an operating reach which intersects the pipe handling device. In another embodiment, the pipe handling device has a reach which intersects through a v-door such that the pipe handling device may hoist tubulars from outside of the drilling platform, such as from an external storage area via a tubular ramp. In another of several alternative embodiments, a robotic arm is provided which is mounted in generally in the derrick to provide for moving drill pipe and drill collars between the well center or stand building location to the setback position and back again. In one disclosed embodiment, the pipe handling device is taught to include a vertically extending frame and a vertically aligned gripping device mounted thereon provided adjacent to a preparation opening and a vertical or v-door provided in the side of the derrick for access to areas off the drill floor such as an external catwalk and a tubular access ramp.

Fehres et al discloses an apparatus and method for use in the off-line make-up of drill pipes stands on drilling rigs. A section of a v-door ramp which is attached to the drilling rig structure is fixed and an adjacent section is pivotable between its position adjacent the fixed v-door ramp section and a lowered position wherein the pivotable section is lower to the vertical. One or more joints of drill pipe are loaded onto the pivotable section and clamp thereon so that the joints of drill pipe may then be rotated to the vertical. An off-line drill pipe elevator elevates joints of drill pipe and, prior to placing the pipe stand for storage into a racking board, the joints are made up into a pipe stand by the use of an off-line roughneck.

SUMMARY OF THE INVENTION

The Vertical Offline Stand Building (VOSB) System according to the present invention builds and torques double, triple or quad stands of drill pipe. Each made up stand assembly may be presented to a Racking Board Pipe Handling System such as is the subject of U.S. Pat. No. 7,331,746, and which is incorporated herein, or other suitable system, for storage in the racking board ready for presentation to well center when required. As a result of the use of such a robotic pipe handling system there is no requirement for mouseholes, winch lines, or drilling hands on the drill floor or on the racking board.

In summary, the present invention may be characterized in one aspect as a Vertical Offline stand Building system for positioning adjacent to, in co-operation with, a drilling rig platform having a derrick mounted thereover wherein the derrick includes a means of retrieving and handling pipe stands into and from a pipe racking board mounted on the derrick where the system includes a mast having upper and lower pipe elevators for elevating single pipes from a table, hoisting them sequentially in the mast so as to sequentially make-up a pipe stand held in the mast.

The mast has a basal portion and an upper portion mounted atop the basal portion. The basal portion has a base at a lowermost end thereof. The upper pipe elevator is mounted in the upper portion of the mast and is selectively translatable by a selecting actuable first hoist between upper raised and lowered positions. The lower pipe elevator is mounted in the basal portion of the mast and is selectively translatable by a selecting actuable second hoist between basal raised and lowered positions. Each of the upper and lower pipe elevators are selectively vertically translatable along corresponding upper and lower travel paths along their corresponding upper and basal portions of the mast.

The horizontal pipe support table is positioned adjacent the base of the mast. A horizontal pipe translator is mounted in the table for translating a pipe single longitudinally along the table so as to engage a first end of the pipe single with the lower pipe elevator when in its basal lowered position. The lower pipe elevator has a pipe engaging means for capturing the first end of the pipe single, which may be a collar for engaging a box end upset of the pipe to be elevated.

The first hoist may be any first vertical translator mounted on the mast for selectively raising and lowering, herein referred to as hoisting, the lower pipe elevator between said basal raised and lowered positions. The second hoist may be any second vertical translator mounted on the mast for selectively hoisting said upper pipe elevator between the upper raised and lowered positions.

The mast has a pair of oppositely disposed sides, a front, and a rear, wherein said rear is oppositely disposed to said front. The pipe support table is positionable adjacent the base so as to extend substantially orthogonally from the front of the mast. The rear of the mast is positionable adjacent a drill rig platform and its corresponding derrick.

The front of the mast has a front opening in at least the basal portion of the mast which is substantially completely open and unobstructed. The front opening is sized so that the pipe single having its first end elevated by the lower pipe elevator while drawing the opposite second end of the pipe single along the pipe support table, that is, until the pipe single is elevated from its horizontal storage position on the table to a vertical position freely suspended by the lower pipe elevator in the mast will be elevated and drawn through the front opening, wherein the lower pipe elevator is in the basal raised position once the pipe is vertical and suspended by the lower pipe elevator.

Advantageously the basal raised position overlaps the upper lowered position so that, once the lower pipe elevator has elevated the first end of the pipe single to the basal raised position, the first end of the pipe single may be handed off to the upper pipe elevator, that is, is engagable by a pipe engaging means on the upper pipe elevator, whereby the first end of the pipe single is handed-off from the lower pipe elevator to the upper pipe elevator, Upon the hand-off of the pipe to the upper elevator, whereupon the upper pipe elevator is selectively vertically translatable upwardly on the second vertical translator so as to elevate the first end of the pipe single to the upper raised position and so as to elevate the second end of the pipe, opposite the first end, above the basal raised position. Upon the pipe being handed off to the upper pipe elevator, the lower pipe elevator is selectively vertically translatable downwardly by the first vertical translator so as to lower the lower pipe elevator into the basal lowered position for engaging a first end of a successive pipe single having been translated on the table to said base.

A pipe stand assembly and disassembly device such as a torque wrench and pipe spinner co-operates with the mast and the lower and upper pipe elevators for threading together, and unthreading so as to part, component pipes singles making up a pipe stand which is suspended under the upper pipe elevator when in the upper raised position. That is, when at least one pipe single is suspended from the upper pipe elevator when in its upper raised position it is couplable to a pipe single suspended from the lower pipe elevator when in the basal raised position by the device, for example holding or clamping one of the pipe singles suspended in the upper pipe elevator so as to prevent rotation of that pipe single, and then a pipe spinner rotating the pipe single suspended in the lower pipe elevator to make-up or breakdown the pipe-stand in the mast.

The rear of the mast is substantially completely open and unobstructed for removal therethrough of the pipe-stand from the upper pipe elevator when the upper raised position. The sides of the mast provide, at least in part, rigidity to the mast.

In one embodiment, the mast is telescopic and the upper portion of the mast translates telescopically relative to the basal portion of the mast.

The lower pipe elevator may include a u-shaped first collar for engaging or gripping (collectively and alternatively referred to herein as gripping or engaging) a box end upset on the first end of the single. The first collar has an opening for accepting the first end of the single into the u-shaped first collar when engaging the first end of the single at the base of the mast and for elevating the first end of the pipe from the base. The opening into the collar is open towards the pipe support table.

The upper pipe elevator may include a unshaped second collar for gripping the box end on the first end of the pipe, wherein said second collar has an opening for accepting the first end of the single into the unshaped second collar when engaging the first end of the single in said overlap between said upper and basal portion and for elevating the single therefrom. The opening in the collar is open towards the derrick.

In one embodiment the base includes a floor having a pipe receiver therein. The pipe receiver is sized to accept the lower end of the pipe, so as to bear the weight of the pipe on the receiver when the lower pipe elevator is lowered from the basal raised position substantially as the upper pipe elevator is lowered to the upper lowered position and the box end of the single released by the first collar and handed off so as to be engaged by the second collar. The receiver may include means for spinning a pipe about its longitudinal axis when the pipe is resting in the receiver.

In an embodiment a selectively engagable pipe clamp is advantageously provided for rigidly clamping an upper pipe suspended by said upper pipe elevator when the upper pipe is stabbed into a lower pipe resting in said receiver. With the upper pipe clamped to prevent rotation of the upper pipe, and with the lower pipe spun by the receiver, a pipe stand is made up of the upper and lower pipes.

Advantageously a selectively actuable pipe stand positioning arm is provided mountable on the derrick, adjacent said mast. The arm may have a pipe stand engaging means on a free end of the arm for supporting and lifting a pipe stand from the mast through the opening in said rear of the mast, whereby the pipe stand is translatable by the arm from the mast for racking adjacent the derrick and for positioning at well center.

The mast may be pivotally mounted on the pipe support table for pivoting between a storage and transportation position substantially flush down on and along the table, and an erected position extending substantially vertically upwardly from the base.

A method according to the present invention of forming a pipe stand includes the steps of:

(a) providing a supply of pipe singles;

(b) providing an elongate mast mounted at its lowermost end on a base of the mast when vertical having a top end, a bottom end and a mid section;

(c) providing in co-operation with the mast a lower and an upper hoist means for sequentially hoisting pipe singles upwardly along the mast, (d) loading a first single on the base so as to engage a first end of the first single with the lower hoist means, (e) hoisting the first single from the horizontal to the vertical along the mast so as to position the first end of the first single at the mid section;

(f) lowering the first single so as to engage the opposite second end of the first single with the bottom end of the mast and so as to disengage the lower hoist means from the first end of the first single;

(g) engaging the upper hoist means with the first end of the first single and elevating the first single further upwardly along the mast while lowering the lower hoist means to engage the first end of a second single on the base, (h) loading the second single upwardly along the mast until the second single is positioned generally parallel therewith and wherein the second single is positioned in substantially coaxial alignment with the first single;

(i) lowering the first and second singles so as to engage the opposite second end of the second single, opposite its first end, with a selectively actuable rotating means for rotating the second single onto the first single;

(j) torquing the first and second singles so as to tighten the first single onto the second single while threadably engaging the second end of the first single down onto the first end of the second single by rotating at least the second single about its longitudinal axis so as to mount the first single to the second single during the rotation whereby co-operating threads on each opposing end of the first and second singles are engaged to form a pipe stand.

The method may further include repeating steps (d)-(j) to form a three-single pipe stand. The method may further include again repeating steps (d)-(j) to form a four-single pipe stand.

The method may further include the steps of engaging a racking arm to rack, remove and position. the pipe stand from the mast for use in the derrick.

The method may include the step of providing an elongate telescoping stand forming mast includes, and may include providing the mast with a front which faces a supply of horizontally stored singles stored on a horizontal pipe rack side of the mast, an opposite rear or a derrick side of the mast, and sides on opposite sides of the mast between the front and the rear, and wherein the front includes a front opening which is completely open between the mid-section and the base and sized so that the singles as they are hoisted from the horizontal to the vertical within the mast are drawn through the front opening without contacting the mast, and wherein the rear includes a rear opening which is completely open and sized for removal of the made-up pipe stand therethrough while maintaining a vertical orientation.

The pipe stand handling system is mounted near the center of the pipe path. The support and spanning components may thus be smaller than in the prior art due to the reduction of reach required. The apparatus stabilizes and supports a pipe stand being transported between the well bore axis in a derrick and a pipe rack such that unwanted movement of the pipe stand, which affects the rate of racking, may be reduced, and wherein the apparatus is mounted in the pipe flow or transfer path, thereby increasing racking efficiency. A rotating gate according to the present invention in combination with an articulated arm provides, in essence, a means to pass drill pipe from above the well bore to a pipe rack through a side of an oil well drilling rig or beam assembly supporting the rotating gate and spanning the opening providing access to the racking board.

In particular, in one preferred embodiment, the apparatus includes a rotatable gate assembly mounted between the pipe rack and derrick so as to be within the pipe transfer path. The rotatable gate assembly includes a substantially unshaped collar having an associated drive and an arm. The collar defines a gate opening to receive and secure an upper portion of a pipe stand. The collar is rotatably mounted relative to a support frame. The first end of the arm is pivotably and rotatably mounted below the collar, for example to a lower end of a shaft or tube on which the collar is mounted. A releasable pipe mount is mounted to the second end of the arm, opposite the first end, to engage a predetermined portion of the pipe stand. The releasable pipe mount may include an upper securing means which engages for example an upper or mid-portion of the pipe stand and a lower securing means such that the lower securing means may securely engage a lower portion of the pipe stand. The upper and lower securing means may be mounted on a pipe mount carriage, which may be an arm, elongate frame, etc., to provide support for, and stability to the pipe stand, while it is transferred along its transfer path between the derrick and the rack.

The upper securing means may be a pair of independently actuable retractable jaws extendable to engage the pipe stand to prevent movement of the pipe stand relative to the pipe mount. The lower securing means may be a support member, for example a collar, attached to a lower end of a carriage on which the jaws are mounted such that the support member may receive the pipe stand to support the weight of the pipe stand and prevent movement of the lower portion of the pipe stand relative to the pipe mount. In such an embodiment the lower securing means may be the primary support for the pipe stand. The support member may be configured to engage and mate with a tool joint on the pipe stand.

The apparatus further comprises a first actuator configured to tilt the carriage and the upper and lower securing means mounted thereon such that the pipe stand once securely engaged by the upper and lower securing means may be raised, for example along the well bore axis, by a second actuator on the carriage and maintained vertical by the first actuator for transport between the well bore axis in the derrick and the pipe rack by translation of the pipe stand through the side of the derrick. In one embodiment, when engaging the lower securing means with the pipe stand, the second actuator raises the carriage to slide the lower securing means upwards to engage the tool joint on the pipe stand.

The arm is pivoted relative to the collar by a third actuator which may be mounted between the first end of the arm and the shaft or tube such that the arm may displace between a vertical position immediately below the collar and substantially parallel to the pipe stand and an angled position wherein the carriage is translated away from the collar and is brought adjacent to the pipe stand, for example in either the well bore axis in the derrick or in the pipe rack. The arm displaces between the vertical position and into the angled position so that the carriage on the end of the arm may securely engage the upper and lower securing means to the pipe stand in the derrick. The arm may then be retracted, that is, returned to the vertical to bring the pipe stand to mate in the gate collar. In use, the collar is then rotated one hundred eighty degrees in a horizontal plane so as to rotationally carry the pipe stand one hundred eighty degrees with it. The arm may then displace between the vertical position and the angled position such that the arm may transfer the pipe stand securely engaged to the upper and lower securing means to and from the pipe rack.

A drive mechanism rotates the rotatable gate assembly between a pipe engaging position, wherein the rotatable gate assembly is in operable communication with the derrick, and a pipe racking position, wherein the rotatable gate assembly is in operable communication with the pipe rack. The pipe rack comprises a frame and a plurality of support members such as so-called fingers, wherein each of the support members are attached to the frame at a first end only such that a central gap or slot is defined between the support members. The support members capture and retain a pipe stand when the arm racks the pipe stand into a slot between the support members.

BRIEF DESCRIPTION OF THE DRAWINGS

These and other features of the invention will become more apparent from the following description in which reference is made to the appended drawings wherein similar characters of reference denote corresponding parts in each view.

DETAILED DESCRIPTION OF EMBODIMENTS OF THE INVENTION

Figure 1A:
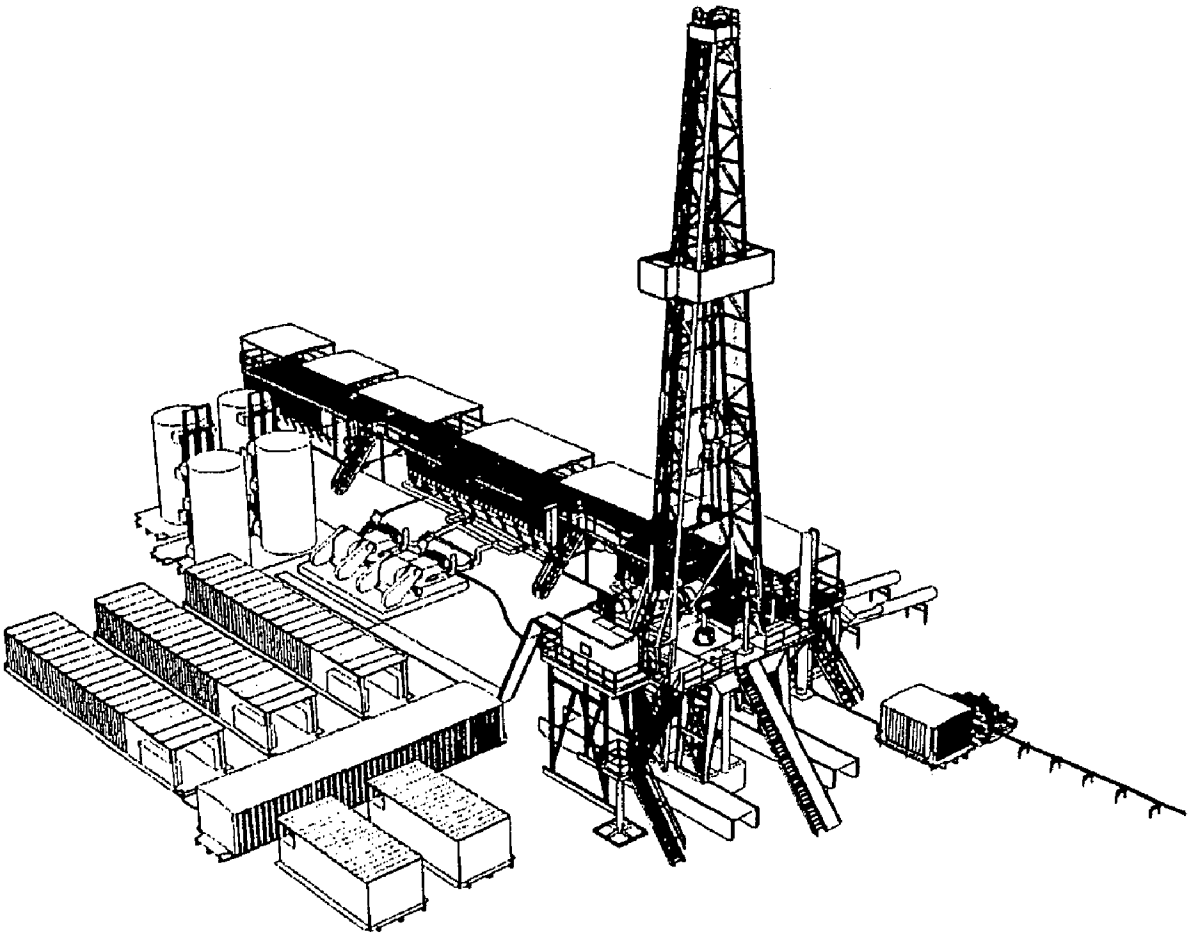
FIG 1a PRIOR ART
FIG. 1*a* is, in front perspective view, a conventional oil drilling rig.
Figure 1B:
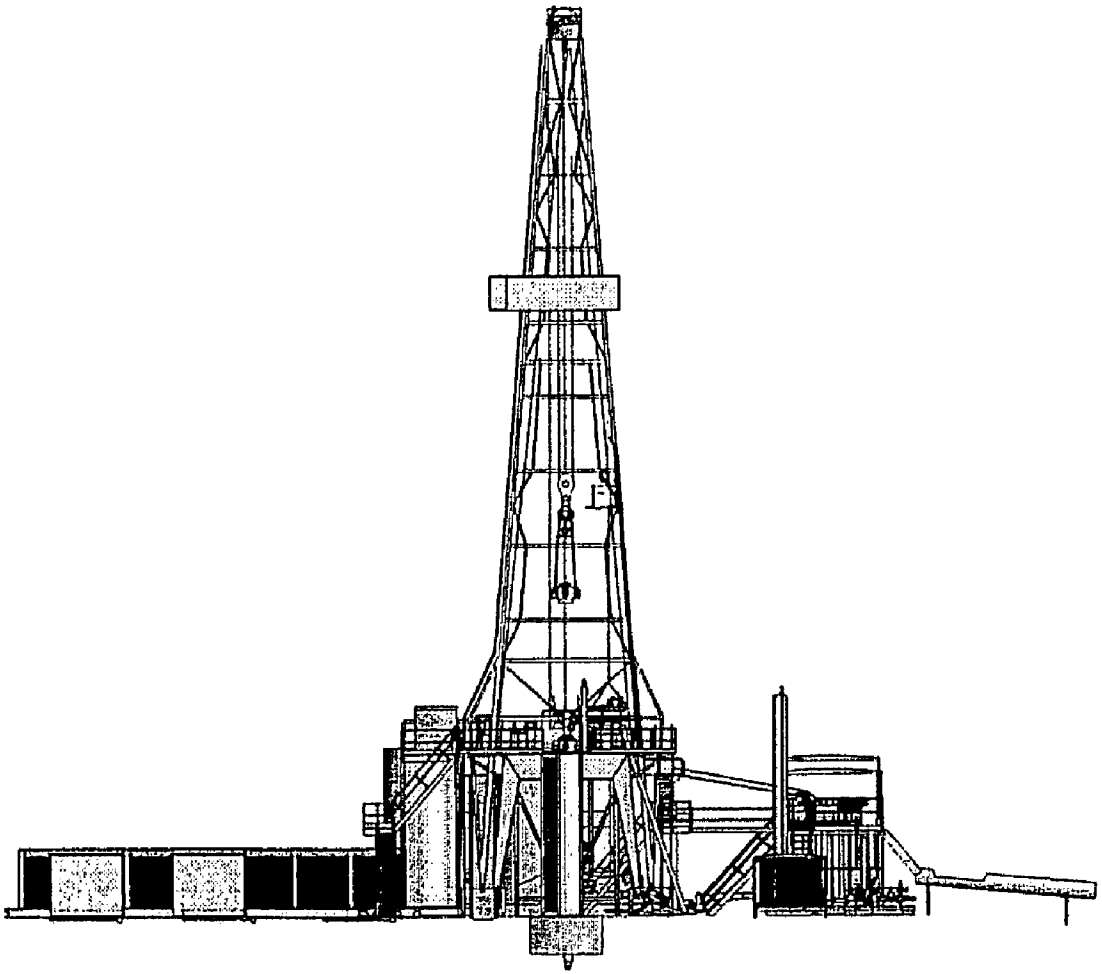
FIG 1b PRIOR ART
FIG. 1*b* is, in front elevation view, the oil drilling rig of FIG. 1*a*.
Figure 2A:
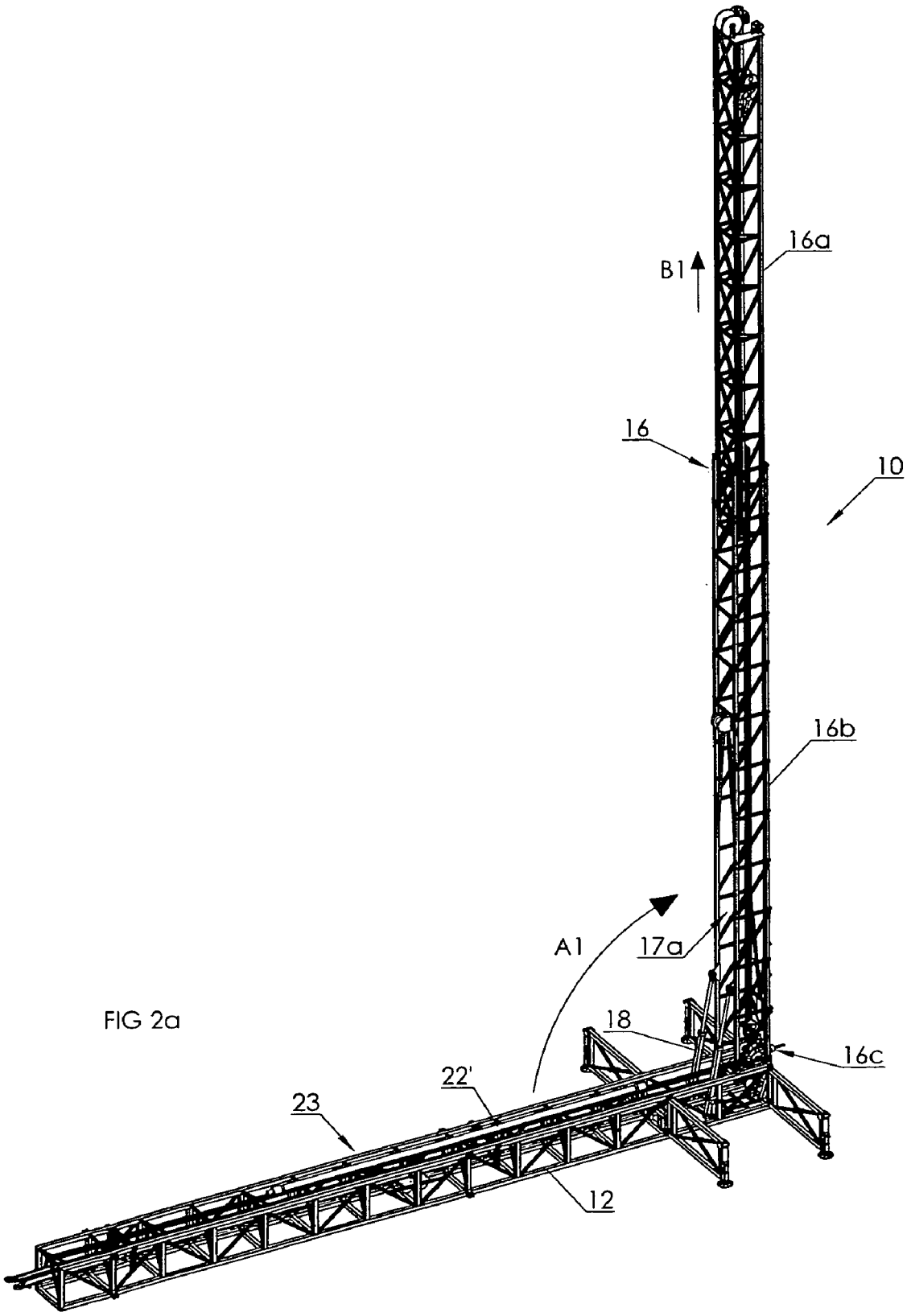
FIG. 2*a* is, in front perspective view, the pipe support table and pipe stand building mast according to one aspect of the present invention showing a first pipe single on the table, having been indexed onto the table from adjacent conventional pipe racks.
Figure 2B:
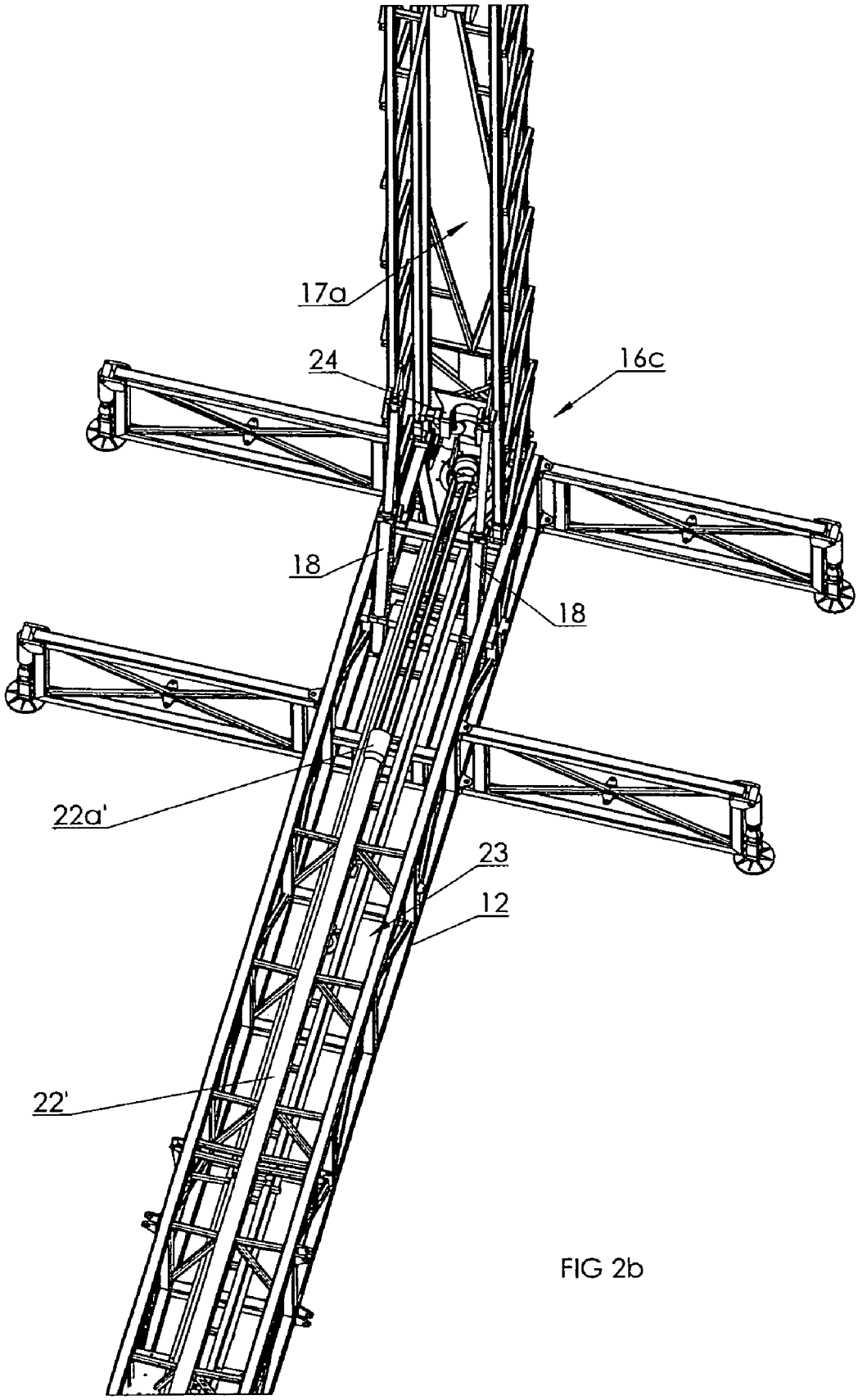
FIG. 2*b* is an enlarged view of the intersection between the table and mast in FIG. 2*a*.
Figure 2C:
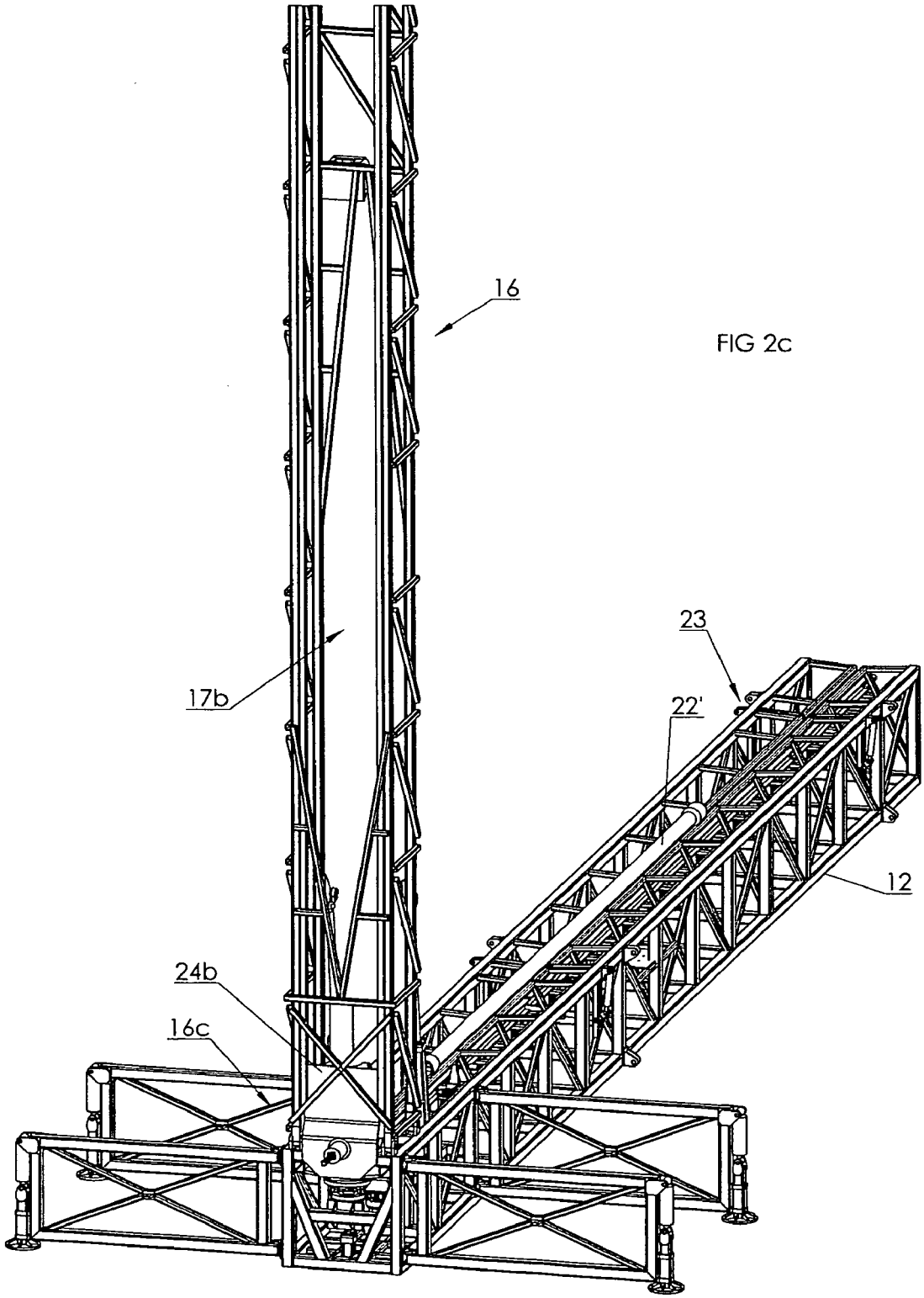
FIG. 2*c* is, in rear perspective view, the intersection of the mast and the table.
Figure 3A:
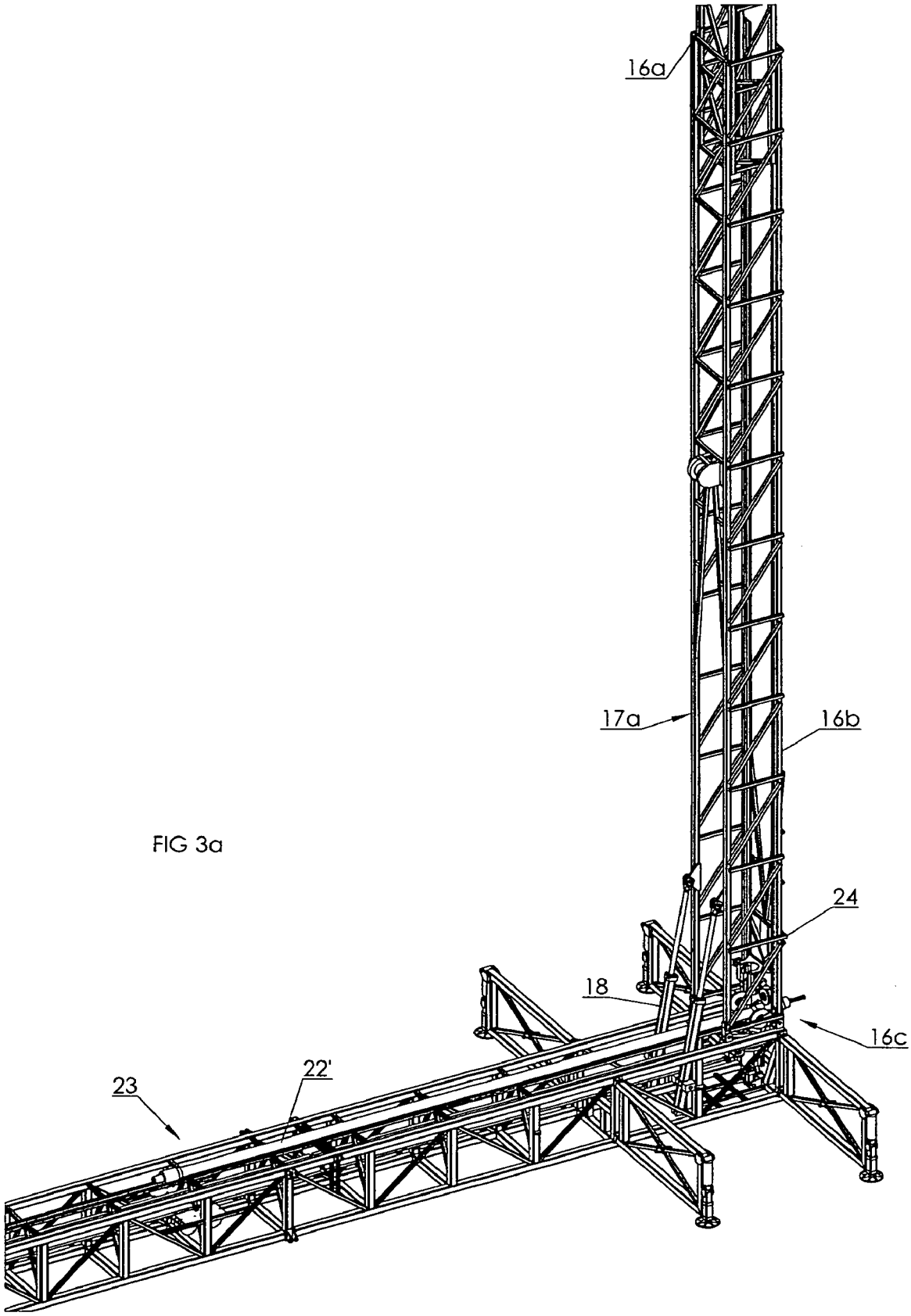
FIG. 3*a* is the mast and table of FIG. 2*a* showing the first single pipe translated along the table so as to position the box end of the pipe in the base of the mast with the box and upset positioned in the elevator collar of the lift plate.
Figure 3B:
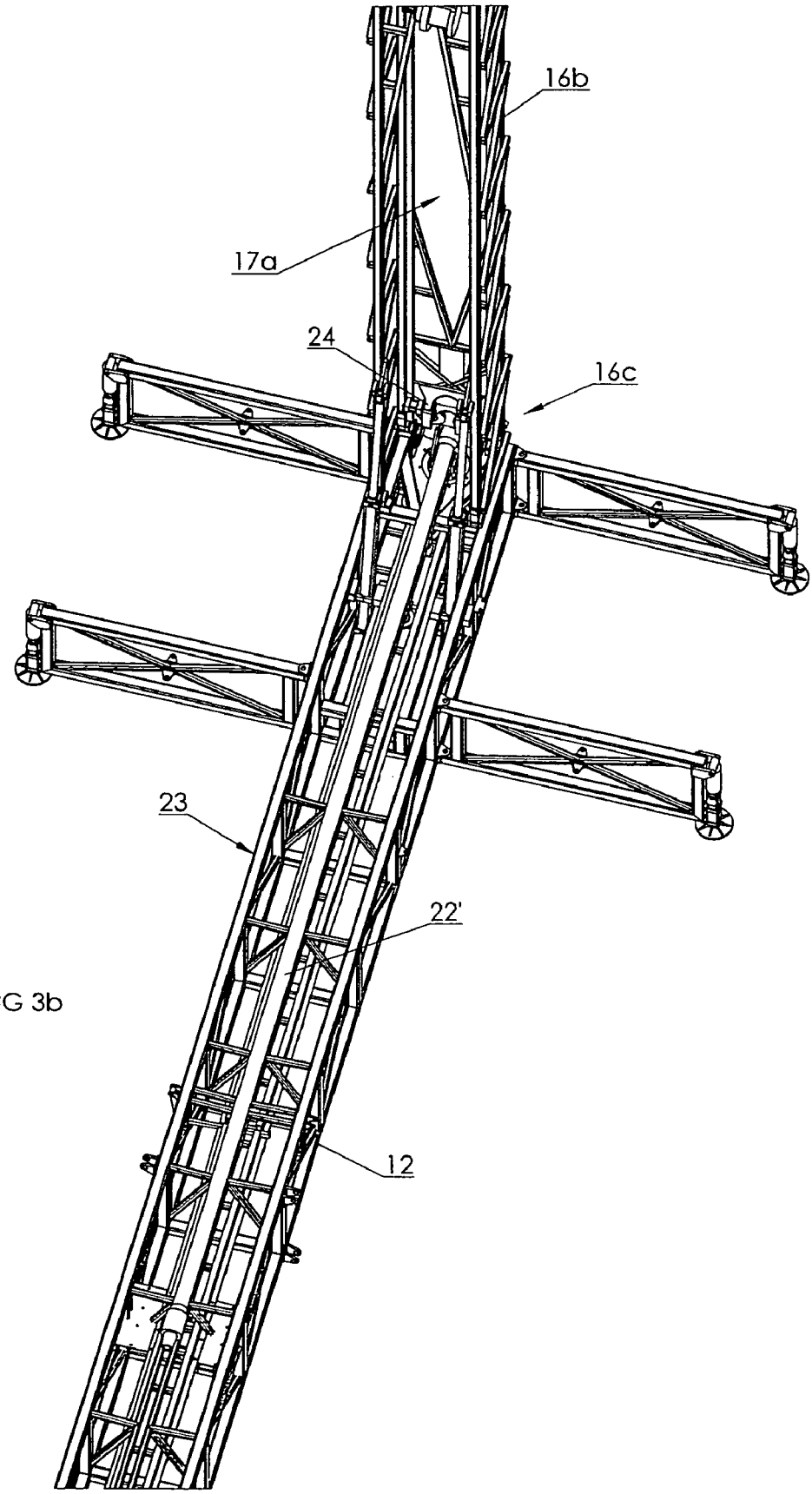
FIG. 3*b* is an enlarged view of the intersection of the table and mast of FIG. 3*a*.
Figure 3C:
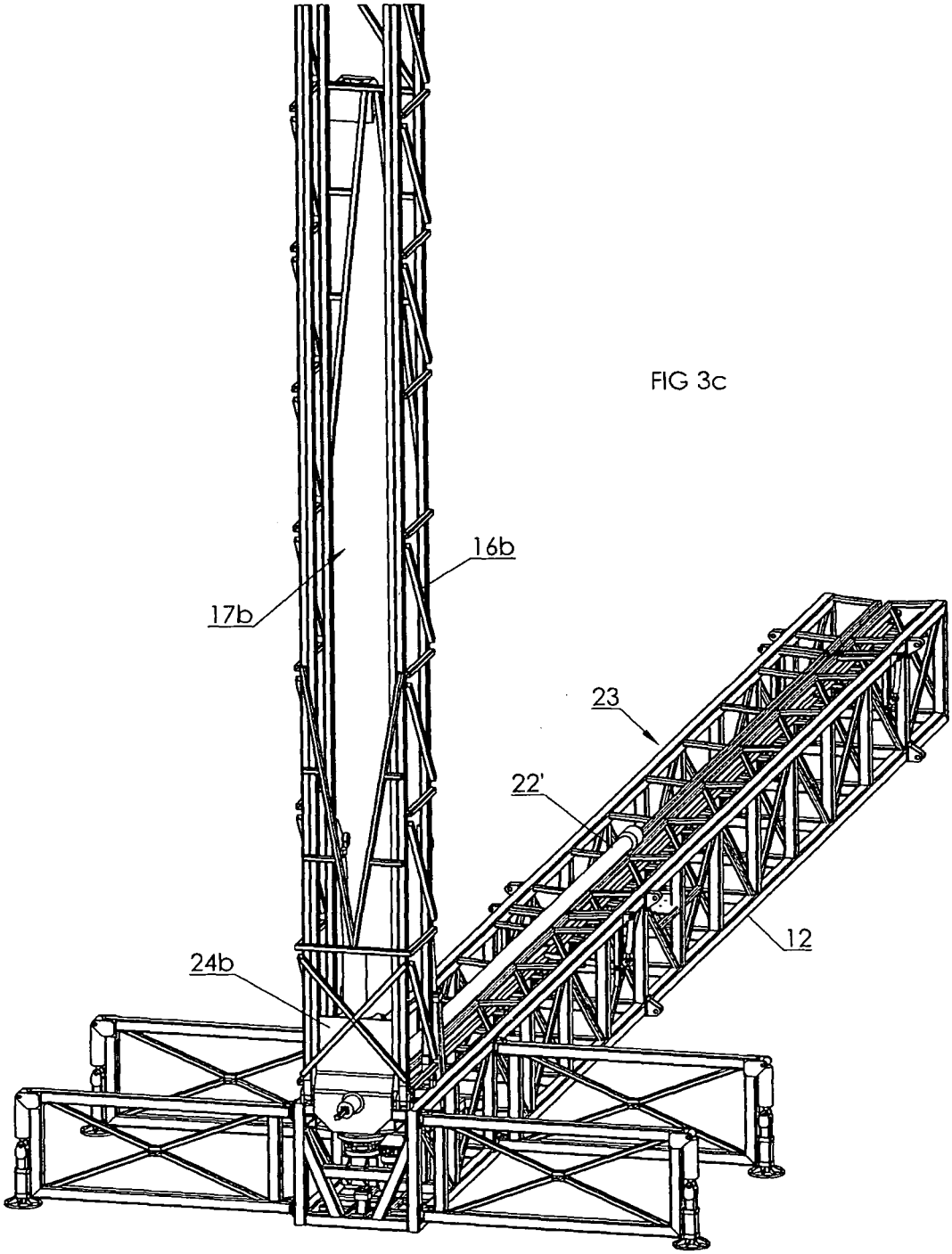
FIG. 3*c* is, in rear perspective view, the intersection of the mast and table of FIG. 3*b*.

The vertical offline pipe stand building and manipulating system 10 according to the present invention includes a mast assembly 16, advantageously including a hydraulically raised telescoping upper mast portion 16*a* and basal mast portion 16*b*, mounted on an oilfield skid 12. The skid is positioned adjacent to the existing catwalk and the substructure 14 of the oilrig. The mast 16 is pivoted in direction A1 from a horizontal storage and transportation position to the vertical by actuation of hydraulic actuators 18, Upper mast portion 16*b* is then telescoped vertically upwards in direction B1 towards a racking board 20. The racking board 20 may be modified on the catwalk side to provide a structural jog or extension 20*a* which provides an extended aperture 20*b* therethrough for a vertical stand of pipes 22 to extend into when being built as better described below. Pipe stand 22 as described herein is a triple stand made-up of three pipe singles 22', 22", and 22'" respectively. It is understood that it is intended, as would be appreciated by one skilled in the art, that with sufficiently. sized components, the present invention may be employed to make-up quad pipe stands or greater.

Briefly, in operation first single pipe joint 22' is conveyed horizontally on pipe support table 23 into position in the base end 16*c* of mast 16. Pipe dope (thread lubricant) is applied to the threads in joint 22', preferably by an automatic application device. A measuring plate moves to the pin end of the joint of pipe so that the length of the joint of pipe may be logged in the pipe tally data logger. In the present embodiment, which is not intended to be limiting, the box end of the pipe is positioned through the substantially entirely open front opening 17*a* of the mast and thereby into in the base end 16*c* of the mast, leaving the pin end of the pipe in a trailing position on the pipe support table 23.

Figure 4A:
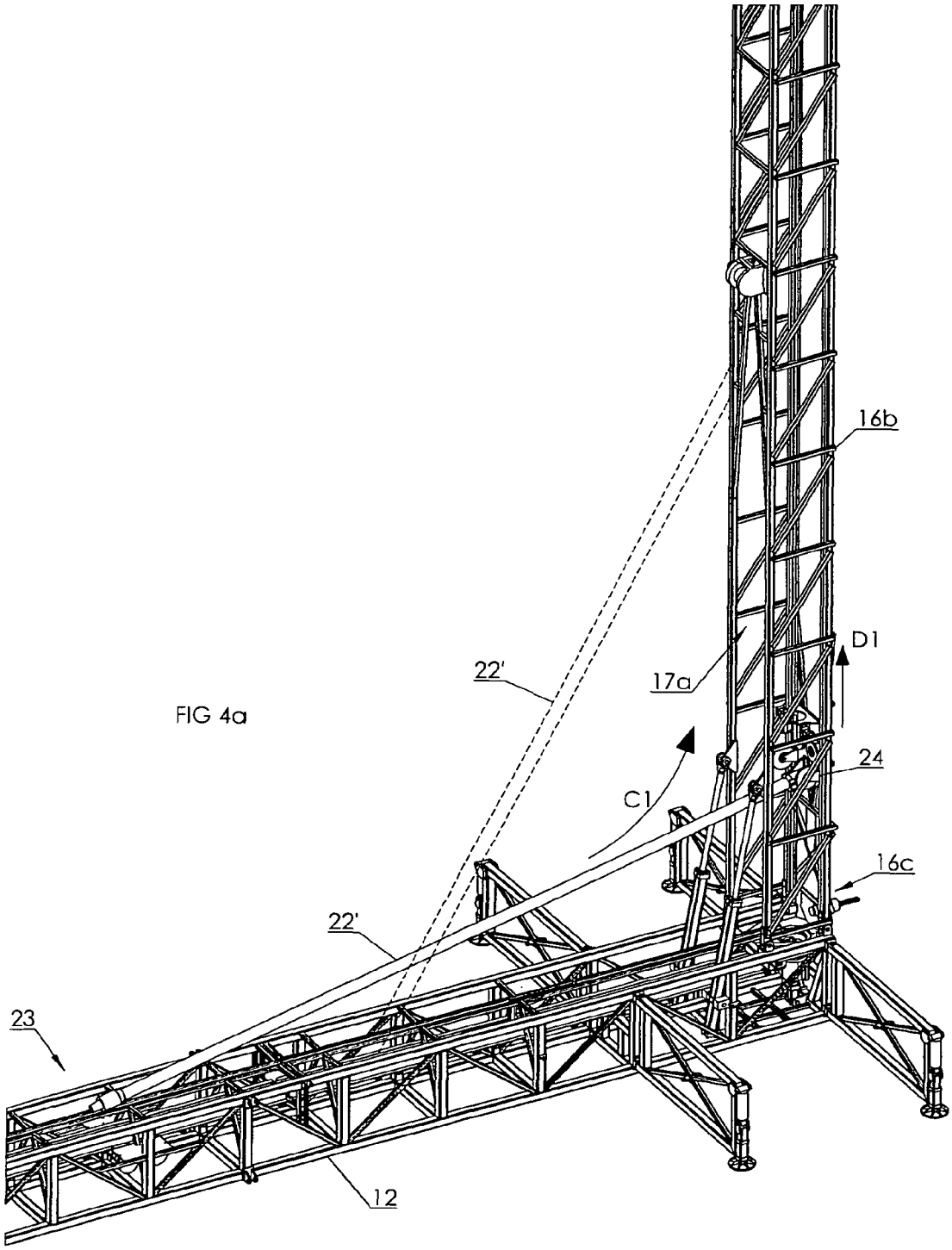
FIG. 4*a* is the mast and table of FIG. 3*a* showing the first pipe having its box end lifted up the mast by the lifting plate wherein the cables hoisting the lift plate are removed in this and subsequent views so as to clarify the drawings.
Figure 9A:
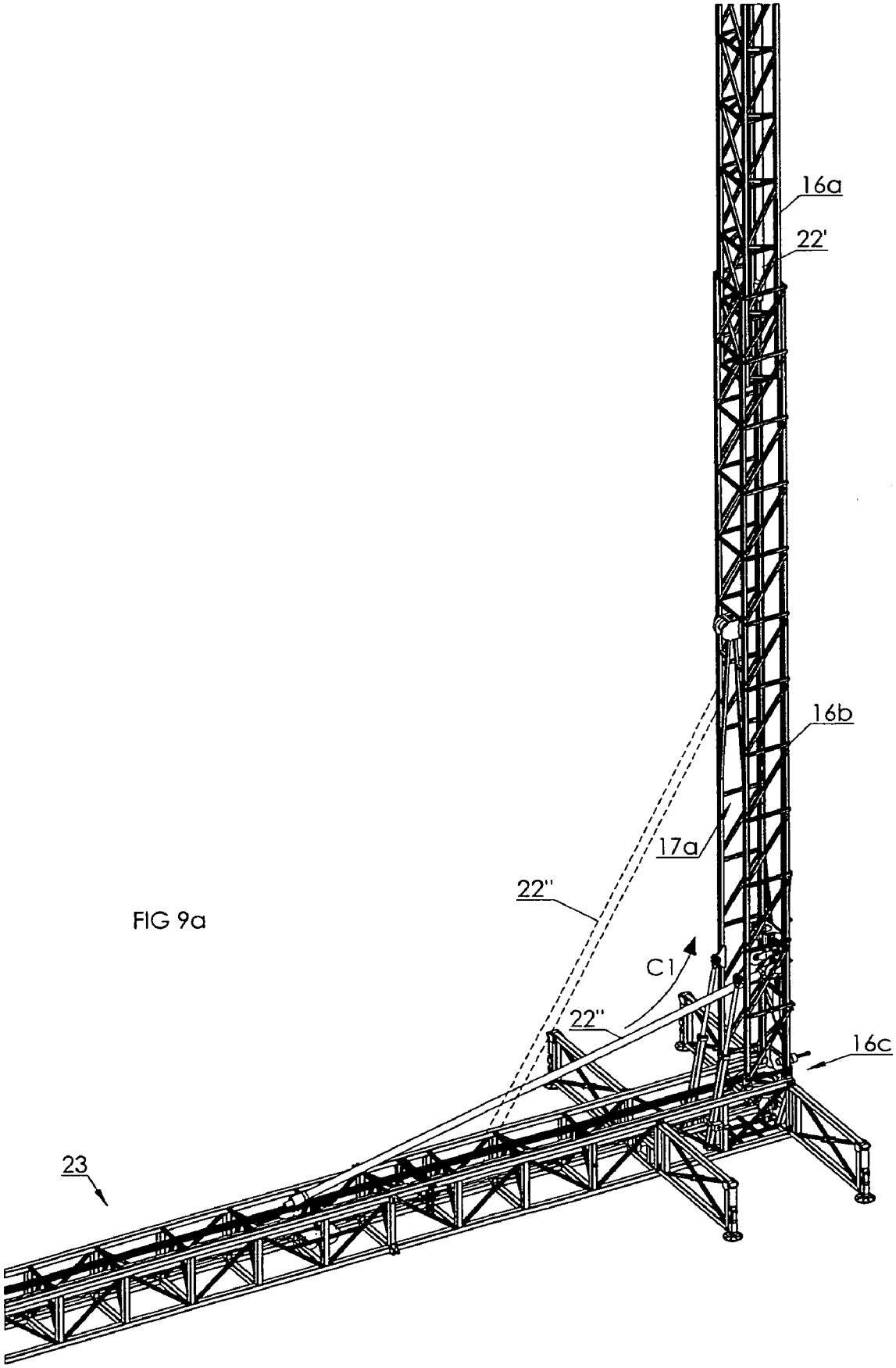
FIG. 9*a* is the mast and table of FIG. 8*a* showing the second pipe being lifted by the lifting plate.
Figure 9B:
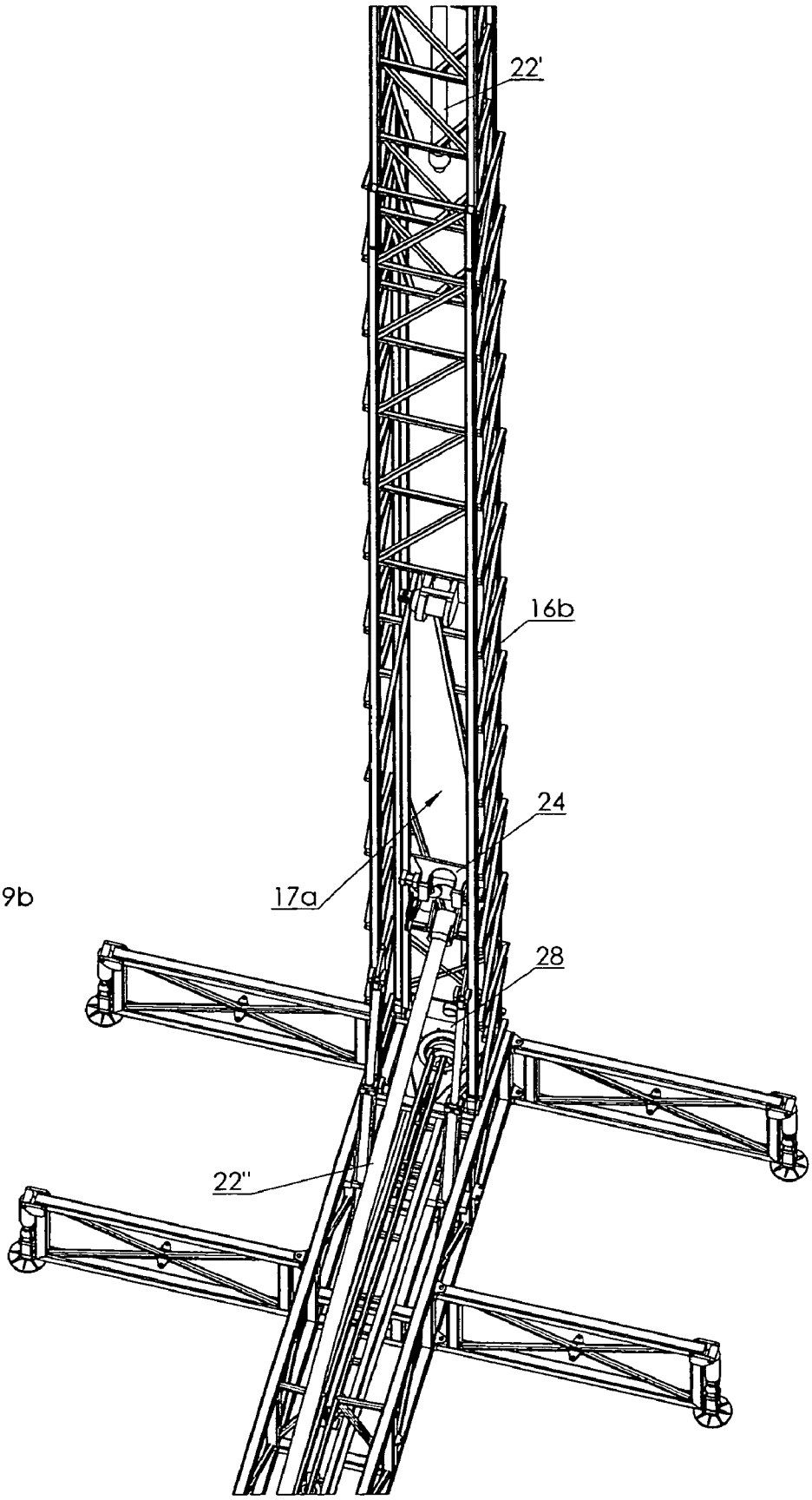
FIG. 9*b* is an enlarged front perspective view of the intersection of the mast and table of FIG. 9*a*.
Figure 9C:
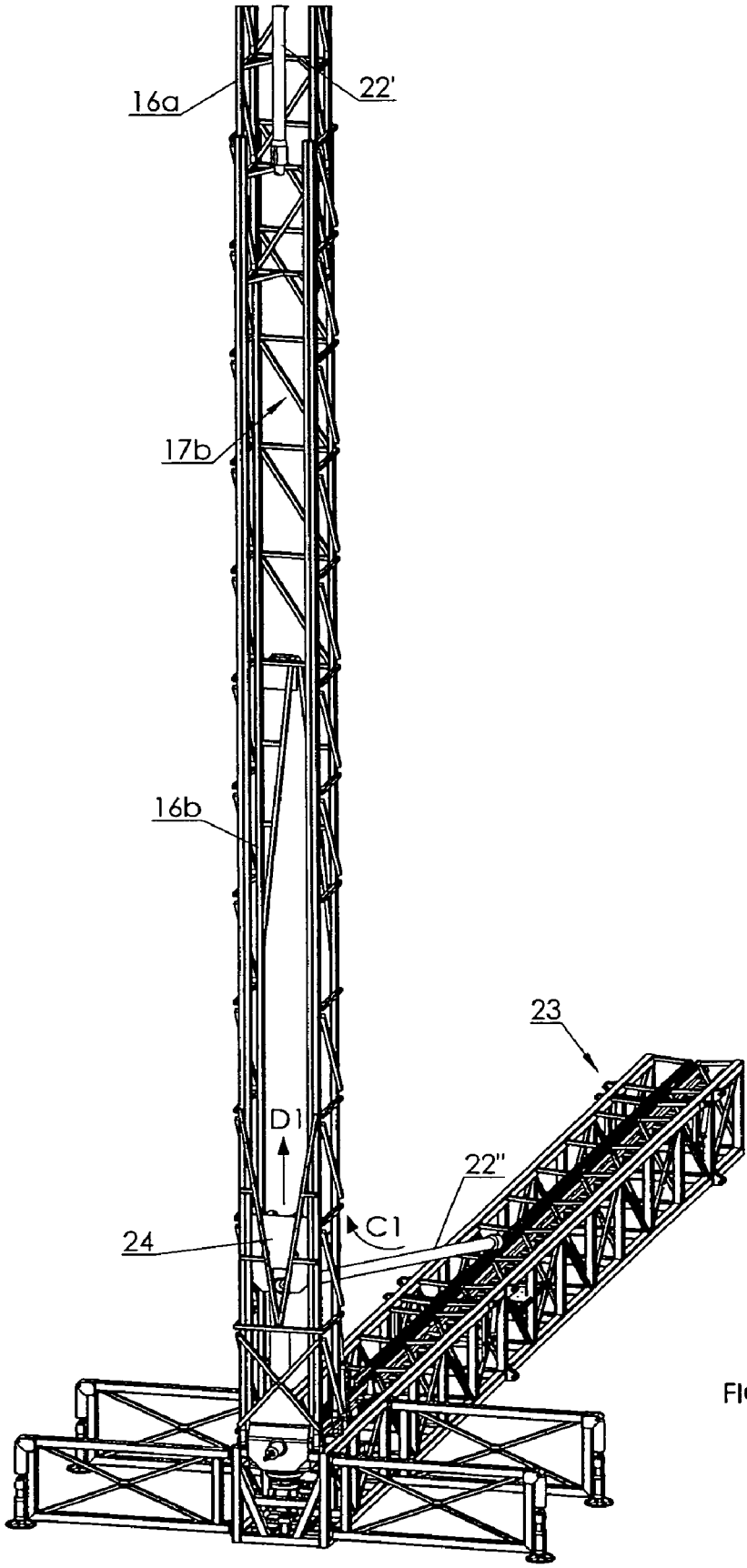
FIG. 9*c* is a rear perspective view of the mast and table of FIG. 9*b*.
Figure 10A:
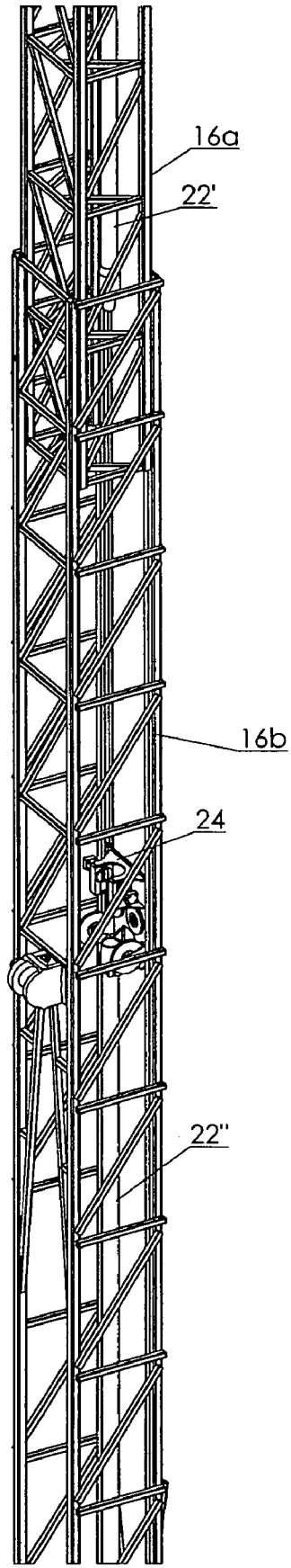
FIG. 10*a* is a front perspective view of the mast of FIG. 9*a* showing the second pipe having been elevated to the vertical by the lifting plate and the pin end of the second pipe resting on the floor of the mast.
Figure 10B:
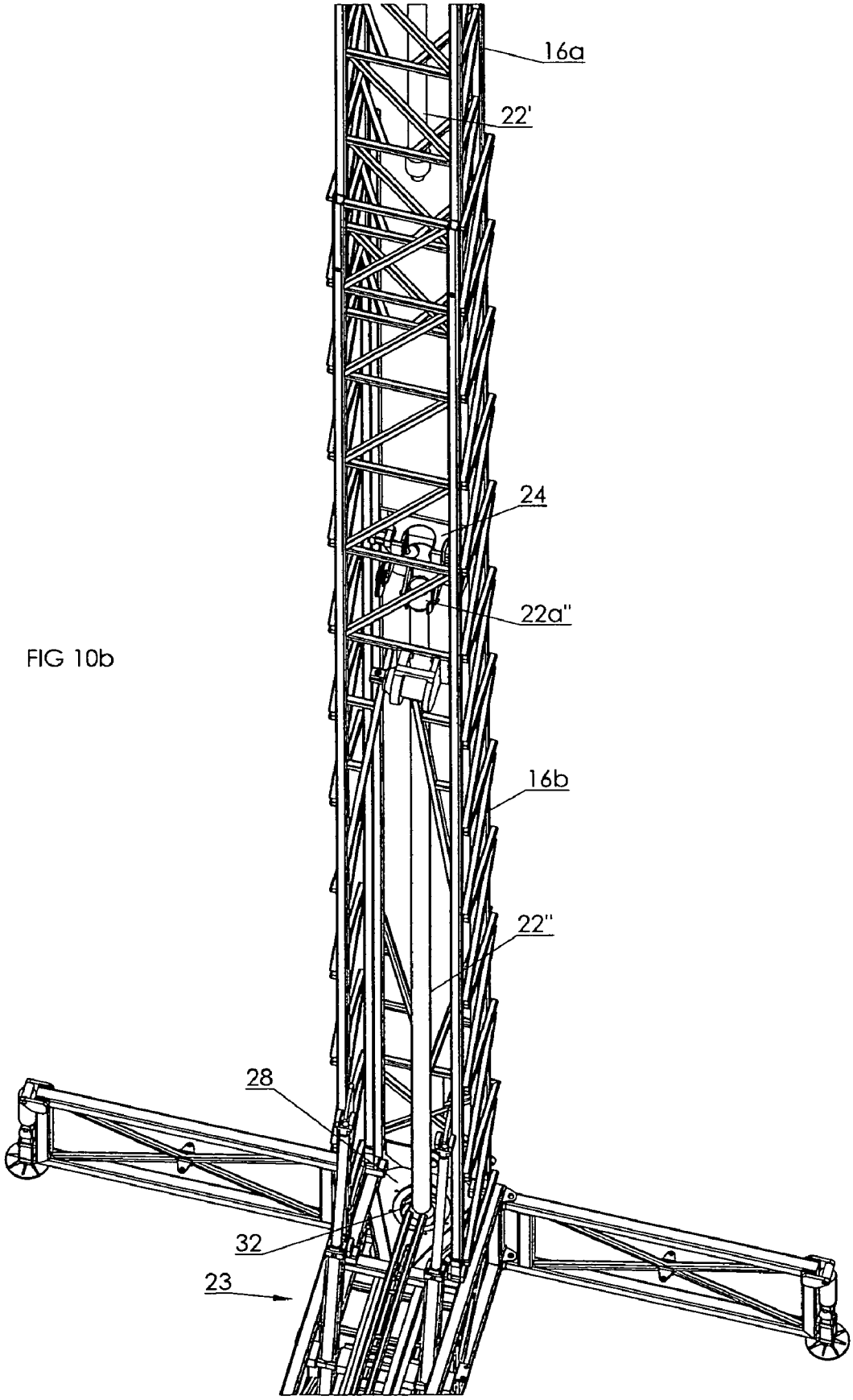
FIG. 10*b* is an enlarged front perspective view of FIG. 10*a*.
Figure 10C:
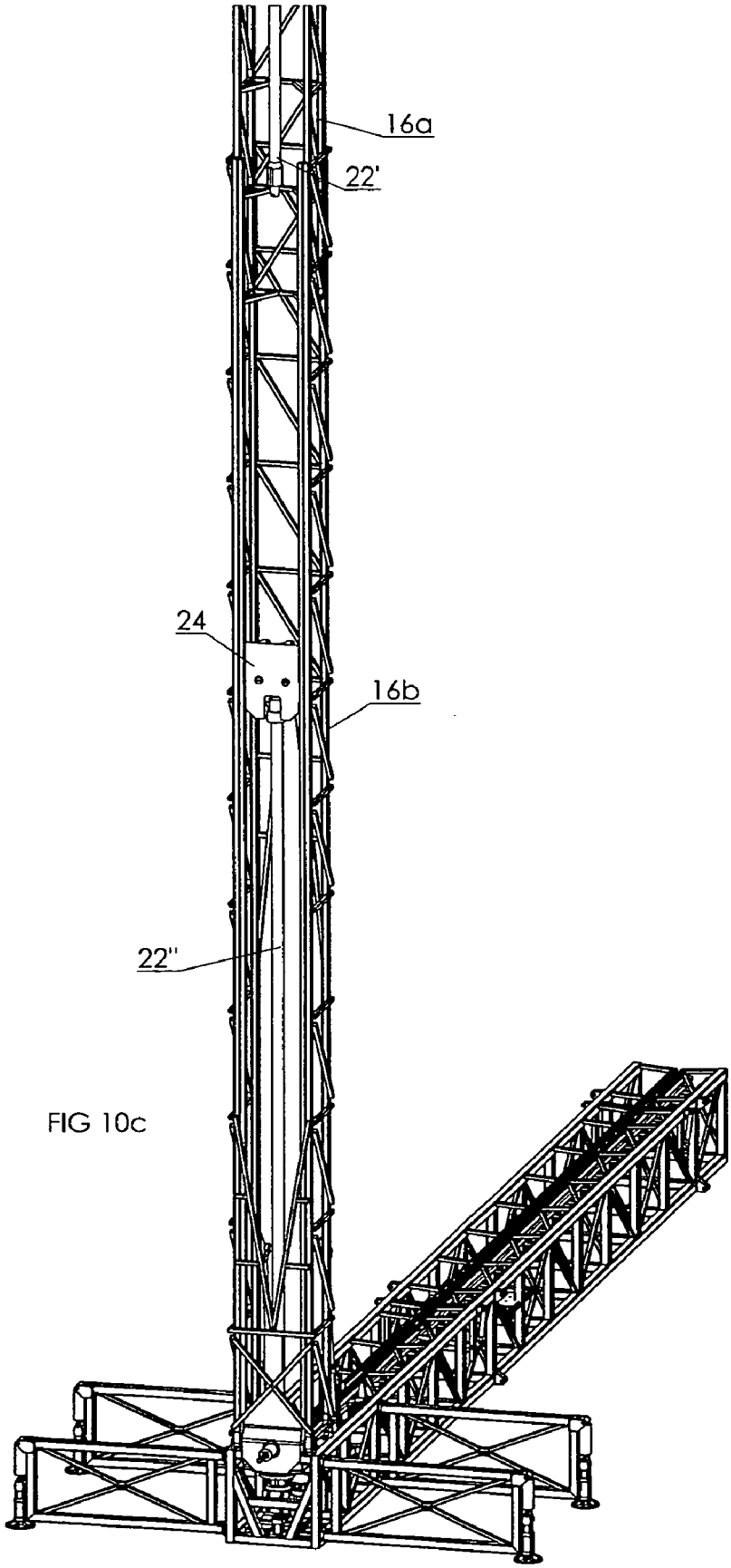
FIG. 10*c* is a rear perspective view of FIG. 10*b*.
Figure 11A:
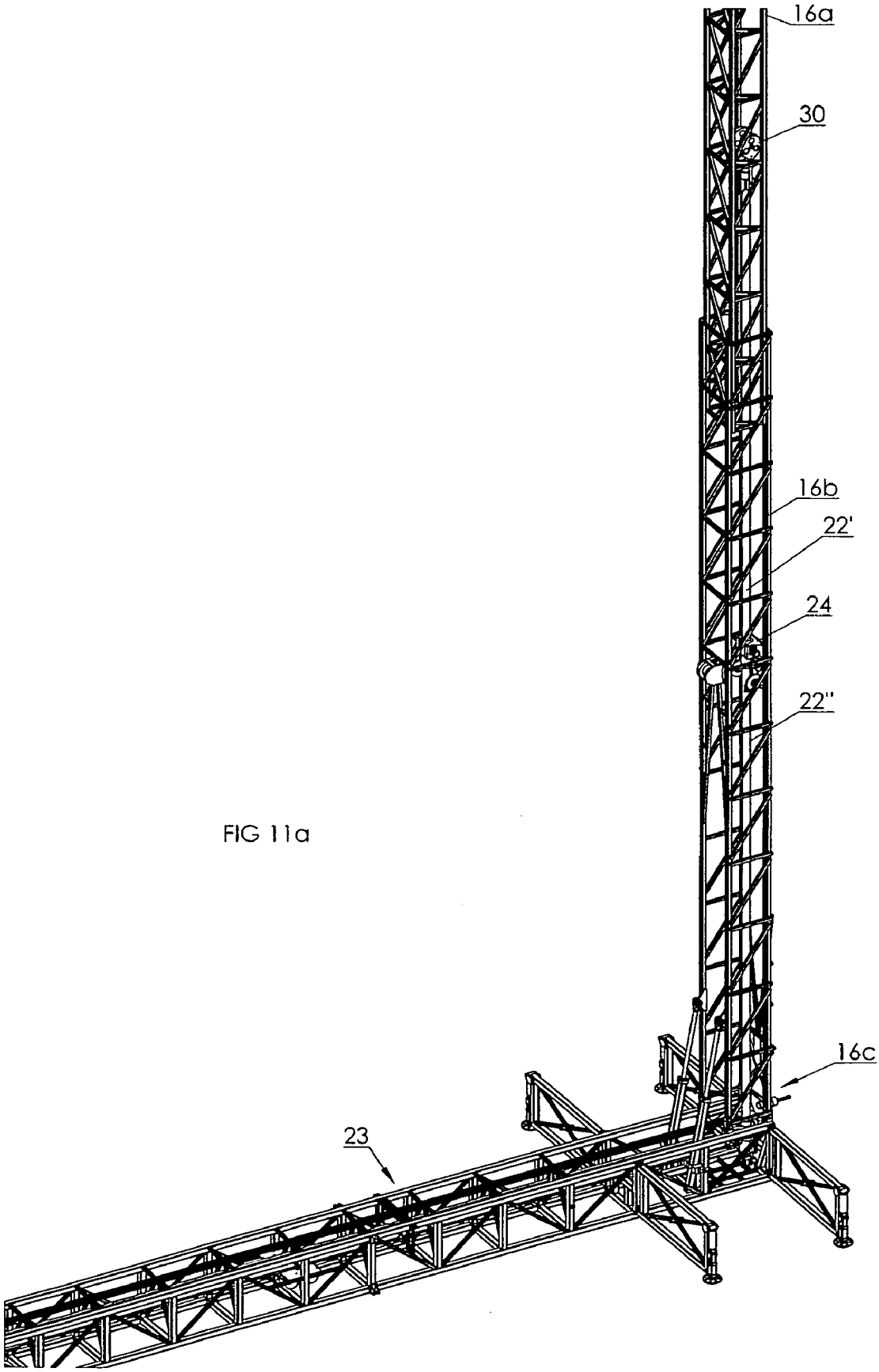
FIG. 11*a* is the mast and table of FIG. 10*a* showing the first pipe having been lowered so as to stab its pin end into the box end of the second pipe and the second pipe spun by the pipe spinner in the base of the mast so as to thread the box end of the second pipe onto the pin end of the first pipe while supported by the lifting plate and travelling block respectively.
Figure 11B:
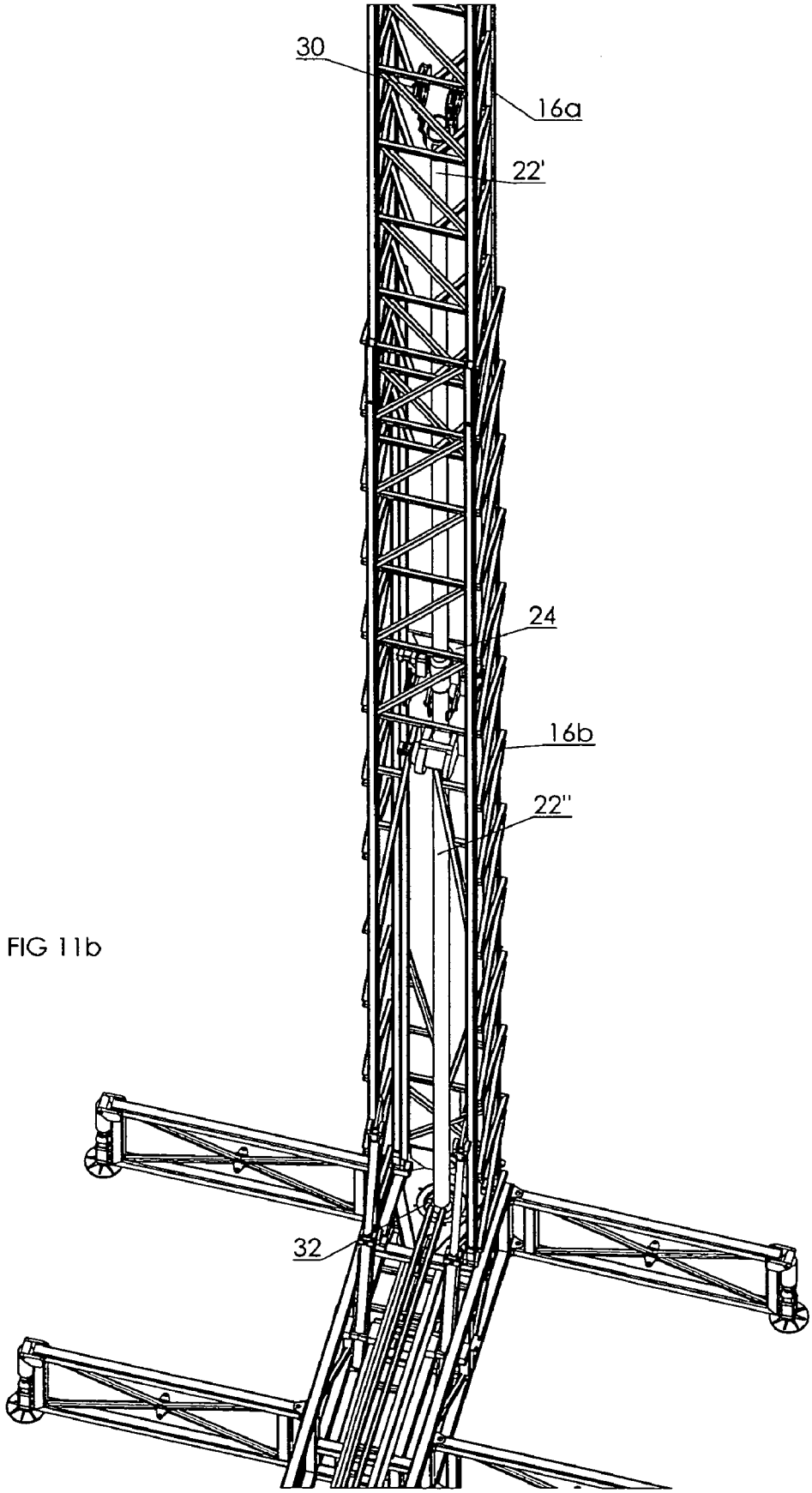
FIG. 11*b* is an enlarged front perspective view of FIG. 11*a*
Figure 11C:
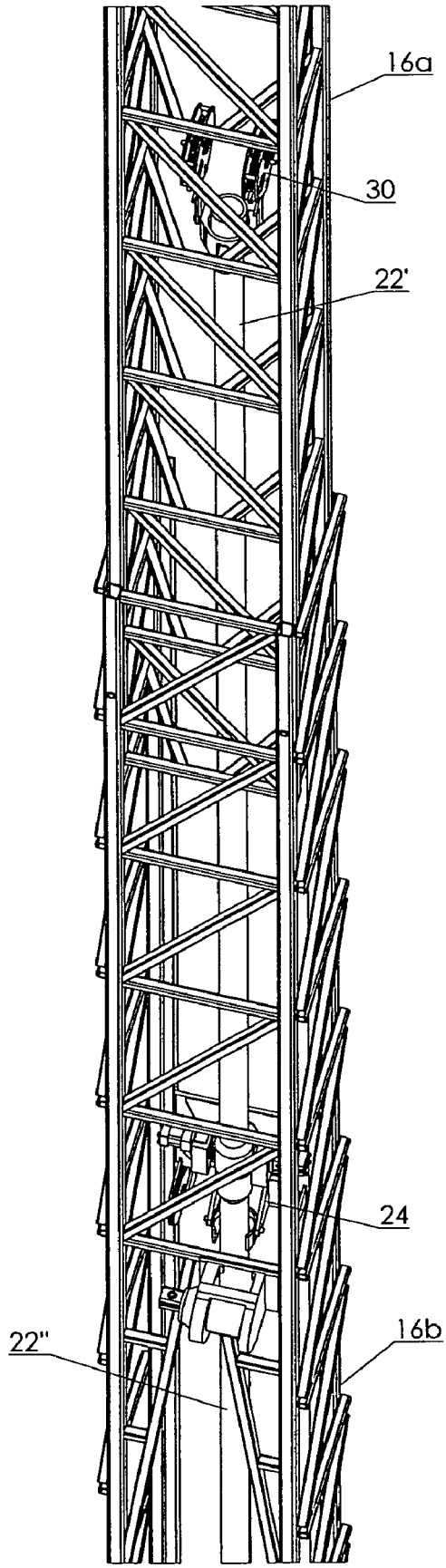
FIG. 11*c* is a rear perspective view of FIG. 11*b*.
Figure 11D:
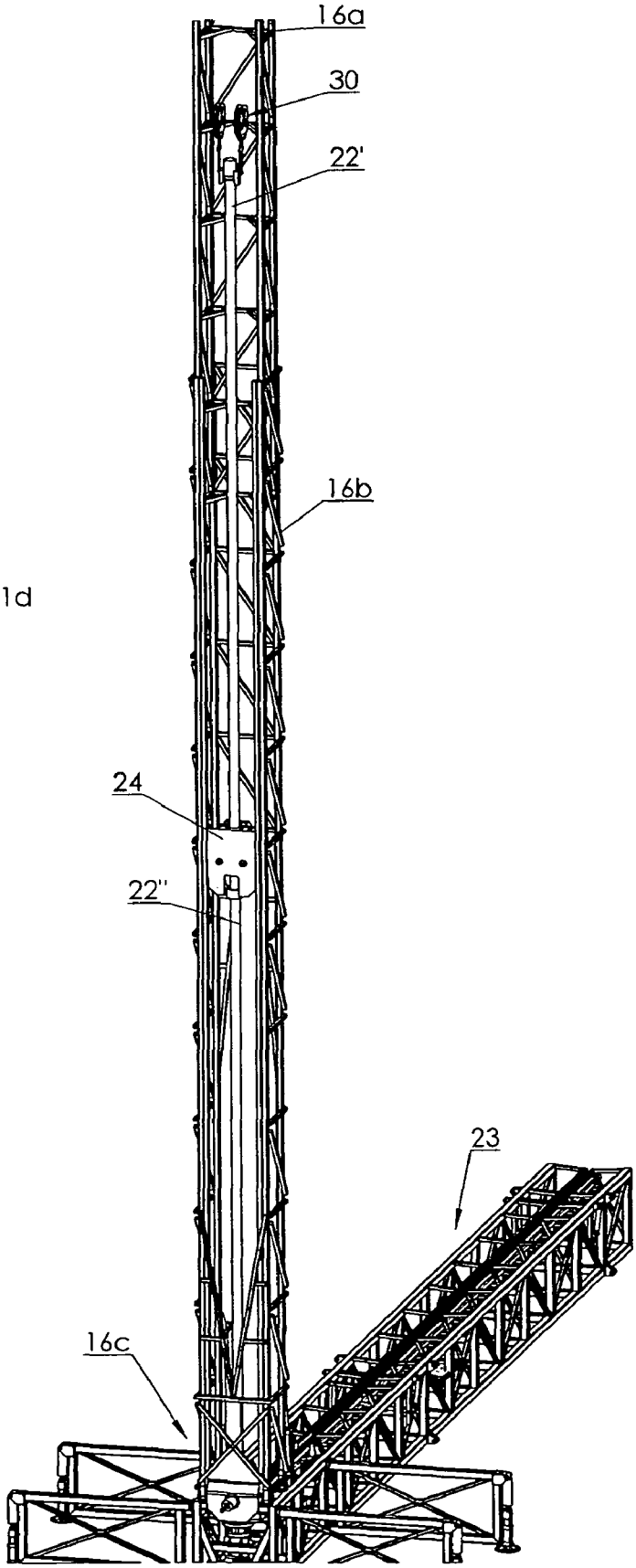
FIG. 11*d* is a rear perspective view of FIG. 11*b*.
Figure 12A:
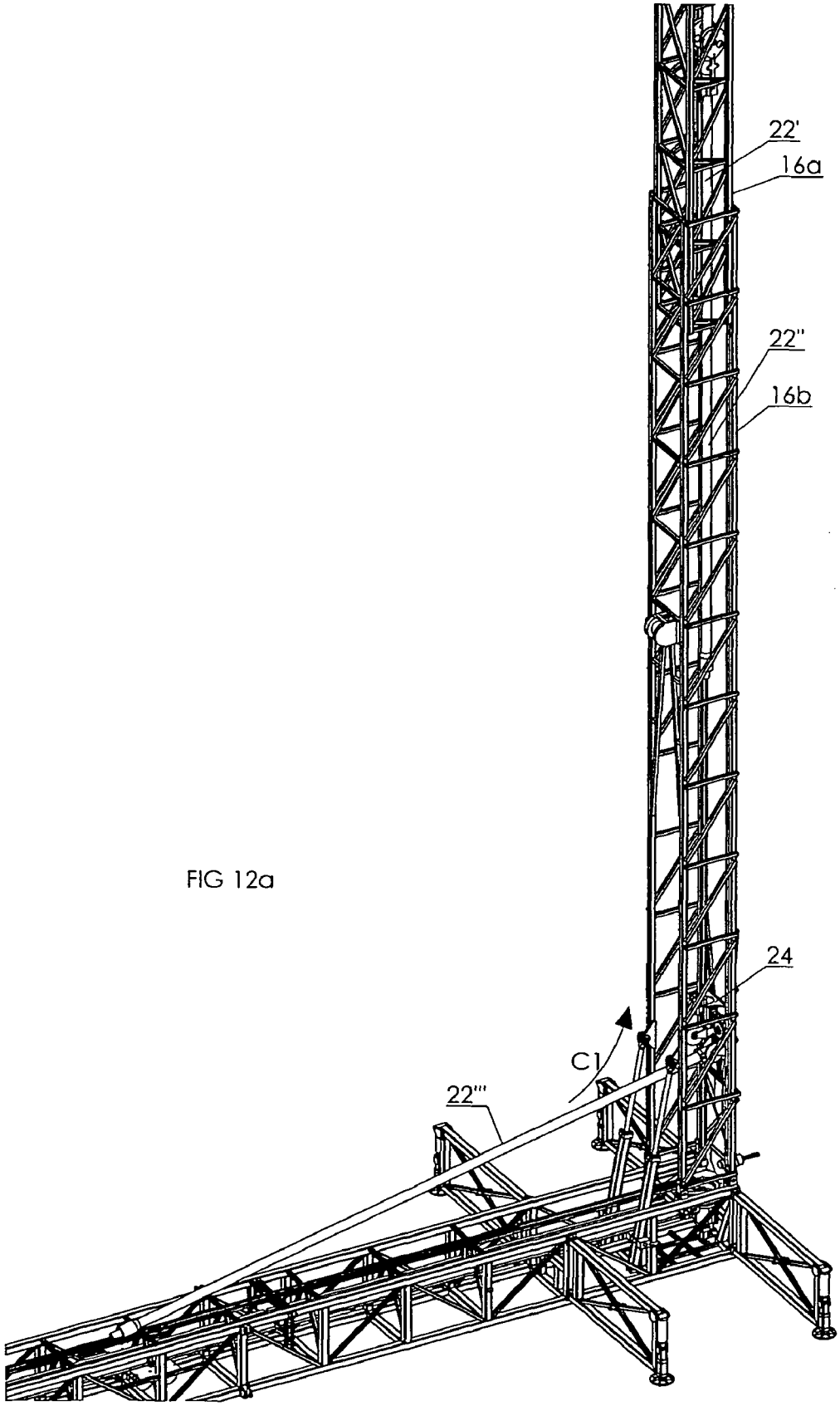
FIG. 12*a* is the derrick and table of FIG. 11*a* showing the lifting plate, having lowered and engaged a third pipe positioned on the table, the lifting plate elevating the third pipe to the vertical.
Figure 12B:
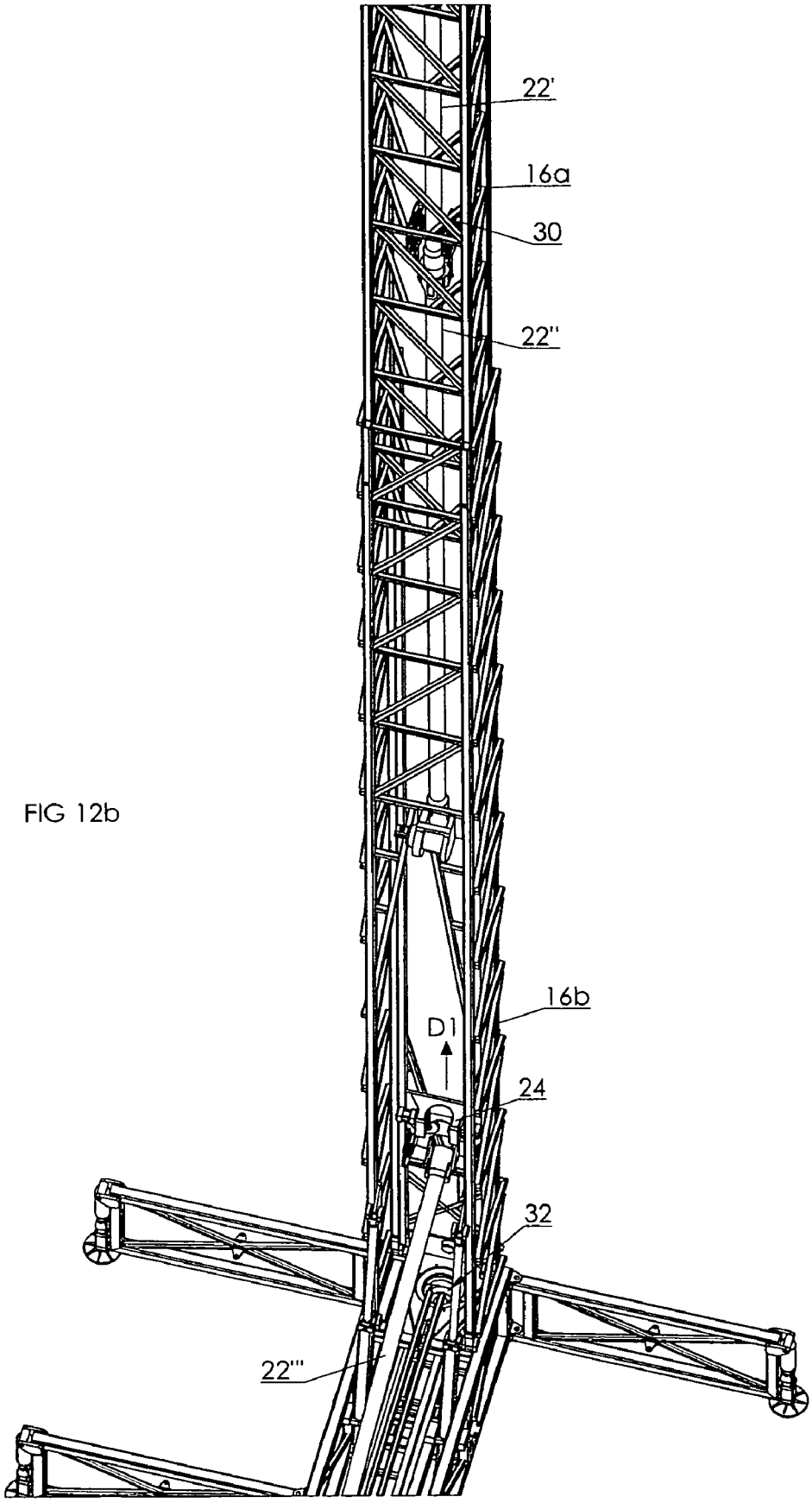
FIG. 12*b* is an enlarged front perspective view of the intersection of the mast and table of FIG. 12*a*.
Figure 12C:
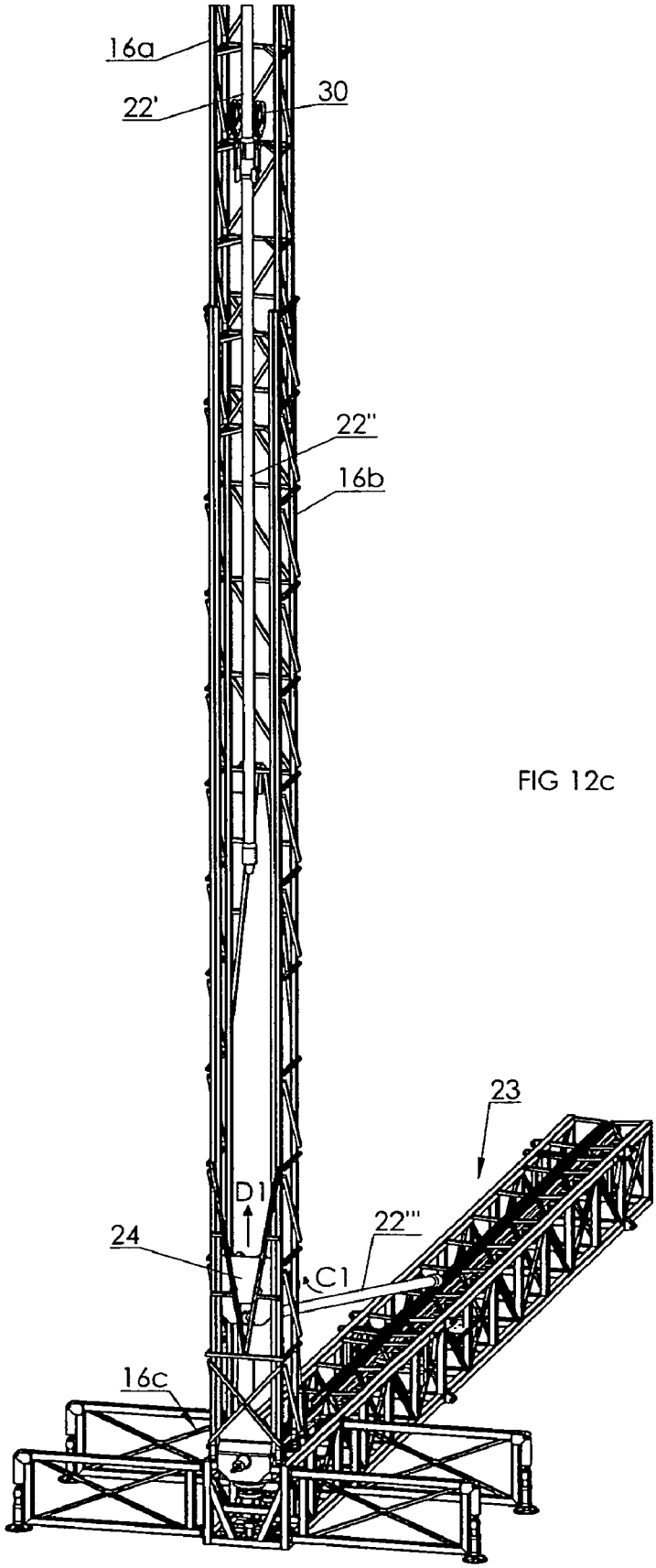
FIG. 12*c* is a rear perspective view of FIG. 12*b*.
Figure 13A:
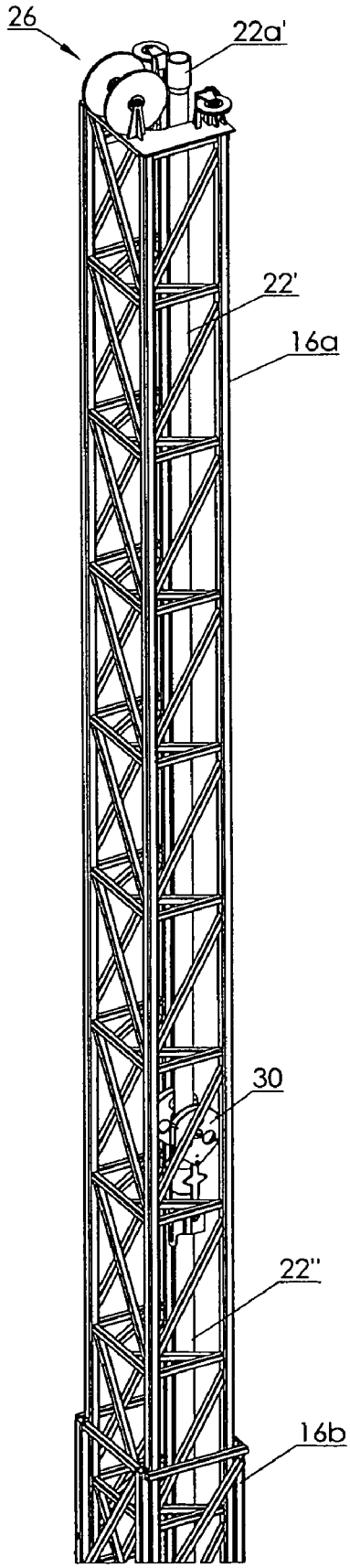
FIG. 13*a* is a perspective view of the top of the mast of FIG. 12*a* showing the made-up pipe stand supported by the travelling block engaging the tool joint between the first and second pipes and suspending the made-up first and second pipes so that the top of the first pipe protrudes from the top of the mast and the bottom of the second pipe is stabbed into the third pipe suspended vertically in the mast by the lifting plate and threaded onto the second pipe by the pipe spinner in the base of the mast.
Figure 13B:
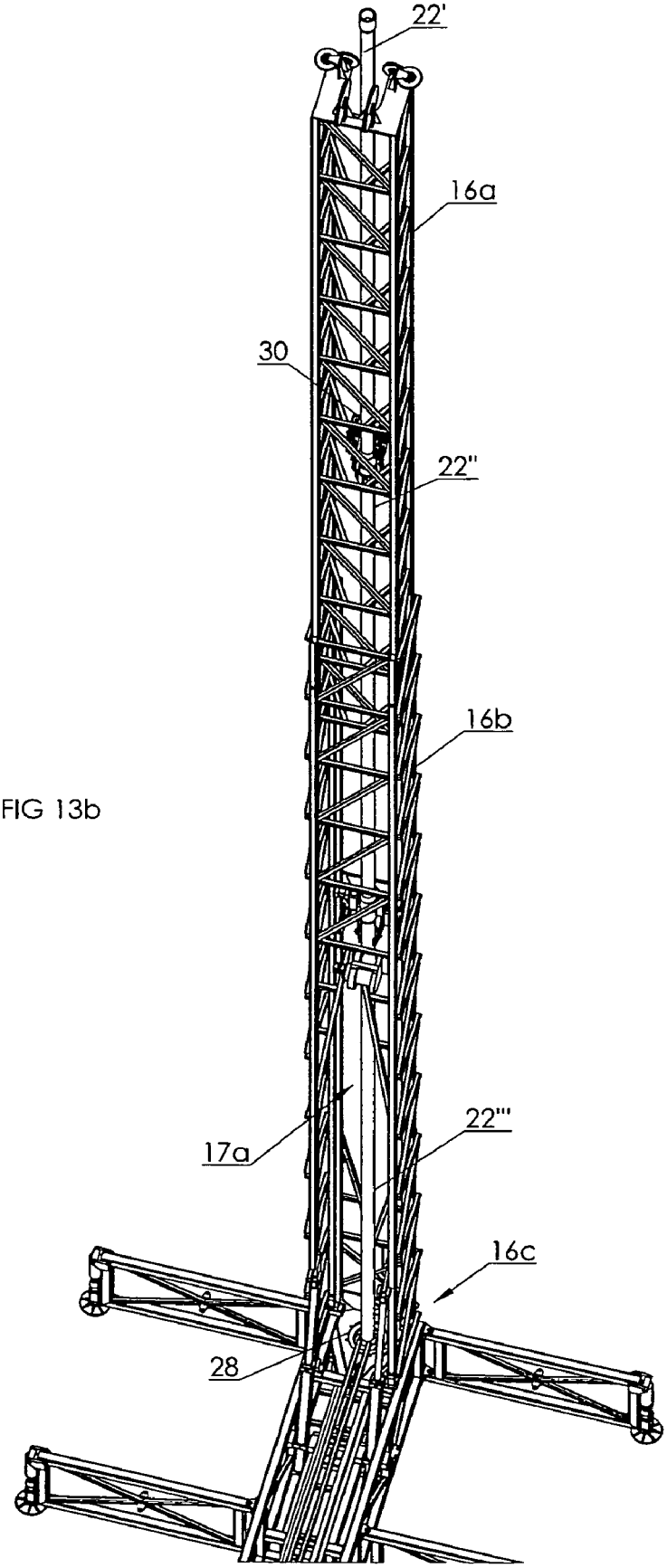
FIG. 13*b* is front perspective view of the intersection of the mast and table of FIG. 12*b*
Figure 13C:
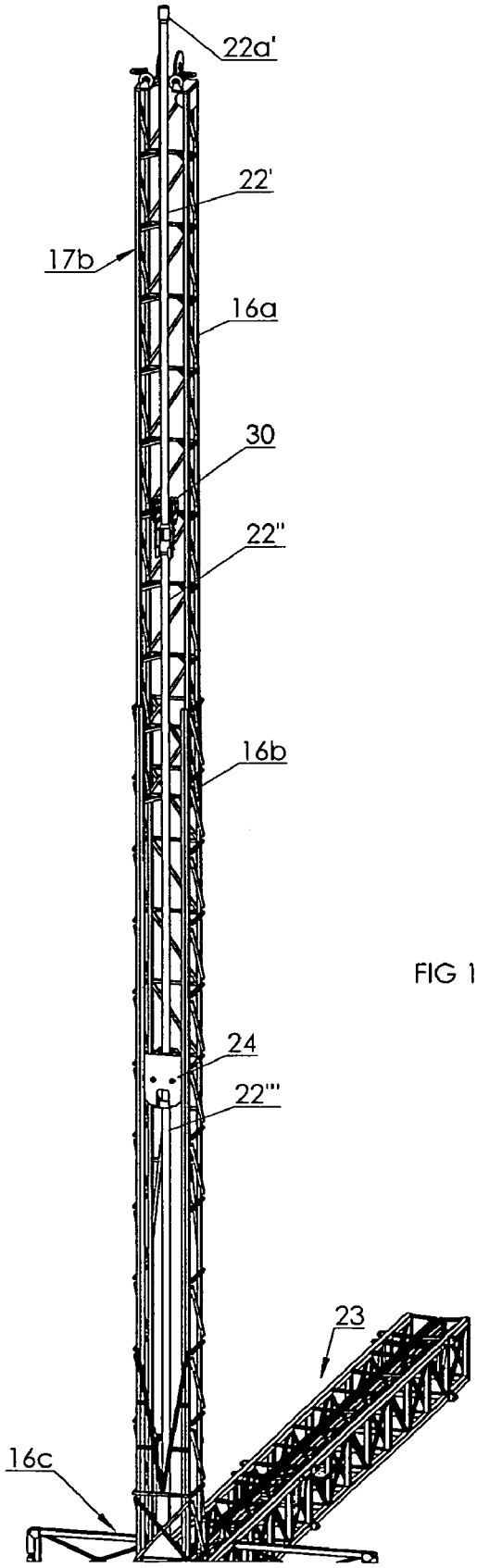
FIG. 13*c* is a rear perspective view of FIG. 13*b*.
Figure 14:
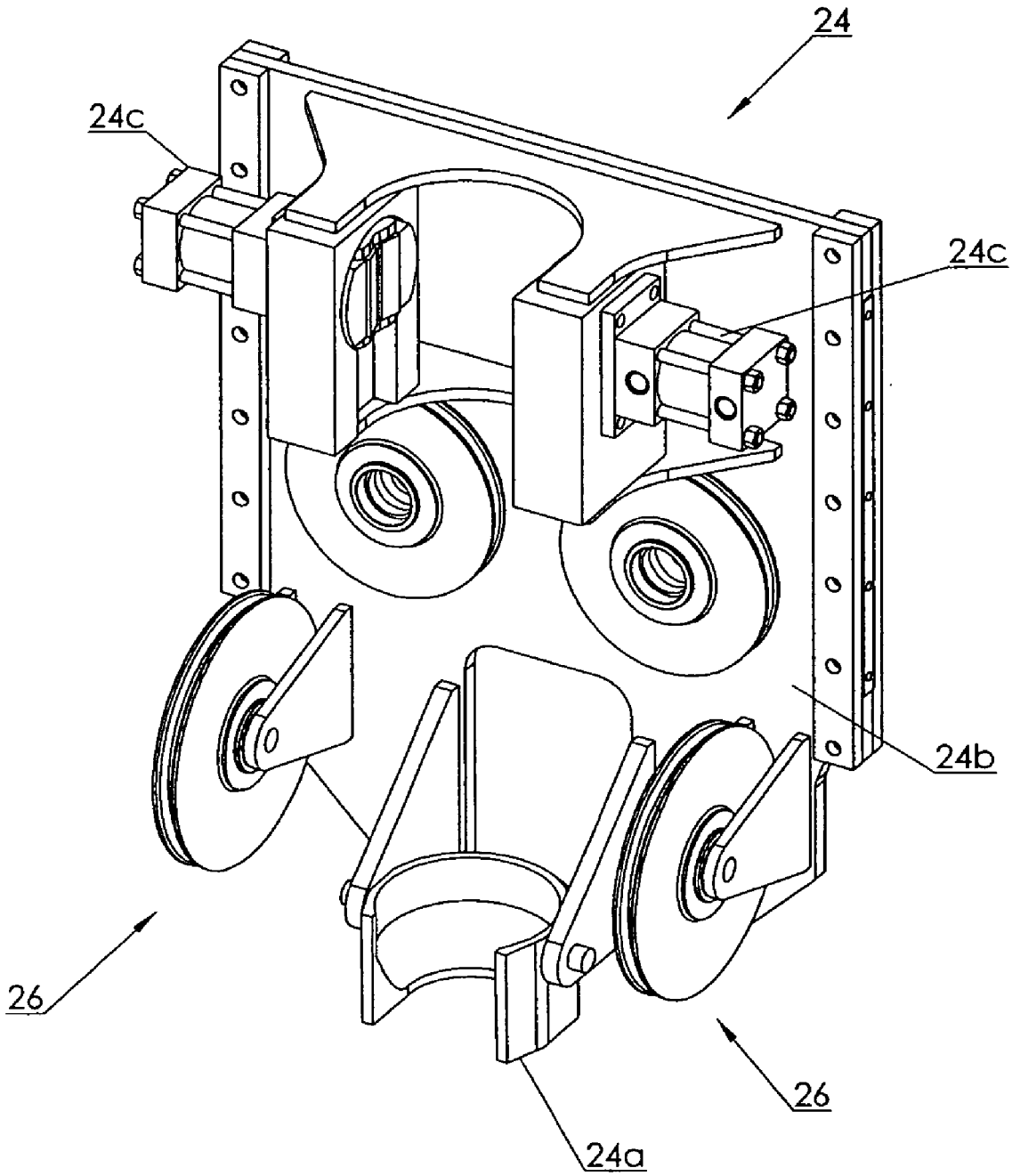
FIG. 14 is, in front perspective view, the lift plate of FIG. 2*b*.

A travelling lift plate 24 on the pipe support table 23, and in particular collar 24*a* which pivots relative to the plate carriage 24*b*, picks up the first pipe 22' from under its tool joint 22*a*' and hoists it in direction C1 to vertical by the operation of a cable and pulley system 26 hoisting lift plate 24 in direction D1. The vertical length of front opening 17*a* is sized to accommodate the inclination of the pipe singles as their box end is elevated with their pin end trailing on the support table, such as illustrated in dotted outline in FIGS. 4*a* and 9*a*. The base of the pipe (in this case the pin end) is then set down on the floor 28 to enable a hand-off of tool joint 22*a*' from the lifting plate 24 to the travelling block 30. During the hand-off the lifting plate is lowered to clear the box end upset of joint 22' making room for the elevator collar 30*a* of travelling block 30 to slip snugly under the box upset.

The single pipe 22' is then hoisted by the travelling block 30 while the lift plate 24 returns to its lowest position. A second single pipe 22" is then brought into position, doped and tallied, as was done to the first single pipe. The second single pipe 22" is hoisted by the lift plate 24 while the first single pipe 22' is suspended in the travelling block 30. The pin end of the second single 22" is set into the pipe spinner 32 located on floor 28.

The lower end of the first single pipe 22', which is now suspended from travelling block 30, is stabbed into the top end of the second single pipe 22' and the two pipes are threaded together by anti-rotation clamps 24*c* on lift plate 24 clamping the bottom of first single pipe 22' and spinner 32 rotating the base of the second pipe to thereby threadably engage the two singles together by winding-on their male/female coupled threaded ends. Once spun together, a torque wrench located in the mast at the position of the threaded connection torques the connection as required. The result is a double pipe stand 22 which has been built vertically off-line.

To build an off-line triple pipe stand 22, travelling block 30 is lowered to pick up the double stand at the completed connection i.e. half way along the pipe stand. The double pipe stand is then hoisted by collar 30*a* engaging under the box end upset of second pipe 22" to make room in the mast for the third single pipe 22'".

As the double stand is hoisted its top end protrudes above the crown of mast 16, towards the racking board 20. The rear opening 17*b* of the mast is completely open so that the pipe stand may be removed from the mast while maintaining the pipe stand vertical. During the hoisting the double stand is continuously guided and supported within the mast 16. The third single pipe 22'" is brought into position on table 23, doped and tallied as was done with the first and second singles.

As before when building the double stand, the third single is hoisted by the lift plate while the double stand is suspended in the travelling block. The spinning and torquing operations are repeated to complete a triple pipe stand. The hand-off between the lift-plate 24 and the travelling block 30 is repeated and the stand is hoisted by the box end upset of pipe 22'" in the last completed tool joint, i.e. about ⅓ of the way up the pipe stand. The pipe stand continues to extend upwardly through the crown of mast 16 and into position through the aperture 20*b* in the racking board 20. The triple pipe stand is then ready to be racked by a Racking Board Pipe Handling System 34 such as described below in detail or other suitable system until it is required for drilling at which time the pipe stand is moved by the pipe handling system to wall center 5*a* in derrick and made up with the drill stem 15. A further single pipe would be added if a quad stand was required.

Control of the Offline Stand Building System may be carried out from the fixed, hard wired operator's consol or from a portable radio control unit. Alternatively, when personnel are barred from the operations area, the Offline Stand Building System, in conjunction with a remotely operable Racking Board Pipe Handling System 34, can work in a full automatic mode.

A pipe handling system 34 or other apparatus for handling the pipe stands is mounted on a derrick 5. Derrick 5 has a well bore axis or well center 5*a*. The pipe handling system 34, includes a pipe racking assembly 110 and a rotatable gate assembly 120 mounted thereto. The system 34 is configured to handle and rack a plurality of pipe stands 22.

Pipe racking assembly 110 includes a generally planar and rectangular frame, referred to above as a racking board 20, which is horizontally disposed when mounted on derrick 5. Pipe racking assembly 110 is mounted to a mid-portion of derrick 5 such that pipe racking assembly 110 extends cantilevered outwards and away from derrick 5. In particular pipe racking assembly 110 includes a racking board frame 116 and a plurality of transversely disposed fingers or elongate support members 118 coupled to frame 116 such that each support member 118 attaches to frame 116 at a first end only, thereby defining a central gap 117 between the distal ends 118*a* of support members 118. Rotatable gate assembly 120 is mounted to frame 116 such that rotatable gate assembly is positioned in gap 117 so that a pipe stand 23 may travel along gap 117 between the distal ends of support members 118. To rack a pipe stand 22, pipe stand 22 is positioned in between support members 118 such that the weight of pipe stand 22 rests against one of the support members 118 and the base of the pipe stand rests on the base support such as the platform at the base of the derrick.

Rotatable gate assembly 120 includes a collar assembly 122 rotatably mounted on a first end of a rotation assembly 124 such that rotation assembly 124 is journalled centrally through collar assembly 122. Preferably, collar assembly 122 is substantially u-shaped when viewed in plan view and defines a recess or a gate opening 125 for receiving and engaging a pipe stand 22. Gate opening 125 may provide additional stability to pipe stand 22, especially to an upper portion of pipe stand 22 when pipe stand 22 is received within gate opening 125. Collar assembly 122 may be rotated on rotation assembly 124 about axis A2 by way of a drive mechanism 128 better described below. The rotation of collar assembly 122 from a pipe stand engaging position and well bore axis 5*a* wherein opening 125 in rotatable gate assembly 120 faces derrick 5, to a pipe stand racking position wherein opening 125 in rotatable gate assembly 120 faces support members 118 of pipe racking assembly 110, enables the transport of a pipe stand 22 away from and well bore axis 5*a* in derrick 5, and through the side of the derrick for racking of pipe stand 22 in between support members 118 of pipe racking assembly 110.

Rotatable gate assembly 120 further includes an arm 130 having a first end and an opposite second end. In the illustrated embodiment arm 130 is of fixed length. However, in other embodiments, depending on the drilling operation, arm 130 may be selectively extendable in length for example telescopically. The first end of arm 130 is pivotably mounted on rotation assembly 124 by way of pivot pins 130*a* for rotation about axis B2. Arm 130 is mounted on rotation assembly 124 such that drive mechanism 128 rotates arm 130 between a pipe engaging position facing and well bore axis 5*a* in derrick 5 and a pipe racking position facing gap 117 between support members 118. In the pipe engaging position, arm 130 is rotated in a vertical plane by retraction of actuators 132 so as to engage pipe stand 22 in derrick 5 with carriage 134 on the distal end of arm 130. The pipe stand is held in carriage 134 while arm 130 is retracted so as to engage the pipe stand into collar assembly 122 and while subsequently the pipe stand, arm 130 and collar assembly are rotated into the pipe racking position to hence transfer pipe stand 112 to pipe racking assembly 110 to position pipe stand 22 in between support members 118.

In the pipe engaging position, arm 130 is translated by actuators 132 to move arm 130 in direction C2 towards pipe stand 22 in derrick 5. Actuators 132 may be pneumatically or hydraulically operated cylinders. In an embodiment of the invention, each actuator 132 is mounted at an upper end thereof to a corresponding arm 222*a* of a horseshoe-shaped mounting bracket 222 mounted on rotation assembly 124 at a first end and operably coupled to arm 130 at a second end such that extension of rod 133 from actuator 132 causes arm 130 to displace from a vertical position parallel to pipe stand 22 to an angled position to engage carriage 134 with pipe stand 22 when in the pipe engaging position. When rotated in the pipe racking position, extension of rod 133 causes arm 130 to displace from a vertical position parallel to pipe stand 22 to an angled position to position pipe stand 22 in between support members 118. Retraction of rod 133 causes extendable arm to displace from the angled position back to the vertical position.

A securing means such as for example carriage 134 is mounted to the second end of arm 130 such that carriage 134 assists in arm 130 translating a pipe stand 22. Advantageously, carriage 134 is elongate and pivotally mounted to arm 130 so that, once translated and pivoted to engage a pipe stand 22, the carriage extends vertically along the length of pipe stand 22. Carriage 134 may extend in length between one quarter to one third the length of pipe stand 22 and engages onto pipe stand 22 without causing damage or substantial scarring to pipe stand 22 for example by the use of pipe gripper 144. Carriage 134 may engage a mid-portion of pipe stand 22 such that carriage 134 may provide greater stability and prevent pipe stand 22 from swaying when pipe stand 22 is uncoupled from drill string 15. The pipe gripper 144 is primarily used to stabilize the pipe stand once the elevator collar 136 has engaged the drill pipe by tool joint 22*a* and lifted the pipe stand prior to arm movement. Pipe gripper 144 may be used as a secondary pipe handling device complementing the action of the elevator collar.

Elevator collar 136 serves as a further securing means. It receives pipe stand 22 within its arms and frictionally engages therein a tool joint 22*a*. Elevator collar 136 thus supports the weight of pipe stand 22. The recess between the arms of elevator collar 136 is sized such that when tool joint 22*a* slides into the recess, tool joint 22*a* is securely engaged and the weight of pipe stand 22 supported. Preferably, elevator collar 136 is mounted to a lower end of carriage 134 such that elevator collar 136 may provide additional stability to a lower portion of pipe stand 22.

Figure 15:
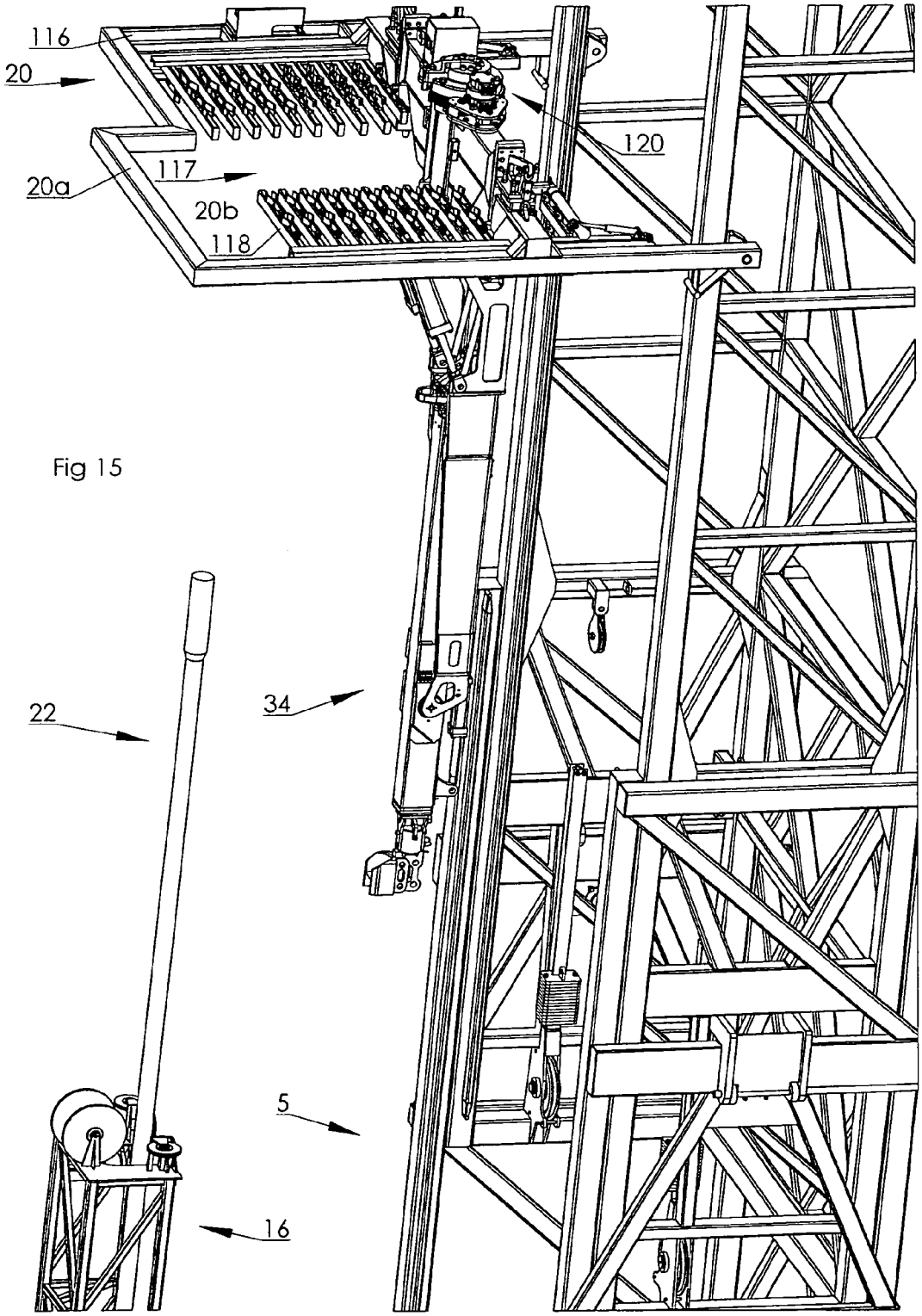
FIG. 15 is, in front perspective view, the top of the made-up pipe stand extending upwardly from the mast and into the extension of the racking board mounted on the derrick.
Figure 16:
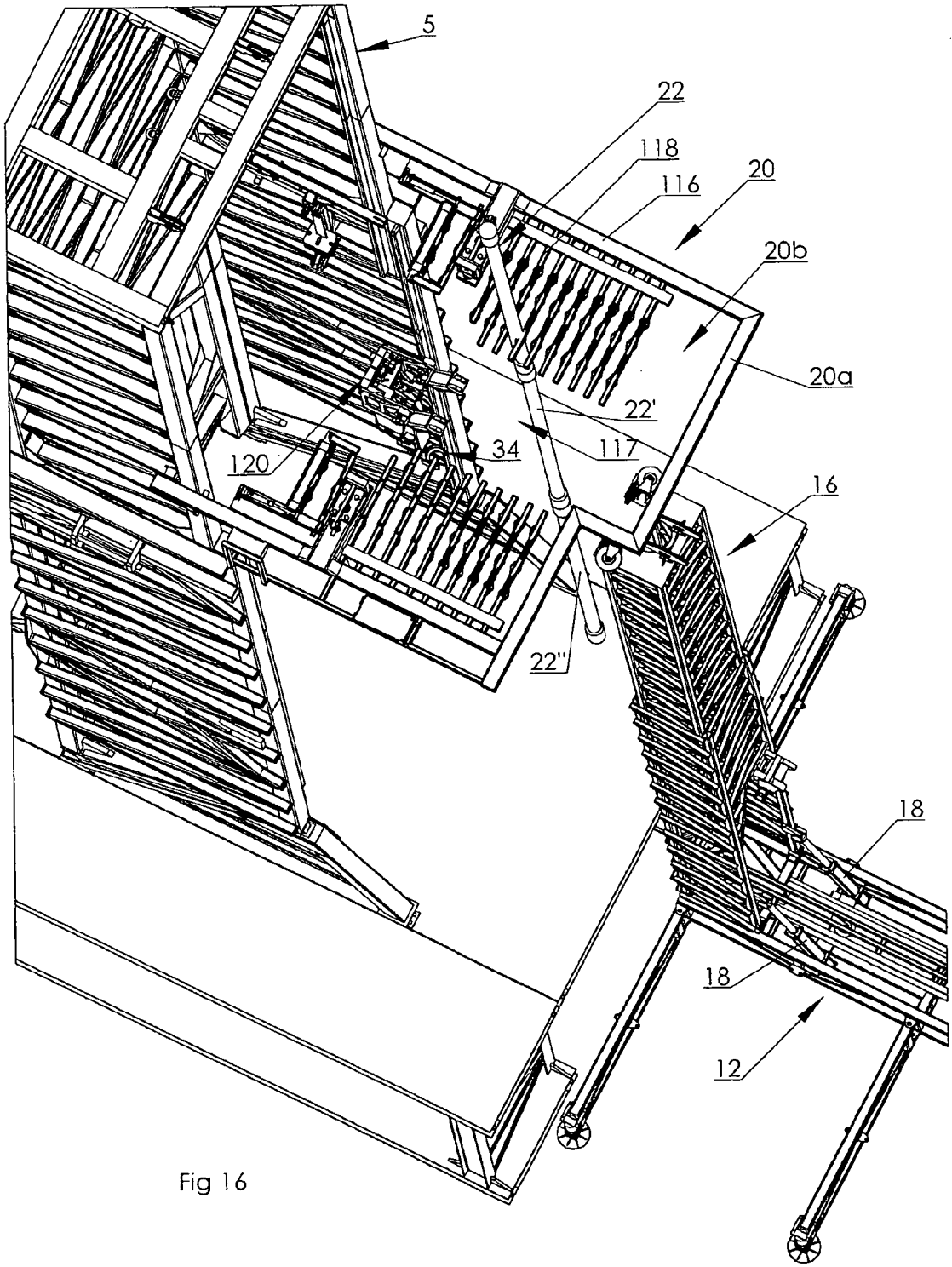
FIG. 16 is, in top front perspective view, a pipe stand that, once made-up within the mast has been transferred by a pipe handling arm from the mast into the racking board.
Figure 17:
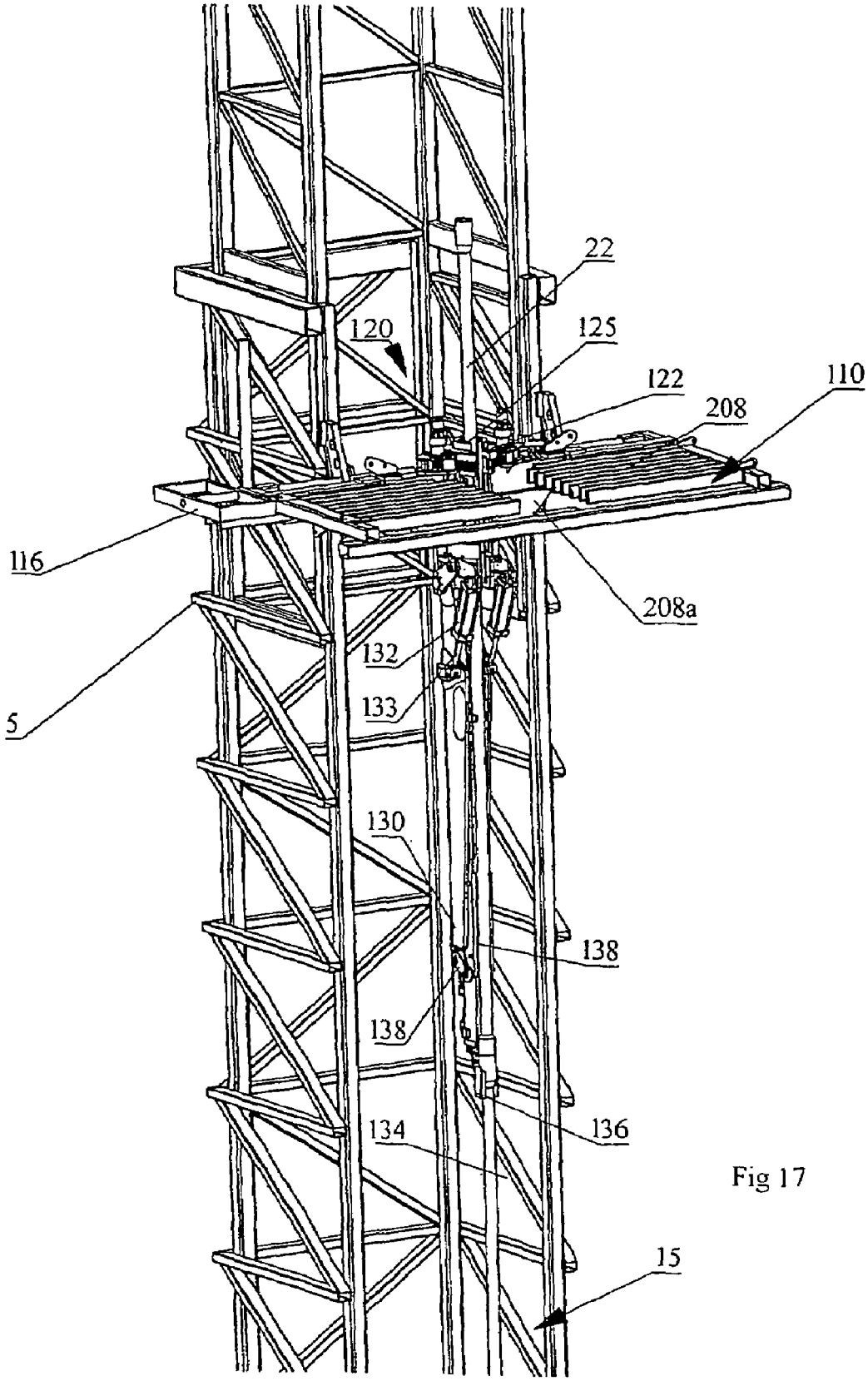
FIG. 17 is a side perspective view of the apparatus for handling pipes according to one embodiment of the present invention.
Figure 18:
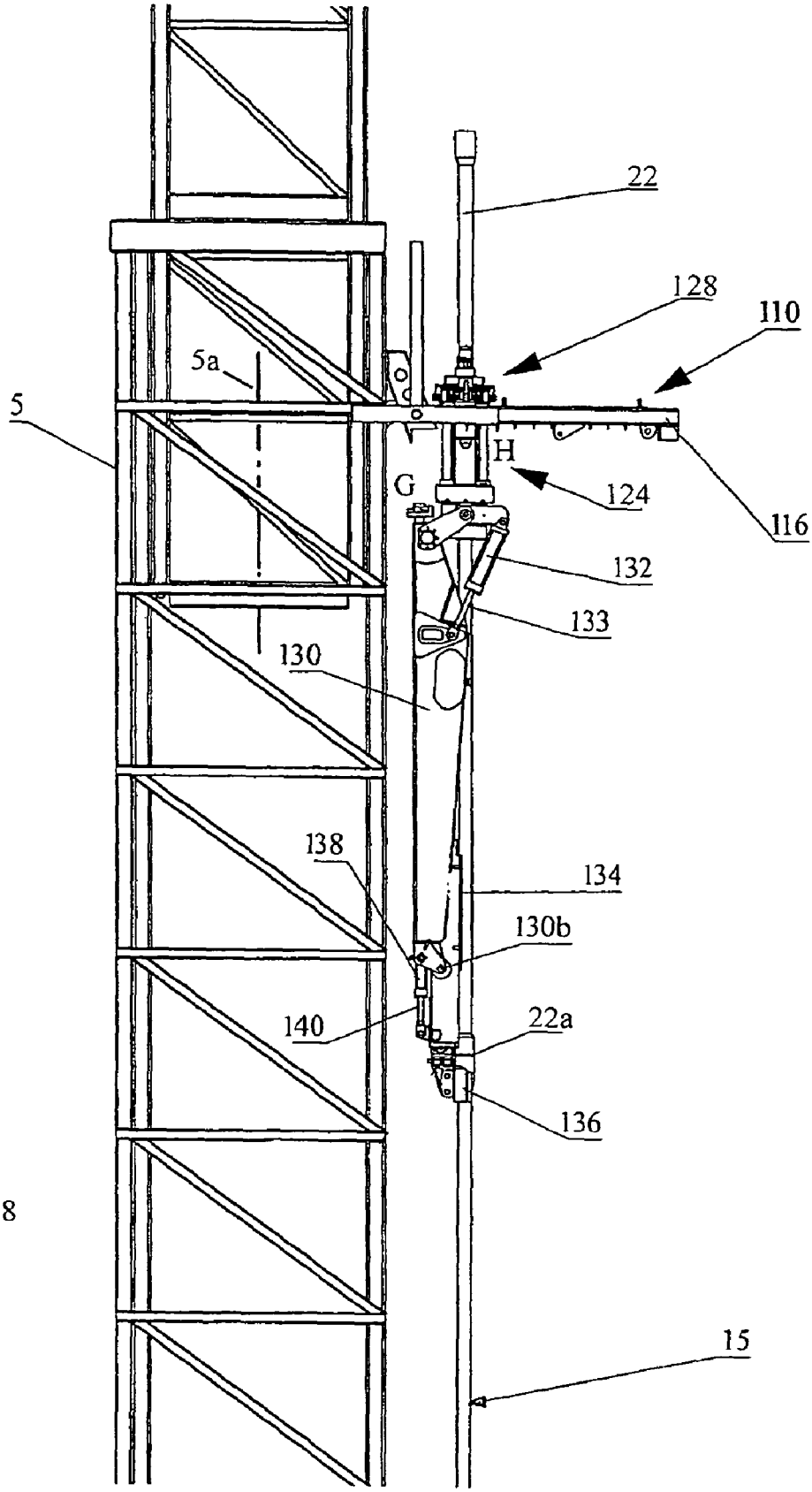
FIG. 18 is a side view of the apparatus of FIG. 17.
Figure 18A:
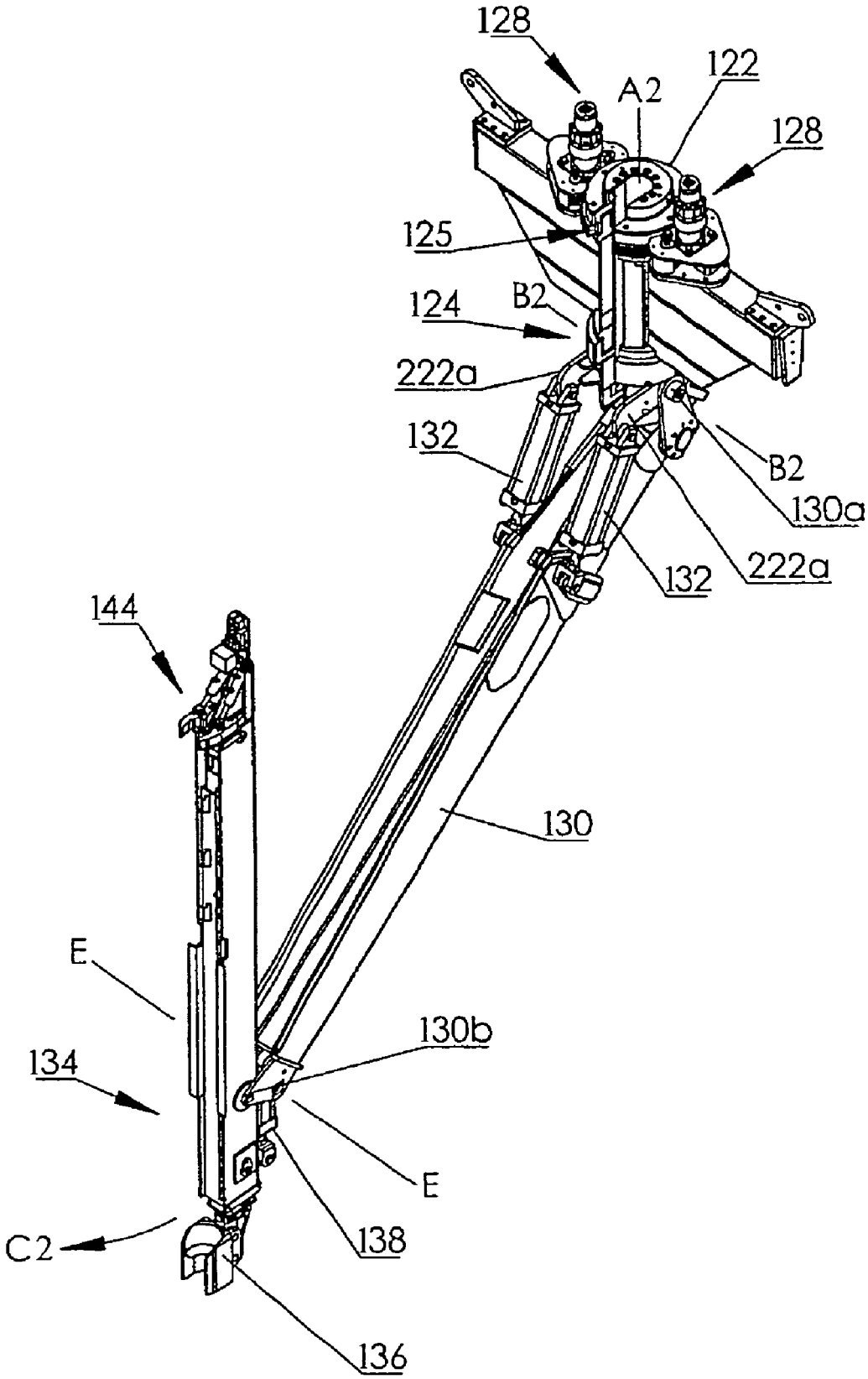
FIG. 18*a* is a side perspective view of the pipe racking assembly and the rotatable gate assembly of the apparatus for handling pipes as shown in FIG. 17.
Figure 18B:
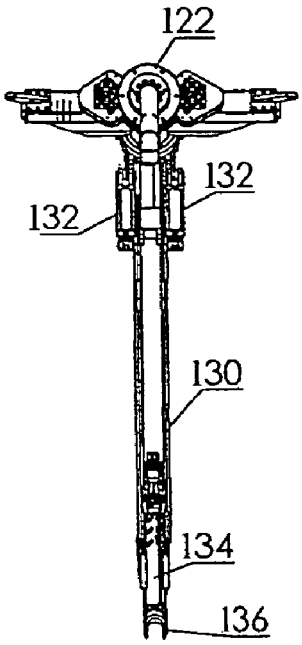
FIG. 18*b* is a plan view of FIG. 18*a*.
Figure 18C:
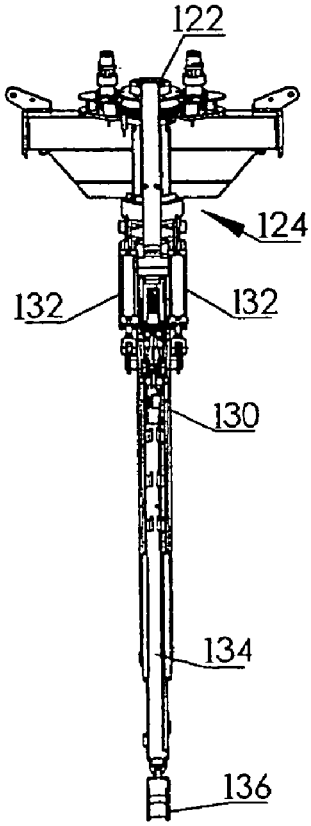
FIG. 18*c* is a front view of FIG. 18*a*.
Figure 18D:
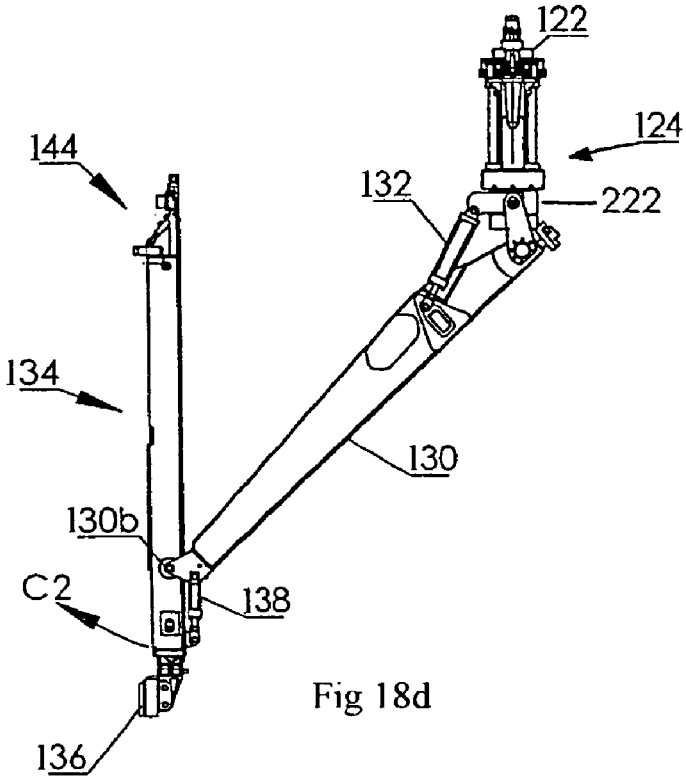
FIG. 18*d* is a side view of FIG. 18*a*.
Figure 19:
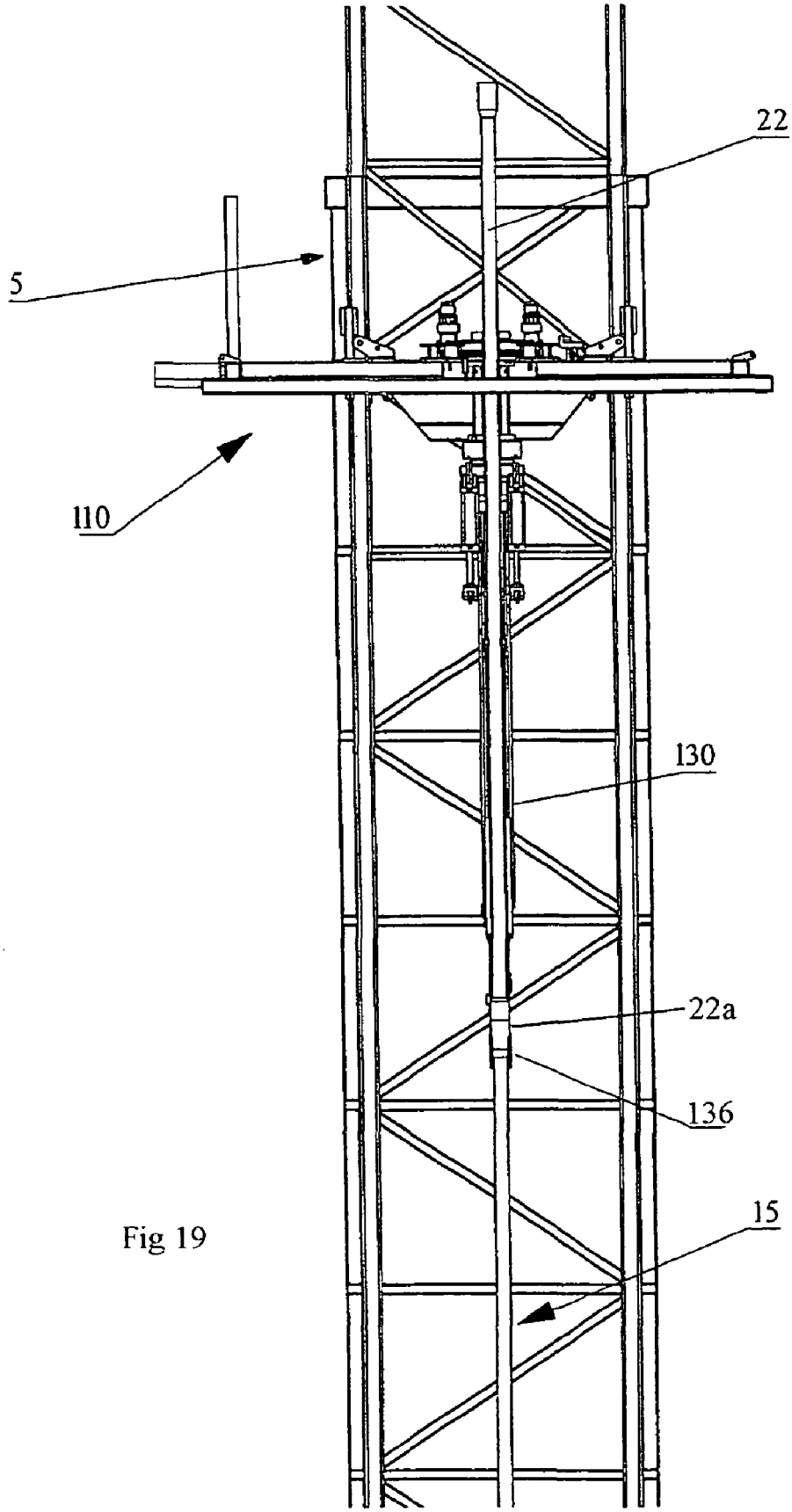
FIG. 19 is a front view of the apparatus for handling pipes as shown in FIG. 18.
Figure 20:
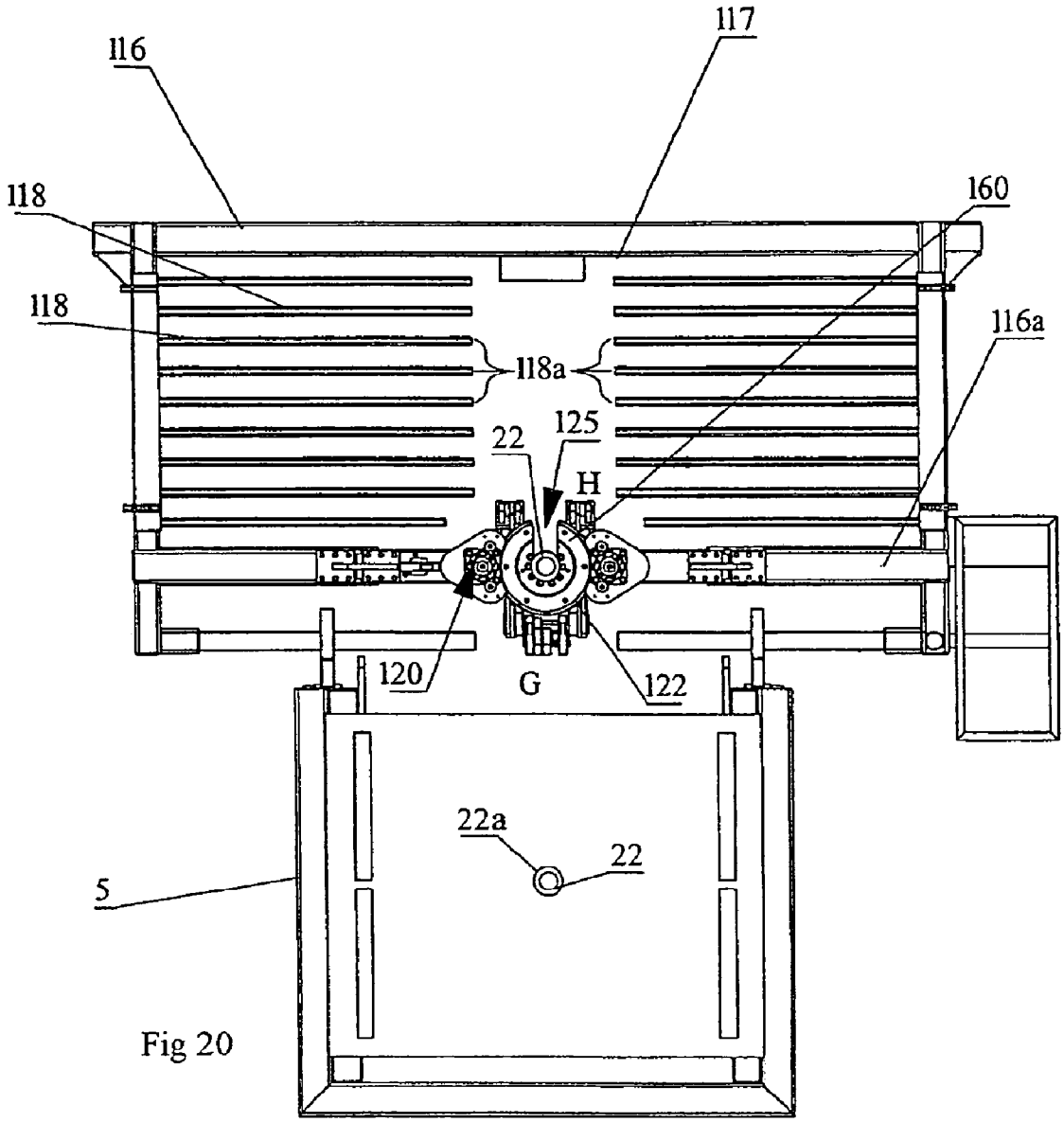
FIG. 20 is a plan view of the apparatus for handling pipes as shown in FIG. 18.
Figure 21:
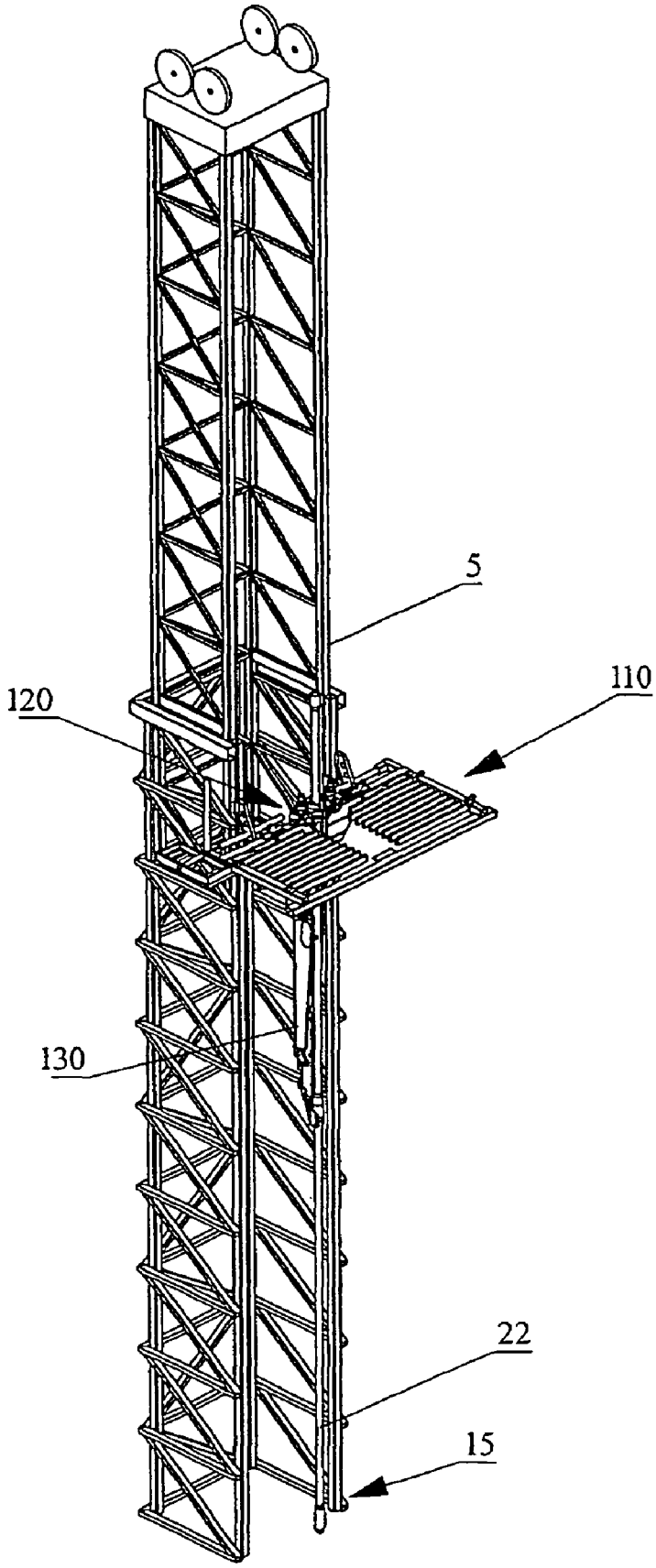
FIG. 21 is a top perspective view of the apparatus for handling pipes mounted on a derrick.
Figure 22:
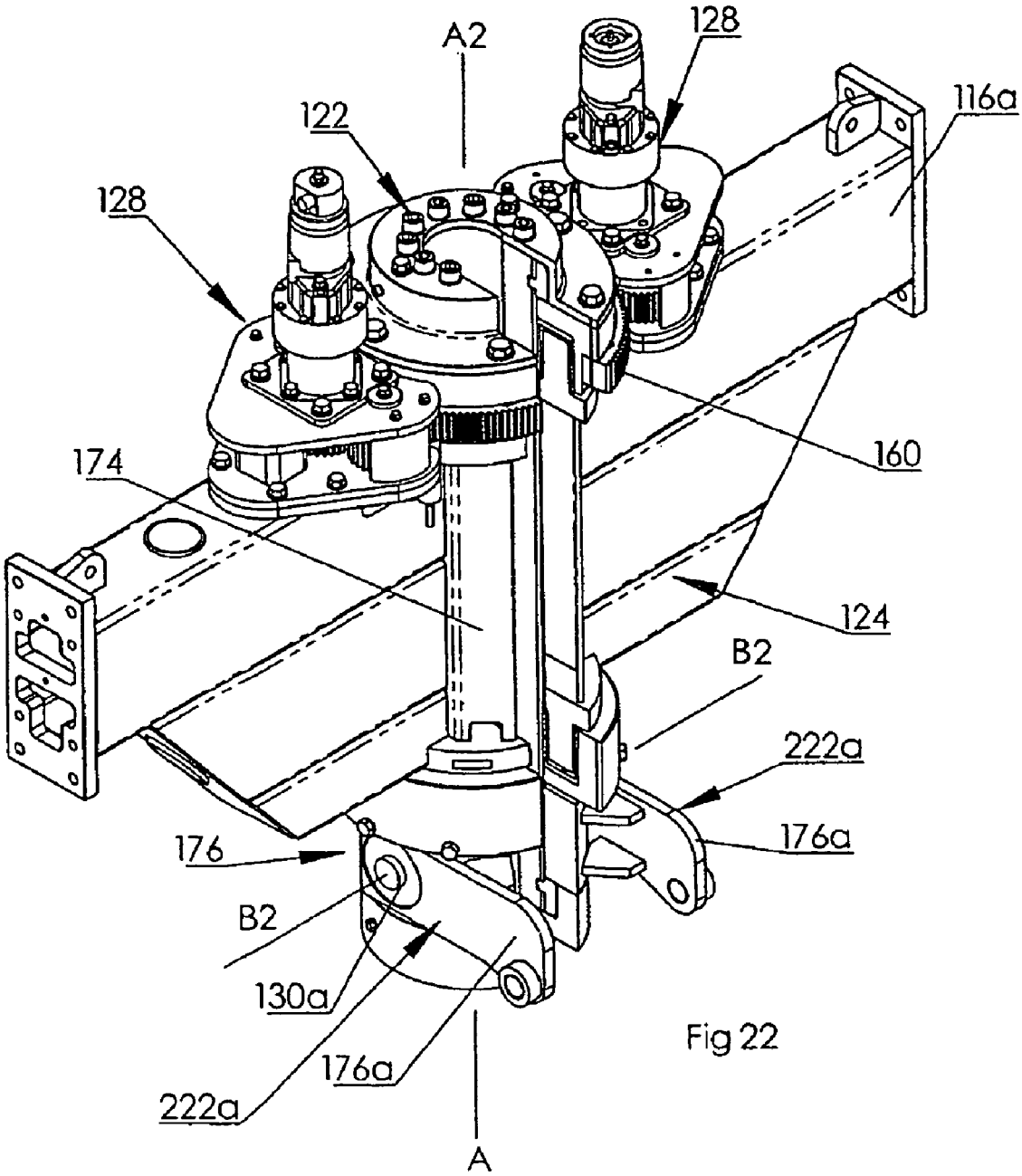
FIG. 22 is an assembled perspective view of FIG. 18*b*.
Figure 23:
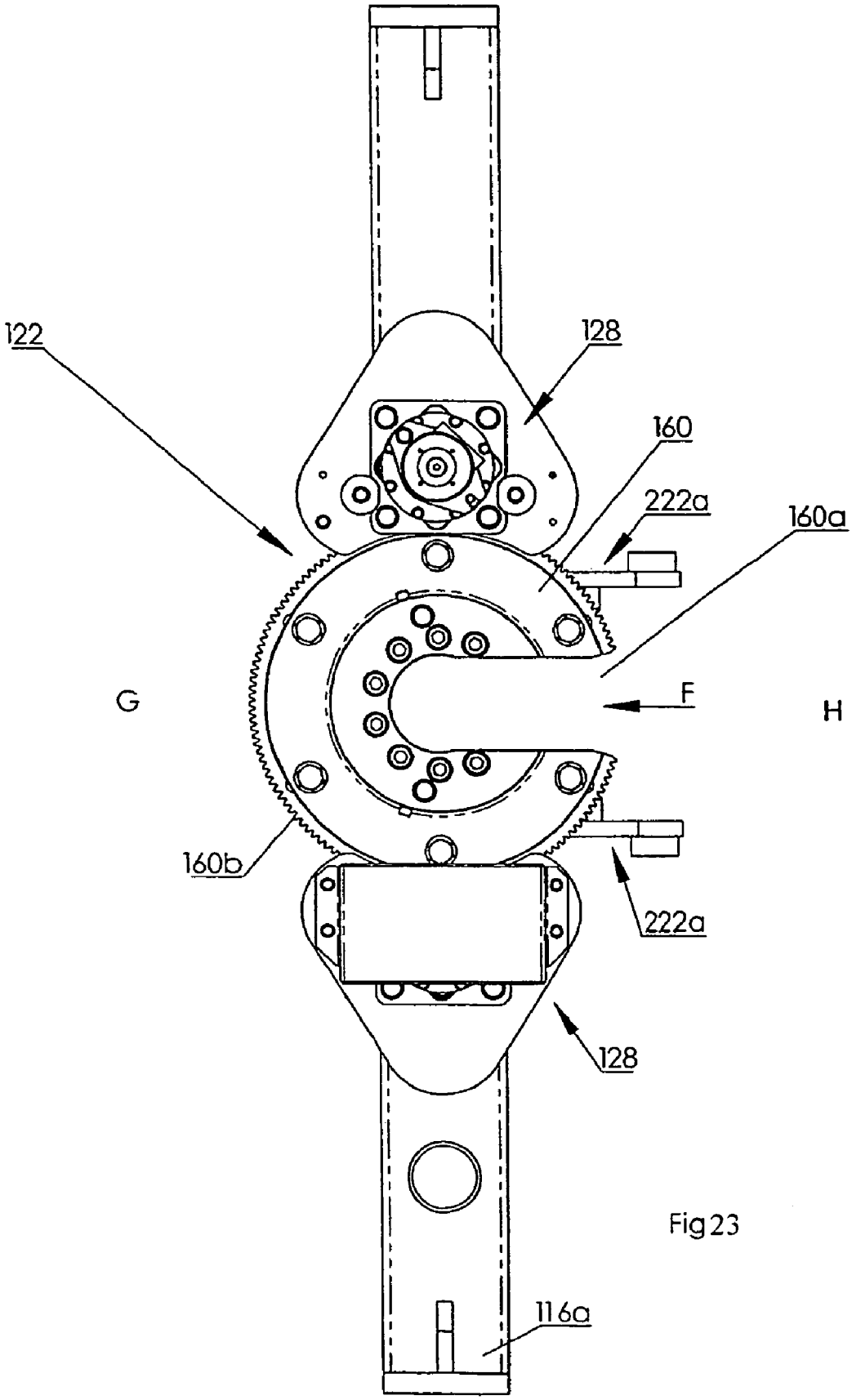
FIG. 23 is a plan view of FIG. 22.
Figure 24:
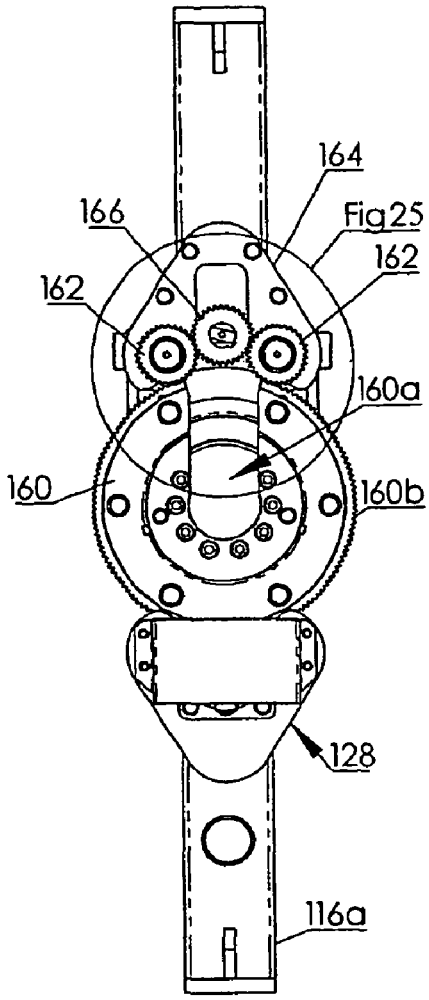
FIG. 24 is the view of FIG. 23 with the pipe retaining collar rotated ninety degrees.
Figure 25:
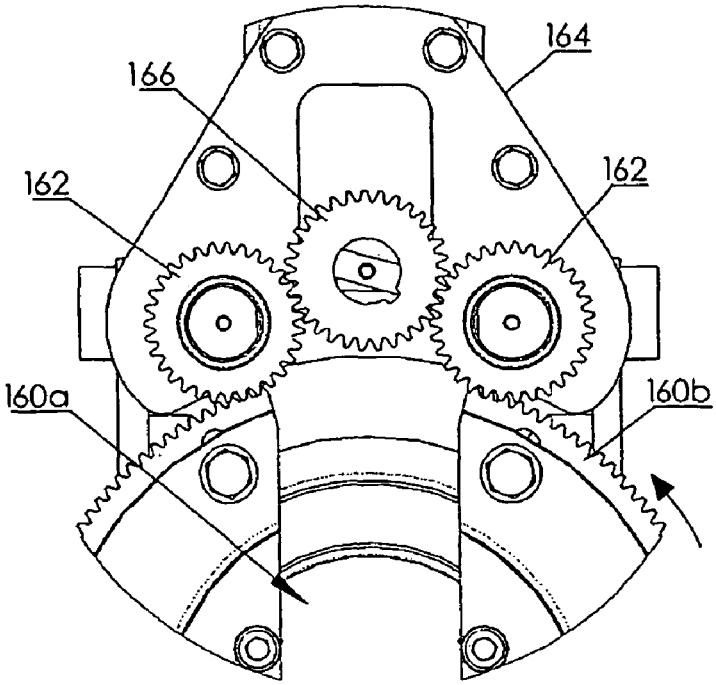
FIG. 25 is an enlarged view of a portion of FIG. 24.
Figure 26:
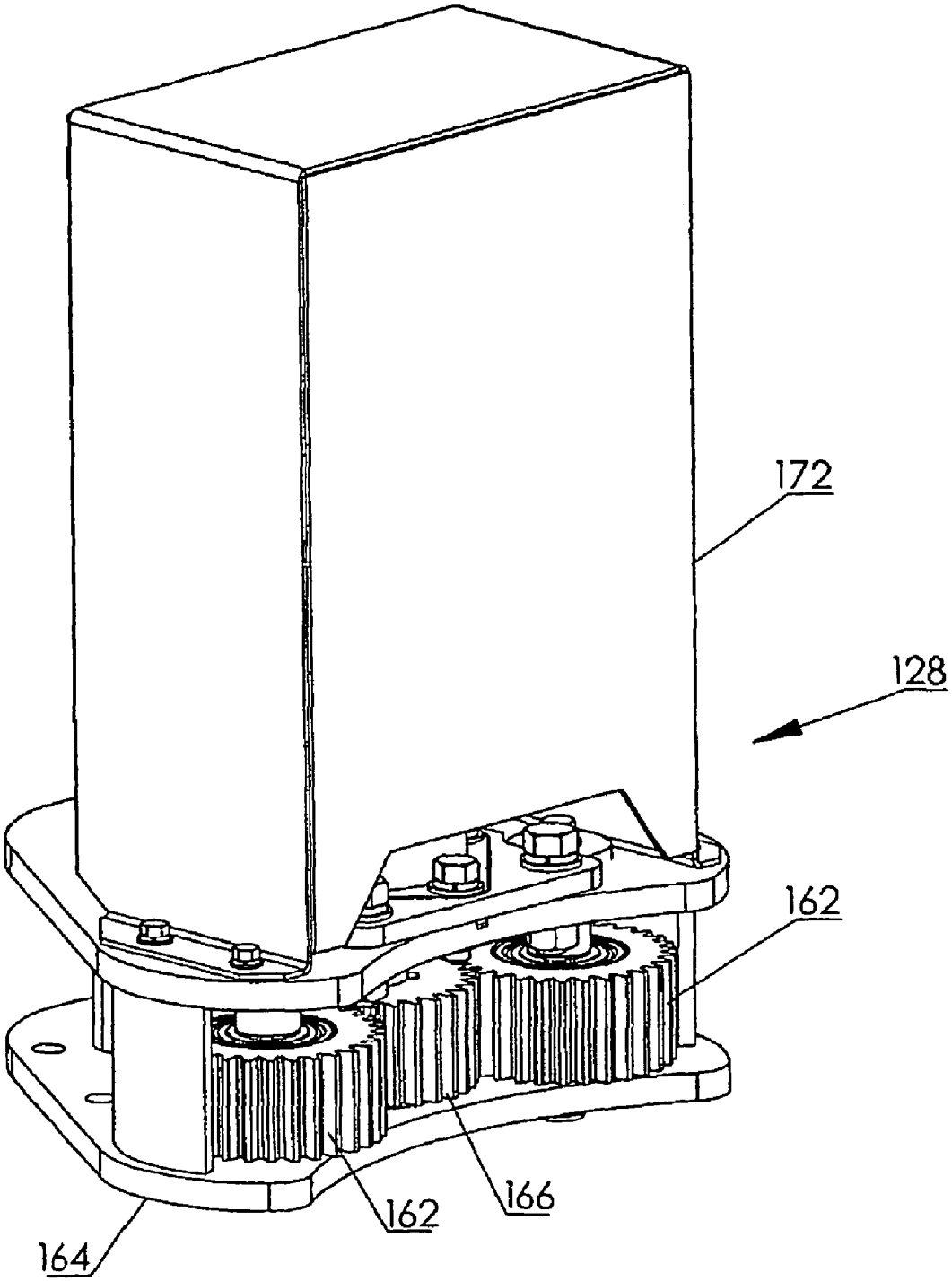
FIG. 26 is a perspective view of one drive assembly enclosed within a housing.
Figure 27:
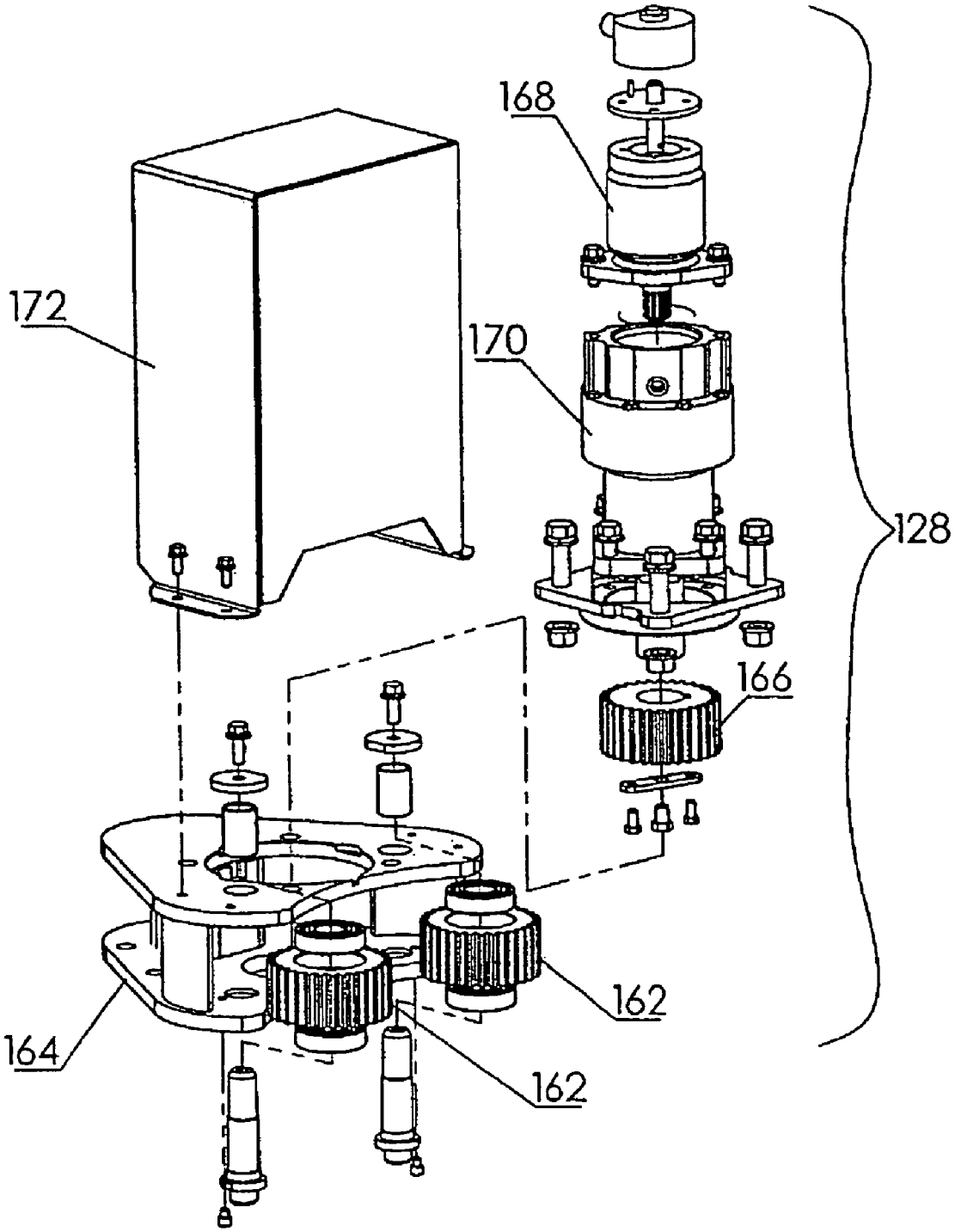
FIG. 27 is an exploded perspective view of the drive assembly and housing of FIG. 26.
Figure 28:
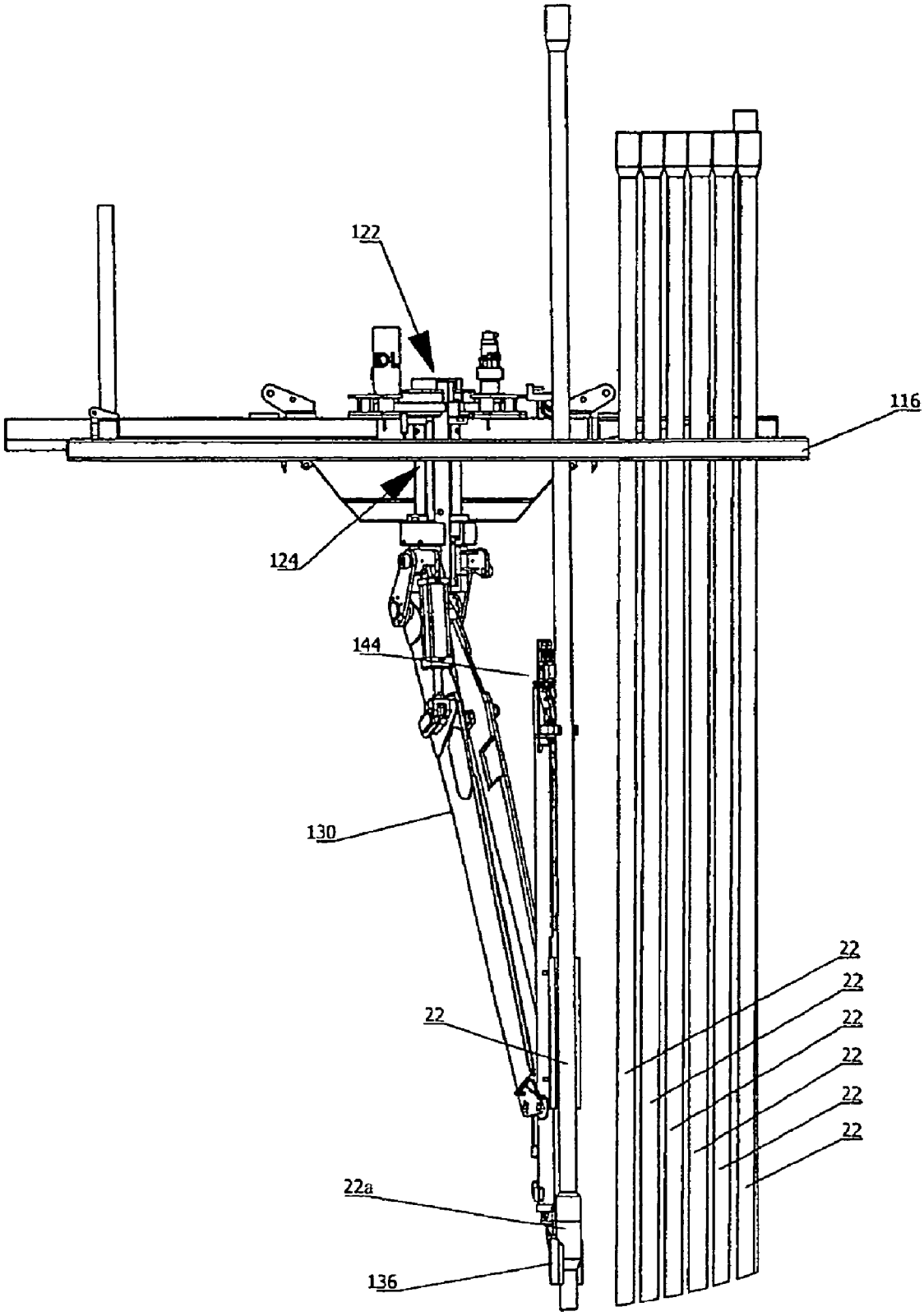
FIG. 28 is a front view of the racking assembly of FIG. 18 racking pipe stands into the rack.
Figure 29:
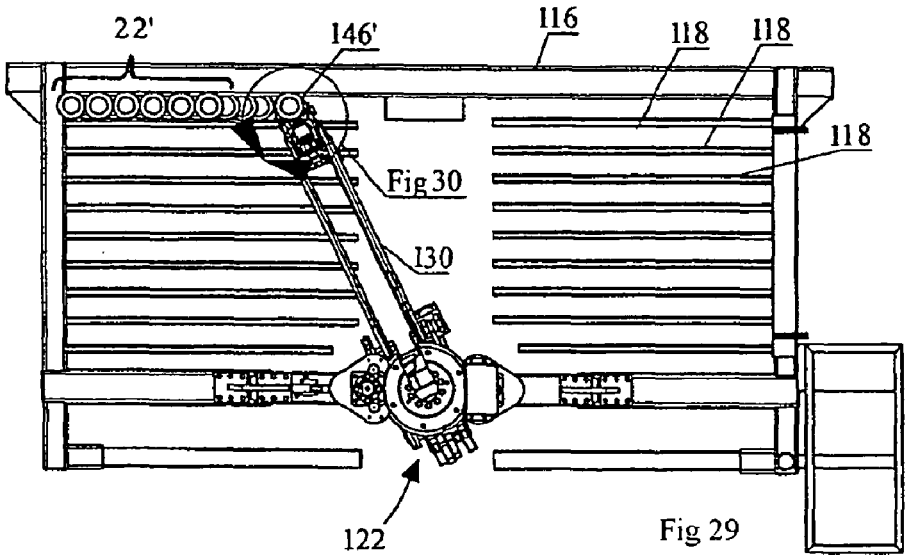
FIG. 29 is a plan view of FIG. 28.
Figure 30:
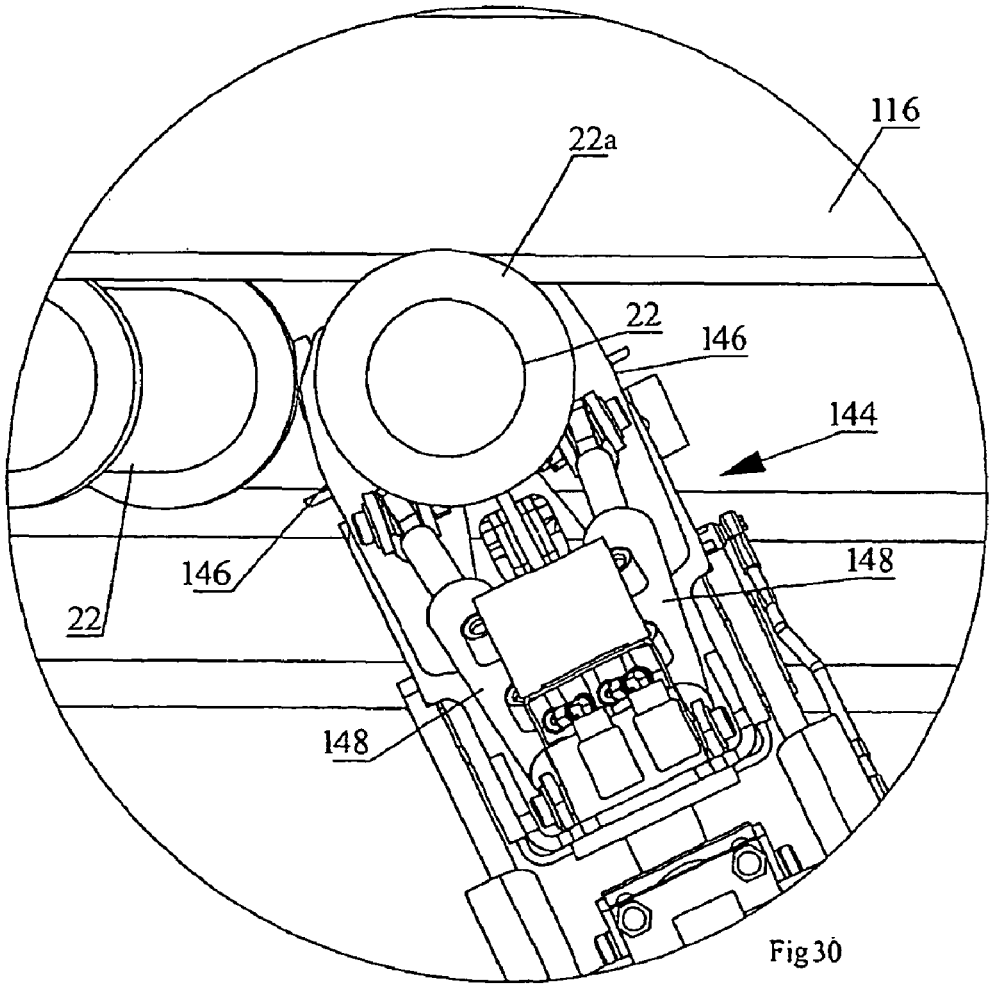
FIG. 30 is an enlarged view of a portion of FIG. 29.
Figure 31:
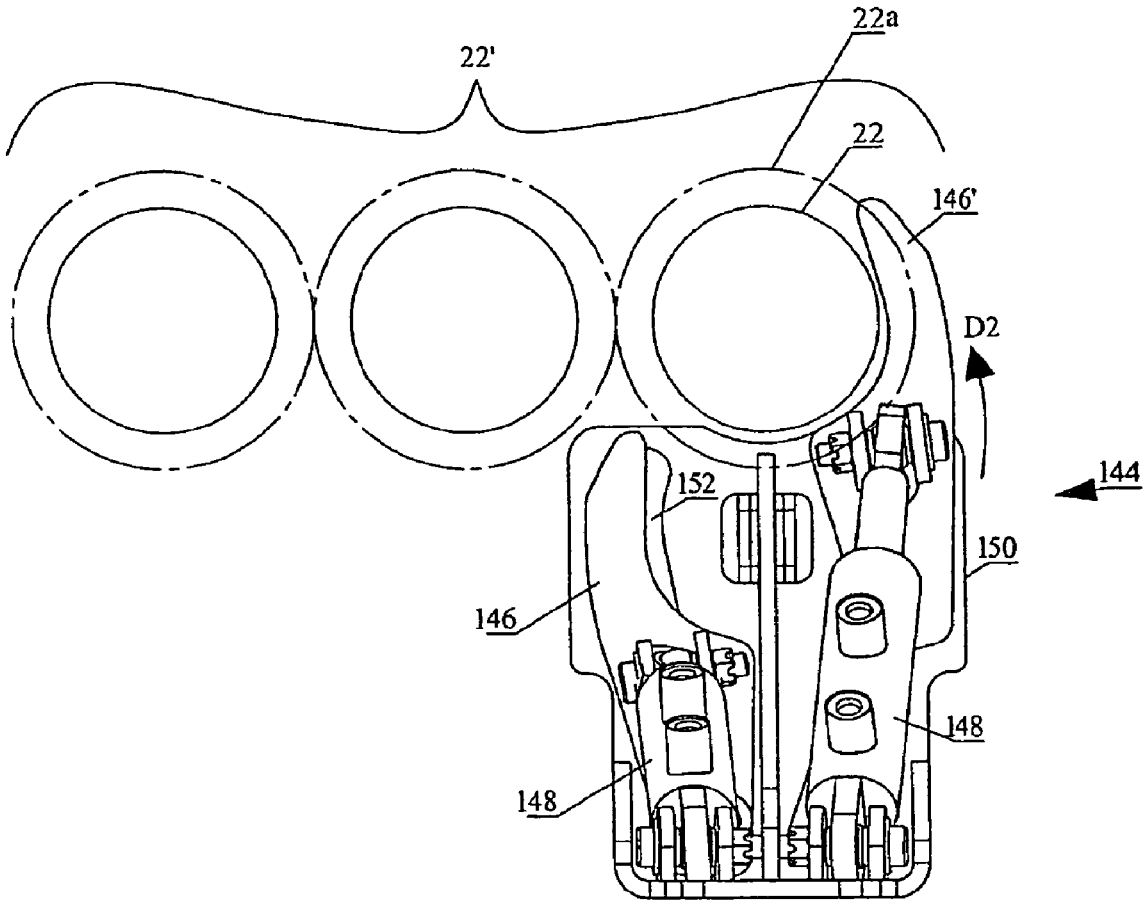
FIG. 31 is an enlarged view of a portion of FIG. 29 illustrating one of the jaws of the pipe gripper retracted.
Figure 32A:
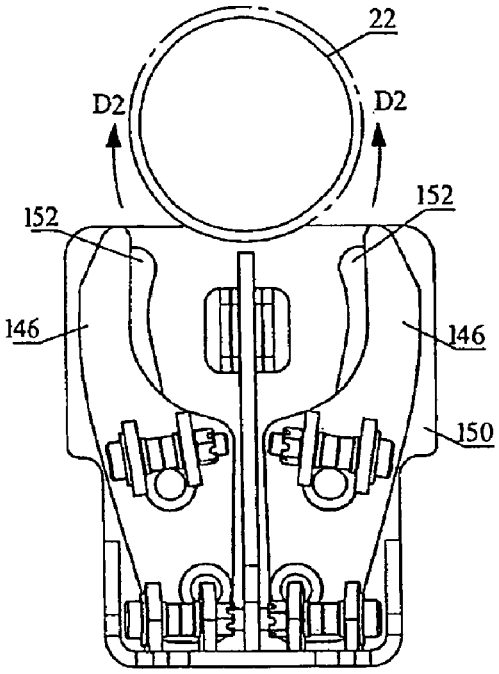
FIG. 32*a* is, in partially cut away view, the view of FIG. 31 with both jaws of the pipe gripper retracted.
Figure 32B:
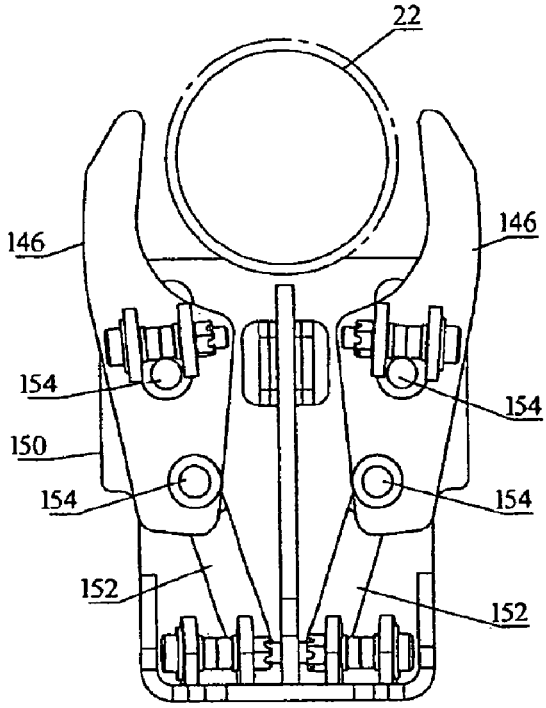
FIG. 32*b* is the view of FIG. 32*a* with both jaws of the pipe gripper partially extended.
Figure 32D:
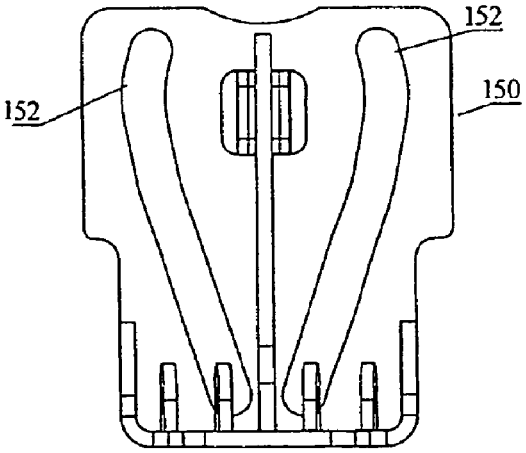
FIG. 32*d* is a partially cut away view of FIG. 32*a* cut away so as to show the cam plate.
Figure 32C:
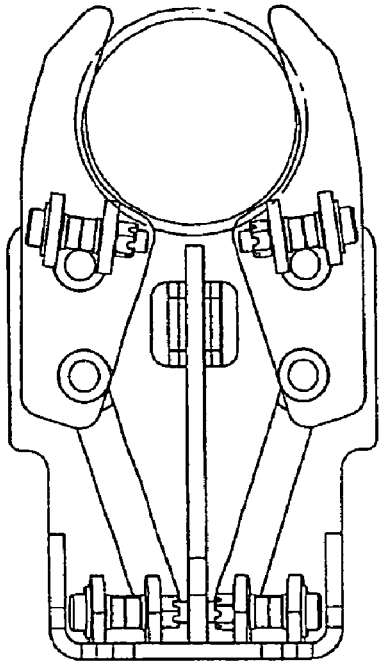
FIG. 32*c* is the view of FIG. 32*b* with the jaws of the pipe gripper fully extended.
Figure 33:
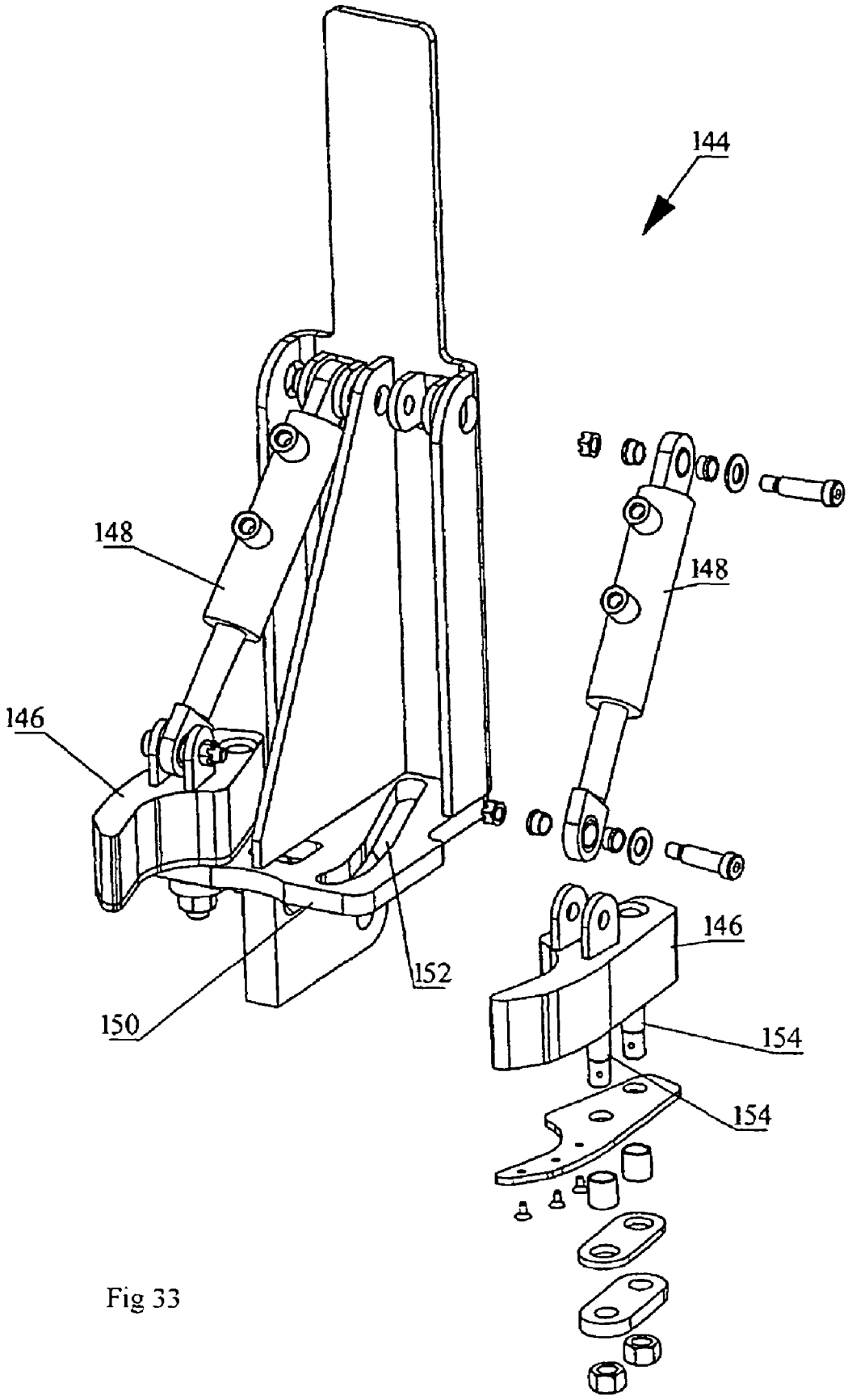
FIG. 33 is a partially exploded perspective view of the pipe gripper assembly of FIG. 30.

Pipe gripper 144 includes a pair of selectively actuable jaws 146. The gripper jaws 146 are independently controlled by a corresponding pair of actuators 148 to serve three functions. Firstly, jaws 146 work simultaneously as a pair to clamp and retain therebetween a pipe stand as shown sequentially in FIGS. 16*a*-16*c*. Secondly, as seen in FIG. 15, with jaw 146' of jaws 146 extended in direction D2 that is on the side of gripper 144 furthest from the pipe stack 22' jaw 146' acts as a barrier preventing the pipes in the stack from falling towards the center of the racking board, that is, into gap 117. The third function is for pipe manipulation. The operator may extend the applicable gripper jaw 146 and use it as a finger to move pipe in the desired direction, for example so as to lean the pipe over against the pipe stand 22' once the pipe is vertically lowered on the working floor.

Pipe gripper 144 has a compact profile in particular in plan view so that, when jaws 146 are retracted pipe gripper 144 fits within an envelope defined in plan view so as to not protrude beyond cam plate 140 and the other components above or below it. Thus, the pipe gripper does not interfere with the primary handling of a pipe stand gripped in the elevator collar. This facilitates handling pipes in close proximity to each other.

Jaws 146 are guided when extended in direction D2 by cam tracks or slots 152 formed in cam plate 150. Actuation of actuators 148 drive or retract the corresponding cam followers 154, mounted to the bottom of jaws 146, along cam tracks 152. Cam tracks 152 are shaped to diverge jaws 146 apart from each other upon initial extension of the jaws from the cam plate. This opens the distance between the jaws so that the pair of jaws may be positioned with the jaws on opposite sides of the pipe. The cam tracks then converge so that as the jaws are extended further from the cam plate, the jaws close towards each other to thereby clamp the pipe between the pair of jaws. When retracted the jaws are completely clear of the pipe. Thus at mid travel the jaws move ahead towards the pipe and open with sufficient clearance to the pipe to allow the pipe to be easily guided into position between the jaws. Near the end of the gripper jaw extension the jaws move sharply inwards towards the pipe so as to capture the pipe as required.

When lateral force is applied to the gripper via the pipe, reaction forces to the actuating hydraulic cylinders are minimal. This is due to the geometry of the guiding pins and cam slots that are nearly perpendicular to the pipe induced forces. This advantage allows positive holding and small actuators for a compact design.

After carriage 134 engages pipe stand 22, and in particular elevator collar 136 mates under a tool joint 22*a* on a corresponding pipe stand 22, an actuator 138 rotates carriage 134 as arm 130 retracts pipe stand 22 from derrick 5 and vertically lifts the pipe stand away from the drill string. Actuator 138 may be a pneumatically or a hydraulically operated. In an embodiment of the invention, a first end of actuator 138 is mounted to the second end of arm 130 and an opposite second end of actuator 138 is operably mounted to carriage 134 such that extension of rod 140 causes carriage 134, elevator collar 136 and pipe stand 22 to rotate about axis E on pin 130*b*.

In operation, after a pipe elevator or any other similar hoisting system raises drill string 15 to a predetermined height, actuators 132 cause arm 130 to pivot about axis B2 on the lower end of rotation assembly 124 and extend in direction C2 towards drill string 15. As arm 130 extends from the vertical position to the angled position towards drill string 15, pipe stand 22 is uncoupled from drill string 15 by conventional detaching means, such as a spinning wrench or power torque wrench. As arm 130 moves towards pipe stand 22, carriage 134 and in particular jaws 146 engage a mid-portion of pipe stand 22 to stabilize pipe stand 22 and prevent pipe stand 22 from swaying. Elevator collar 136 engages tool joint 22*a* of a lower portion of pipe stand 22 to support the weight of pipe stand 22 and provide stability to the lower portion of pipe stand 22. After carriage 134 is so engaged, an actuator (not shown) in carriage 134 elevates carriage 134 such that pipe stand 22 previously coupled to drill string 15 is elevated so that it may be transported away from drill string 15 and derrick 5.

To rack pipe stand 22 on pipe racking assembly 110, rotatable gate assembly 120 must rotate away from derrick 5 along with pipe stand 22 such that arm 130 may transfer pipe stand 22 to engage support members 118. To that end, the actuator (not shown) within carriage 134 raises elevator collar 136 so as to raise the pipe stand, following which actuator 132 causes arm 130 to retract from the angled position to the vertical position while actuator 138 maintains carriage 134 vertical such that the upper portion of pipe stand 22 is maintained vertical and thus received into gate opening 125. Drive mechanism 128 better described below then rotates collar 122 and arm 130 from the pipe engaging position facing derrick 5 to a pipe racking position towards pipe racking assembly 110 such that pipe stand 22 may be positioned in between support members 118. Actuator 132 then causes arm 130 and pipe stand 22 to extend and travel along gap 117. Pipe stand 22 is then manipulated so as to be secured in a predetermined location between support members 118. Actuator 138 manipulates carriage 134, so as to release elevator collar 136 from pipe stand 22 and jaws 146 are retracted from pipe stand 22 such that pipe stand 22 may lean against support members 118 and any other adjacent pipe stands. In particular, once the pipe has been picked up at well center and moved to the desired drop off point the pipe is handled as follows: The gripper jaw closest to the pipe stack is retracted and the furthest gripper jaw from the stack is left extended to guard against the pipe falling to the center of the racking board. The elevator collar 136 is lowered far enough to set the pipe on the working floor but not to disengage it from the pipe tool joint. The arm is then traversed to lean the pipe against the adjacent stack. The elevator collar is then lowered further to disengage the tool joint and the arm is retracted away from the pipe.

In the reverse procedure the pipe is picked up at the racking board finger slot as follows: Standard oilfield practice is to stack pipe leaning at an angle towards the outside of the racking board to ensure it maintains its position. The gripper jaw 146' furthest away from the pipe stack is first extended. This will prevent the pipe from inadvertently falling away from the pipe stack when it is being handled. The gripper jaw 146 closest to the pipe is left retracted so that it will not interfere with the pipe as the elevator collar 136 engages the pipe tool joint 114. If the close gripper is in the extended position it will interfere with the pipe primarily due to the lean of the pipe. The elevator collar 136 is then positioned and lifted to capture the tool joint. The pipe is then raised by the elevator collar. The main arm 130 and carriage 134 is then traversed down the racking board finger slot and the other gripper jaw 146 is extended to capture the pipe. The pipe is now contained between both gripper jaws 146 and is secured for movement to the center gap 117 of the racking board and on to well center.

The rotating gate assembly 120 and its related drive is mounted in the pipe path. The rotating gate collar 122 is u-shaped in plan view so that a pipe stand 22 manipulated by carriage 134 and arm 130, may be slotted into the opening 125 of the rotating gate collar 122 and snugly held nested therein while the rotating gate assembly is rotated one hundred eighty degrees about axis A2. Once so rotated, the carriage 134 and arm 130 are once again actuated, this time to remove the pipe stand from the rotating collar gate so that the pipe stand may then be positioned as desired, either into the finger supports 118 of the pipe rack or into the derrick 5 depending on whether the pipe stand was, respectively, coming from, or returning to, operation in the drill string 15.

Figure 4B:
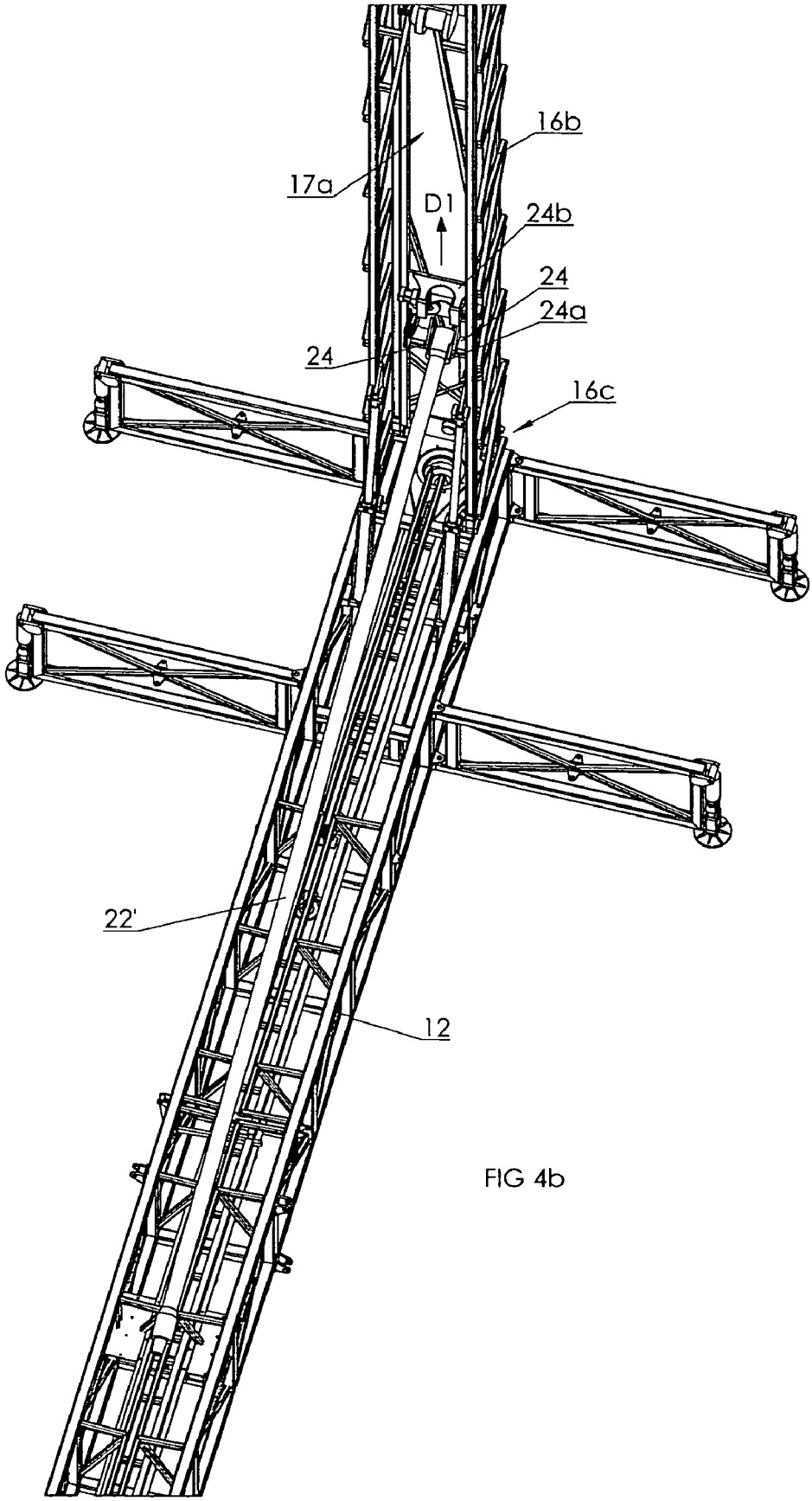
FIG. 4*b* is an enlarged view of the intersection of the mast and table of FIG. 4*a*.
Figure 4C:
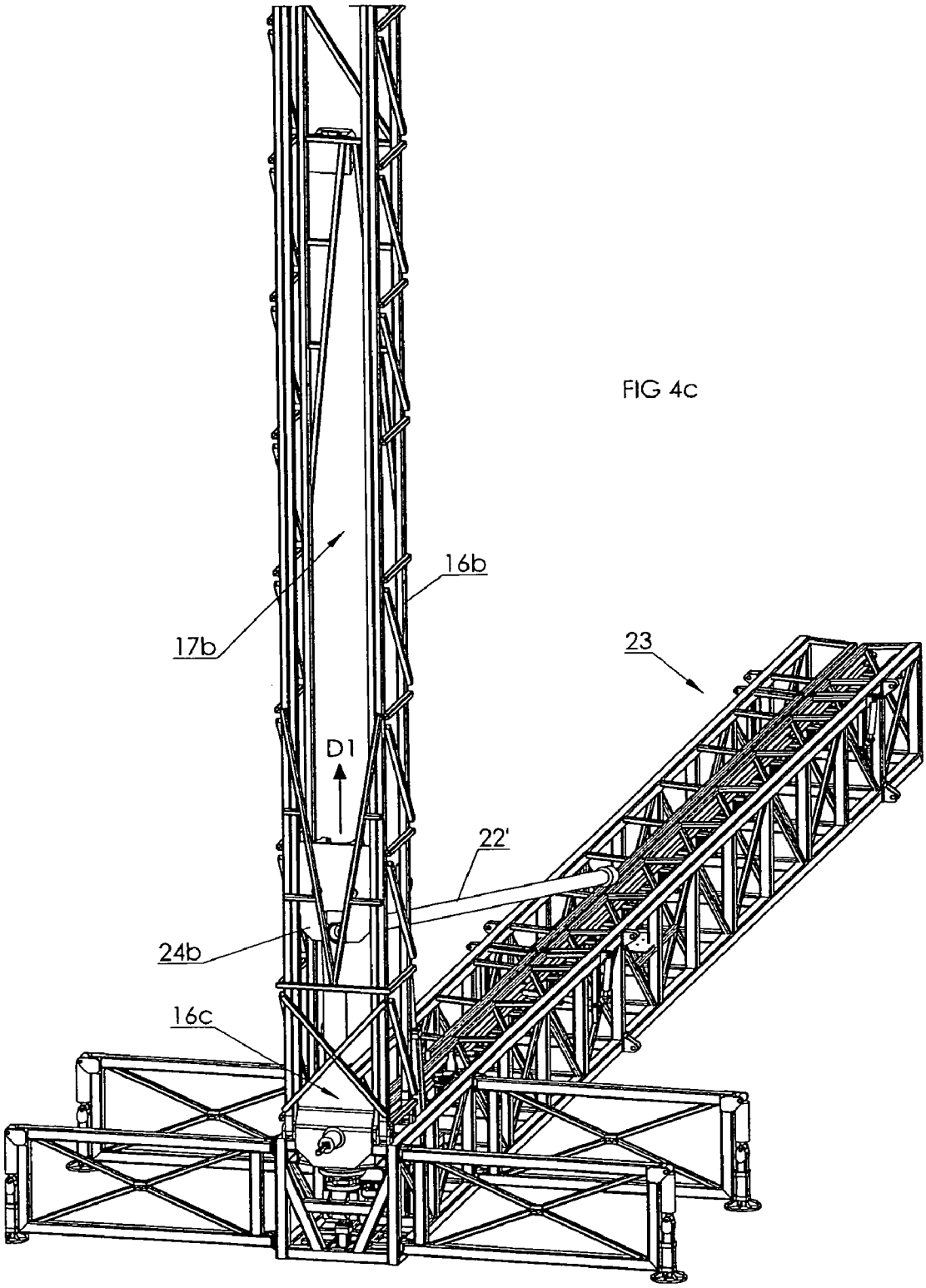
FIG. 4*c* is a rear perspective view of the intersection of the mast and table of FIG. 4*b*.
Figure 5A:
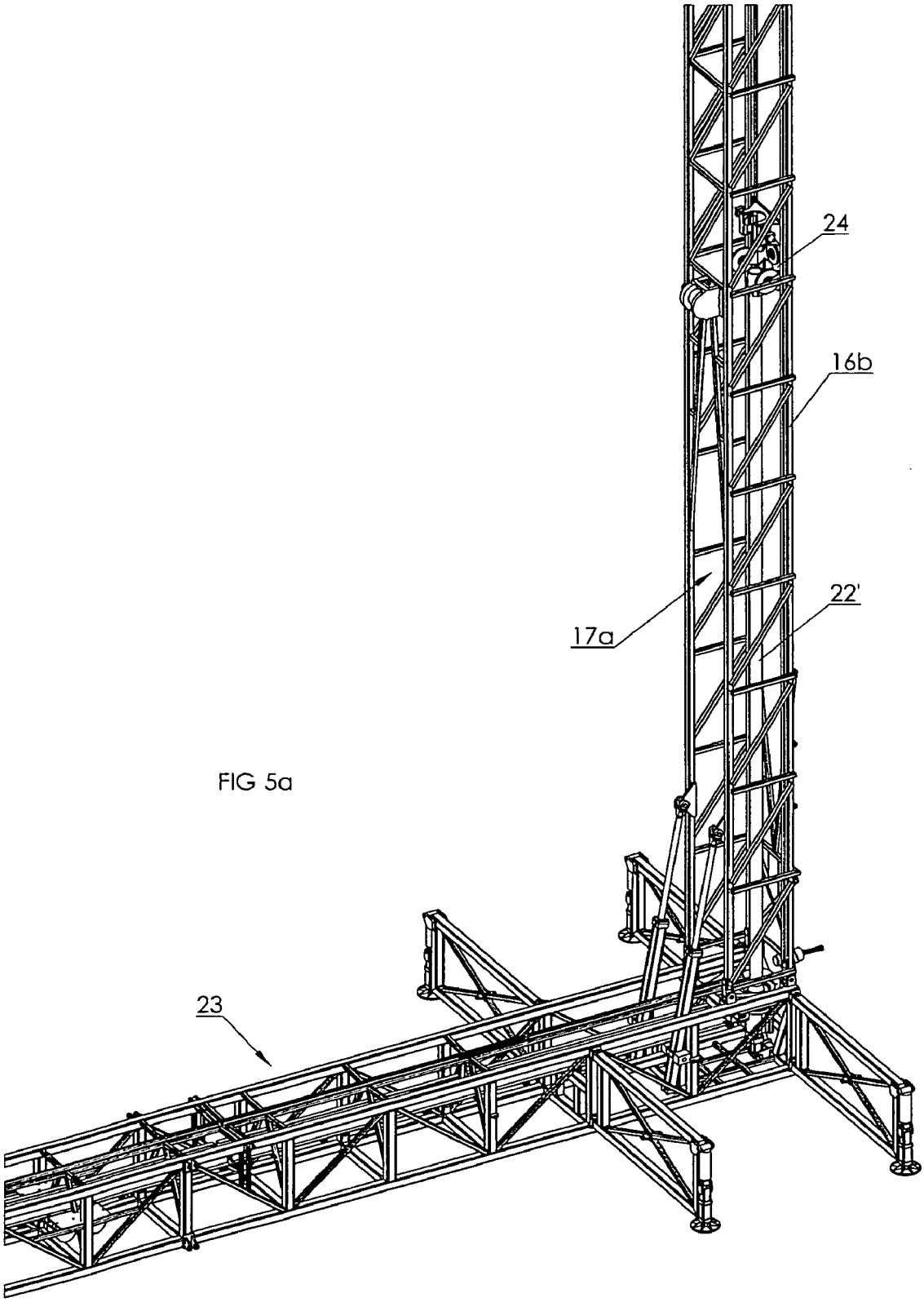
FIG. 5*a* is the view of FIG. 4*a* showing the first pipe having been elevated to the vertical in the mast by the lift plate and lowered so as to set the pin end of the pipe down onto the floor of the mast.
Figure 5B:
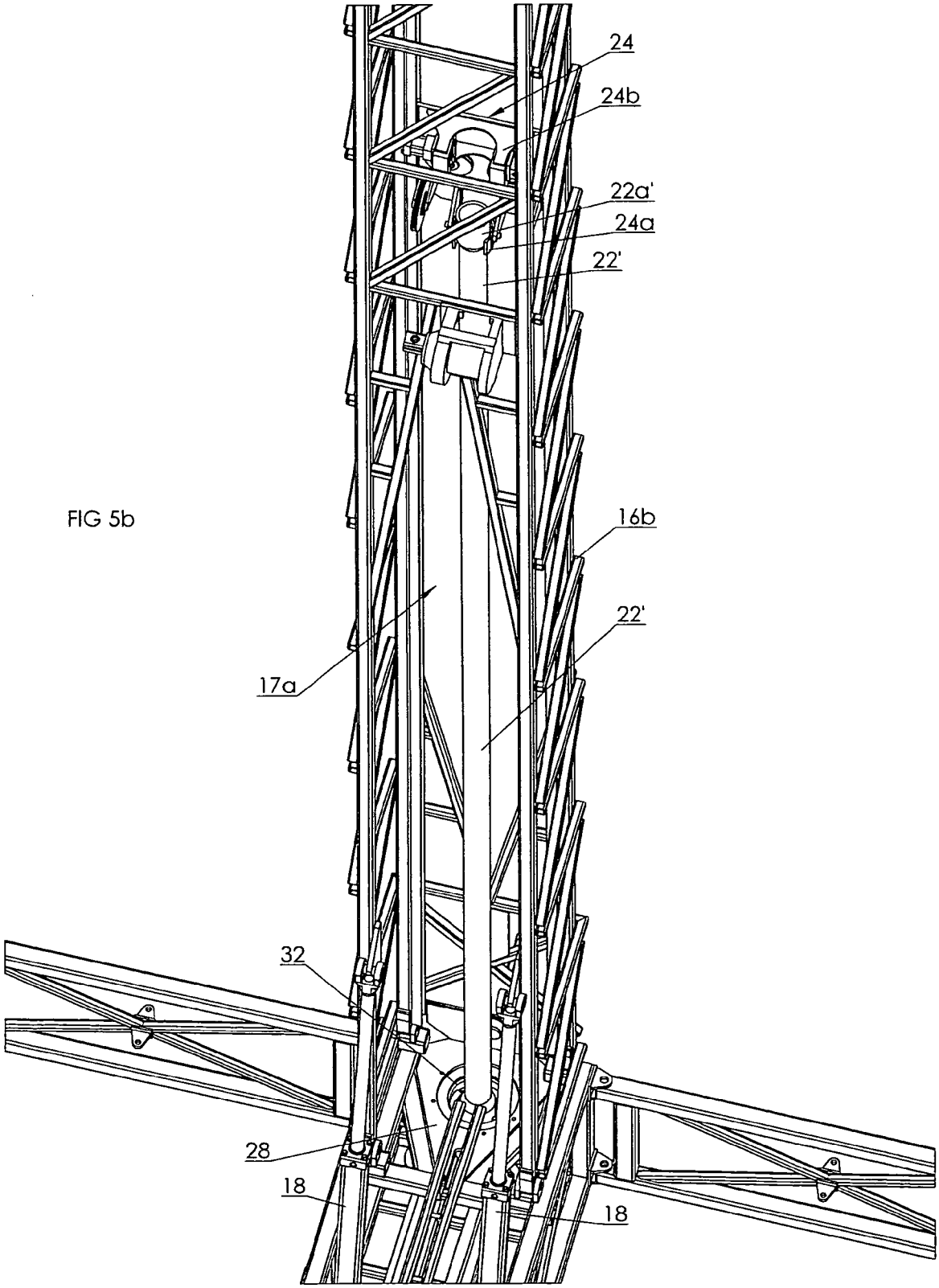
FIG. 5*b* is an enlarged view of the intersection of the mast and table of FIG. 5*a*.
Figure 5C:
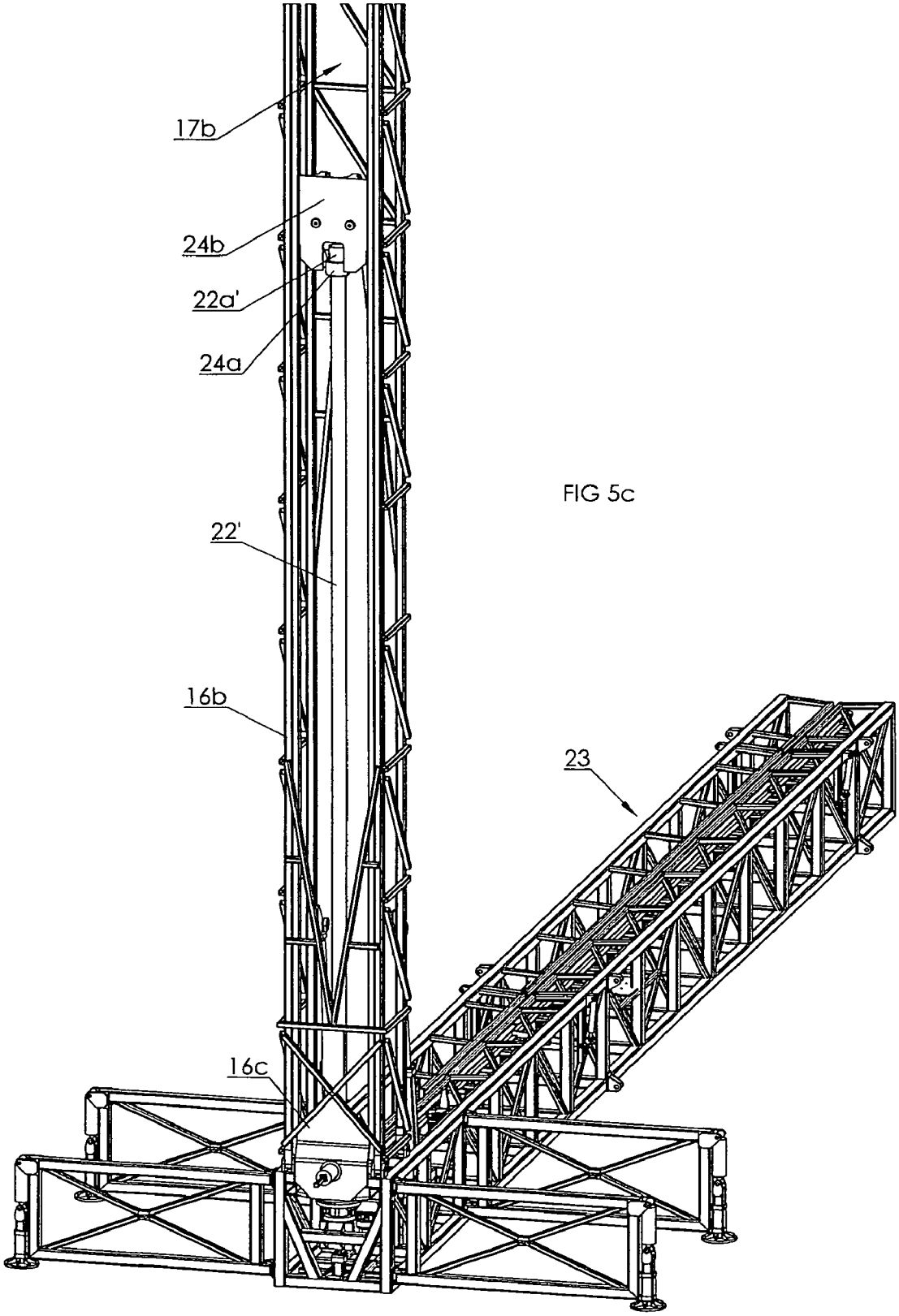
FIG. 5*c* is in rear perspective view the intersection of the mast and table of FIG. 5*b*.
Figure 6A:
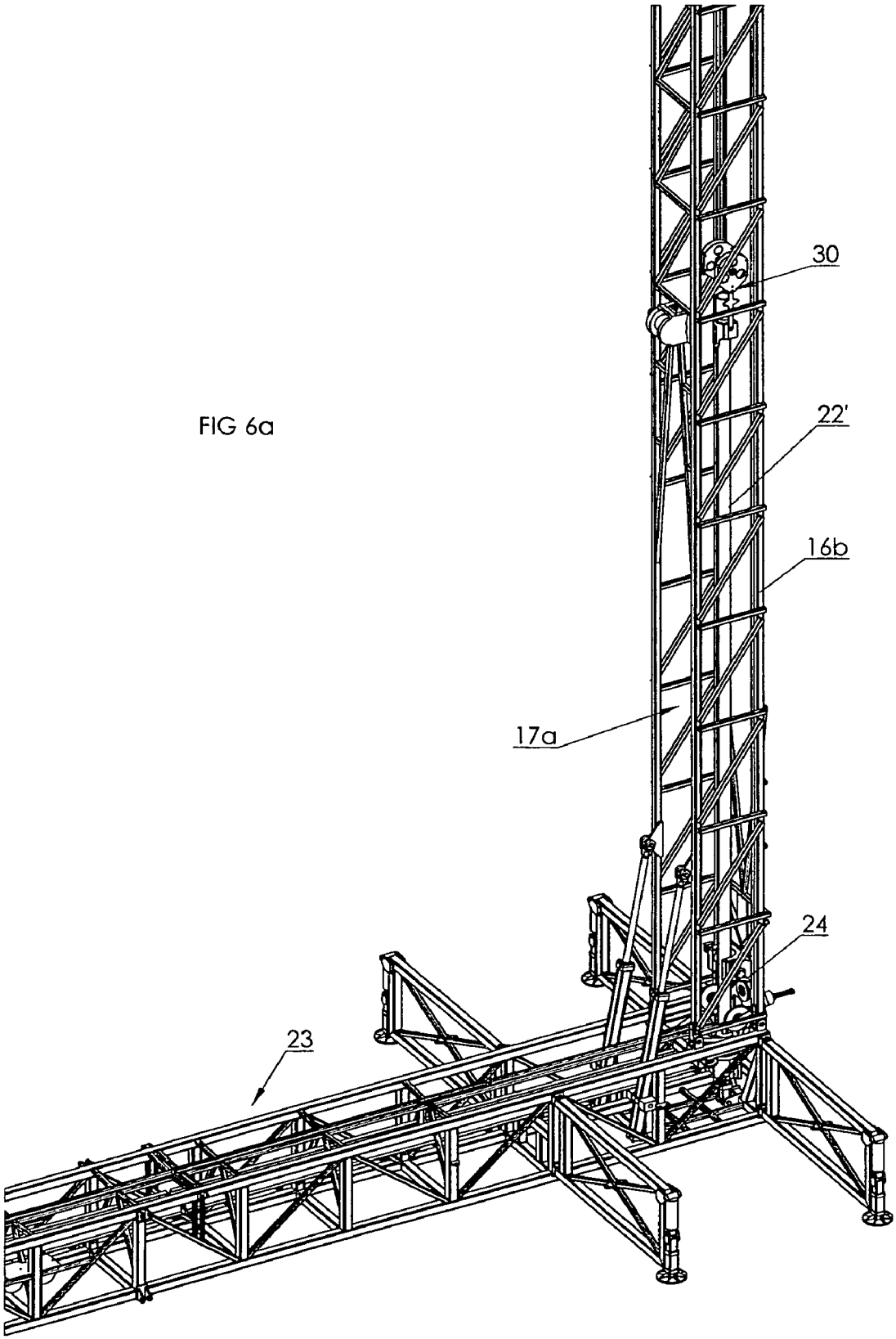
FIG. 6*a* is the view of the mast and table of FIG. 5*a* showing the lifting plate having returned to the base of the mast following lowering of the lifting plate so as to expose the box end of the first pipe and the exposed box end of the first pipe being engaged by the travelling block wherein the cables for hoisting the travelling block are removed in this and subsequent views so as to clarify the drawings.
Figure 6B:
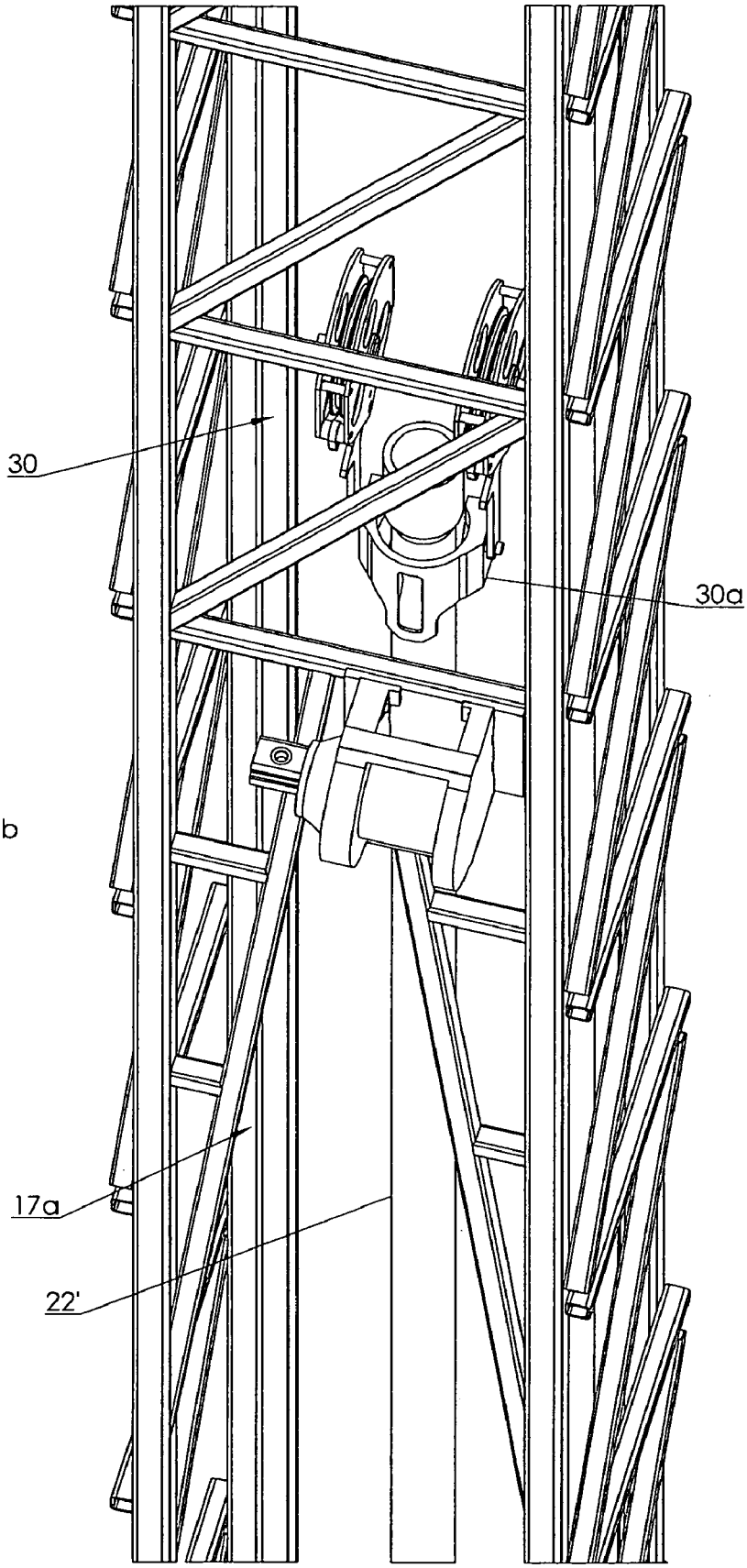
FIG. 6*b* is, in an enlarged front perspective view, the upper end of the front opening of the mast and the upper end of the first pipe being engaged by the travelling block.
Figure 6C:
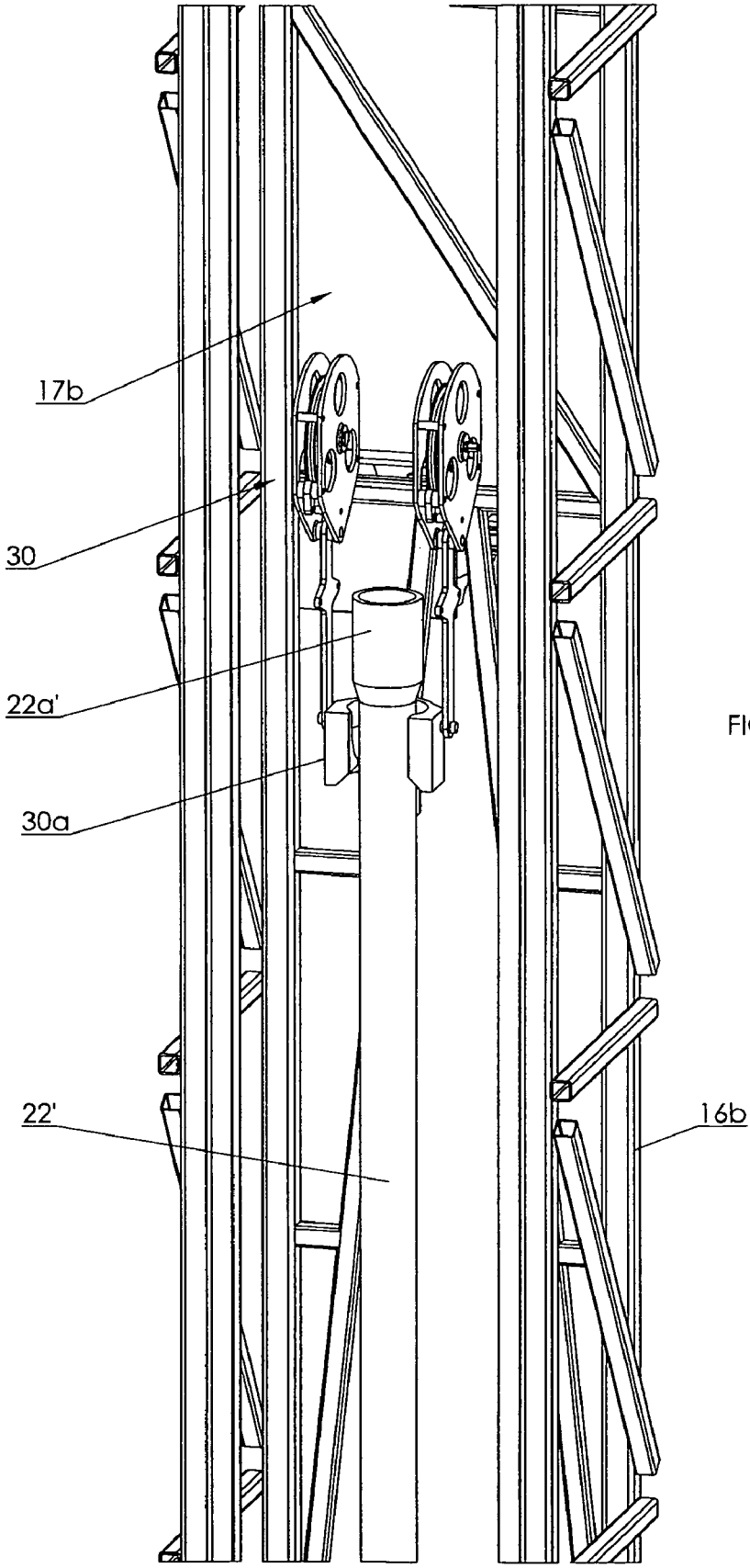
FIG. 6*c* is, in rear perspective view, the enlarged view of FIG. 6*b*.
Figure 7A:
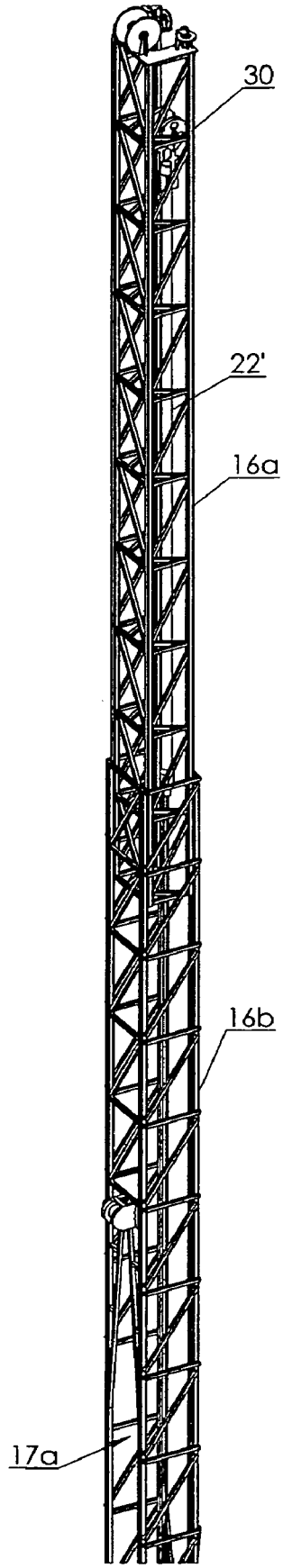
FIG. 7*a* is, in front perspective view, the upper end of the mast of FIG. 6*a* showing the first pipe having been hoisted on the travelling block to the top of the mast.
Figure 7B:
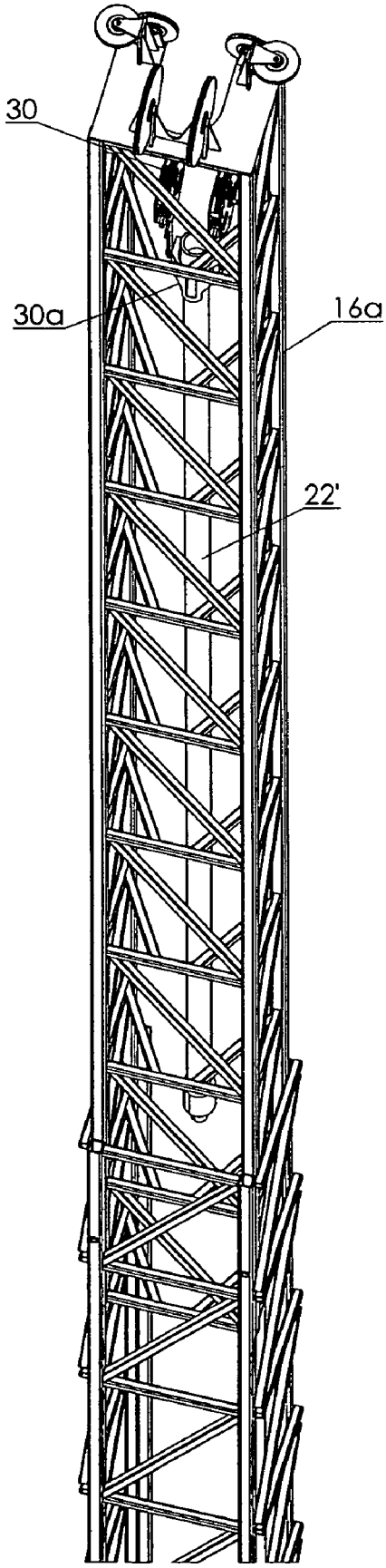
FIG. 7*b* is an enlarged front perspective view of the top of the mast showing the first pipe suspended from the travelling block.
Figure 7C:
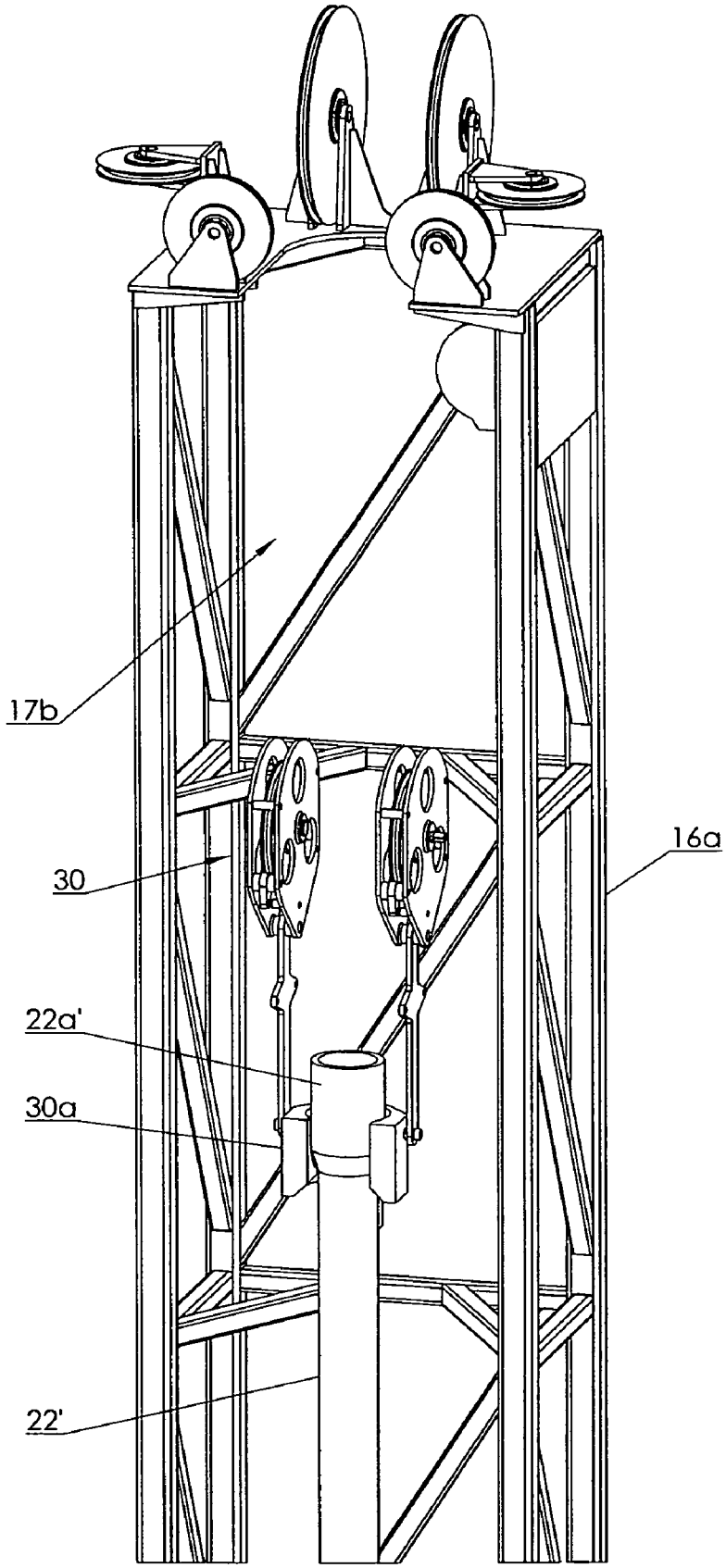
FIG. 7*c* is, in further enlarged rear perspective view, the travelling block and pipe suspended in the top of the mast.
Figure 8A:
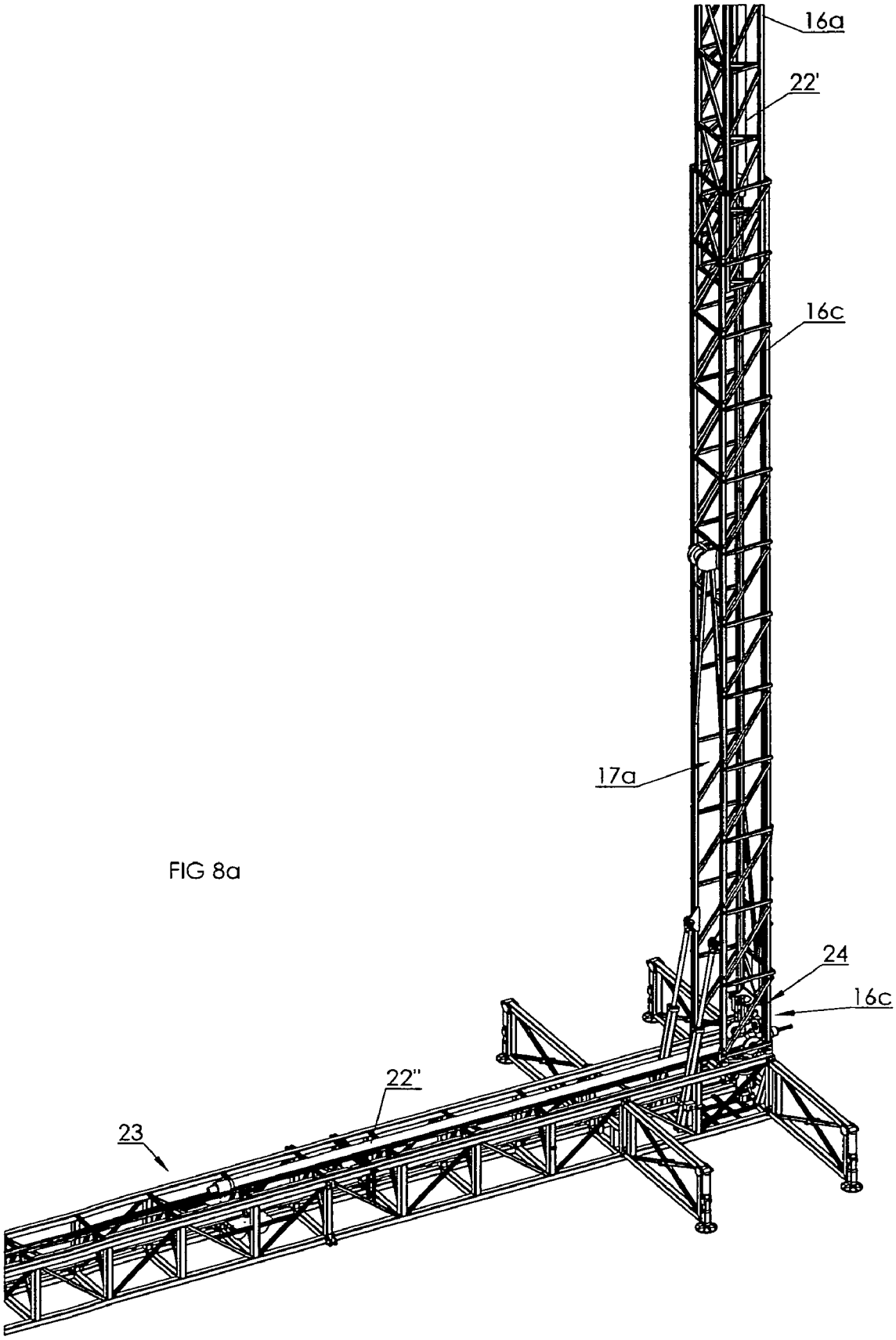
FIG. 8*a* is the mast and table of FIG. 2*a* showing a second pipe positioned on the table with its box end in the base of the mast ready to be elevated by the lifting plate.
Figure 8B:
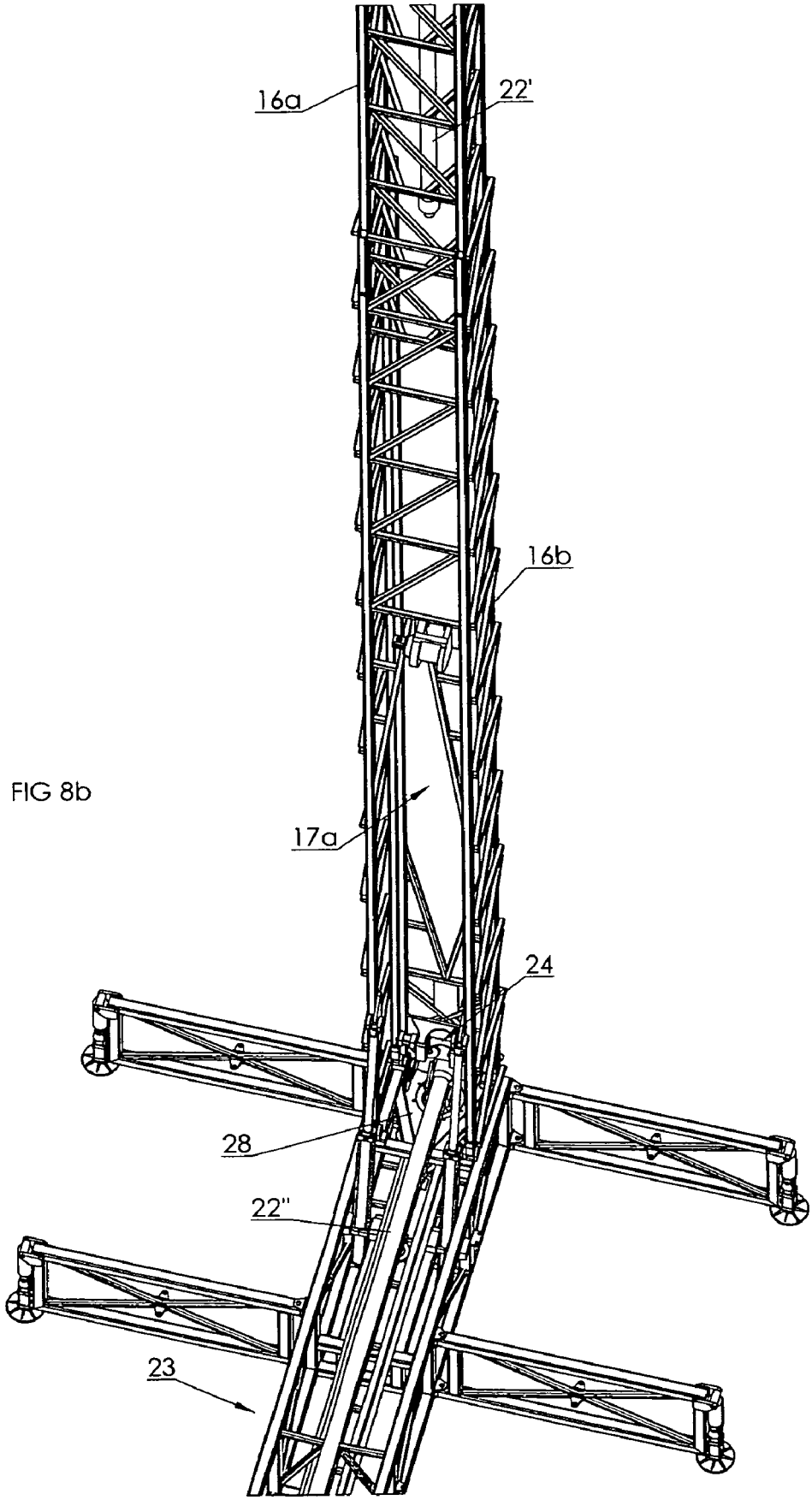
FIG. 8*b* is, in enlarged front perspective view, the intersection of the mast and table of FIG. 8*a*.
Figure 8C:
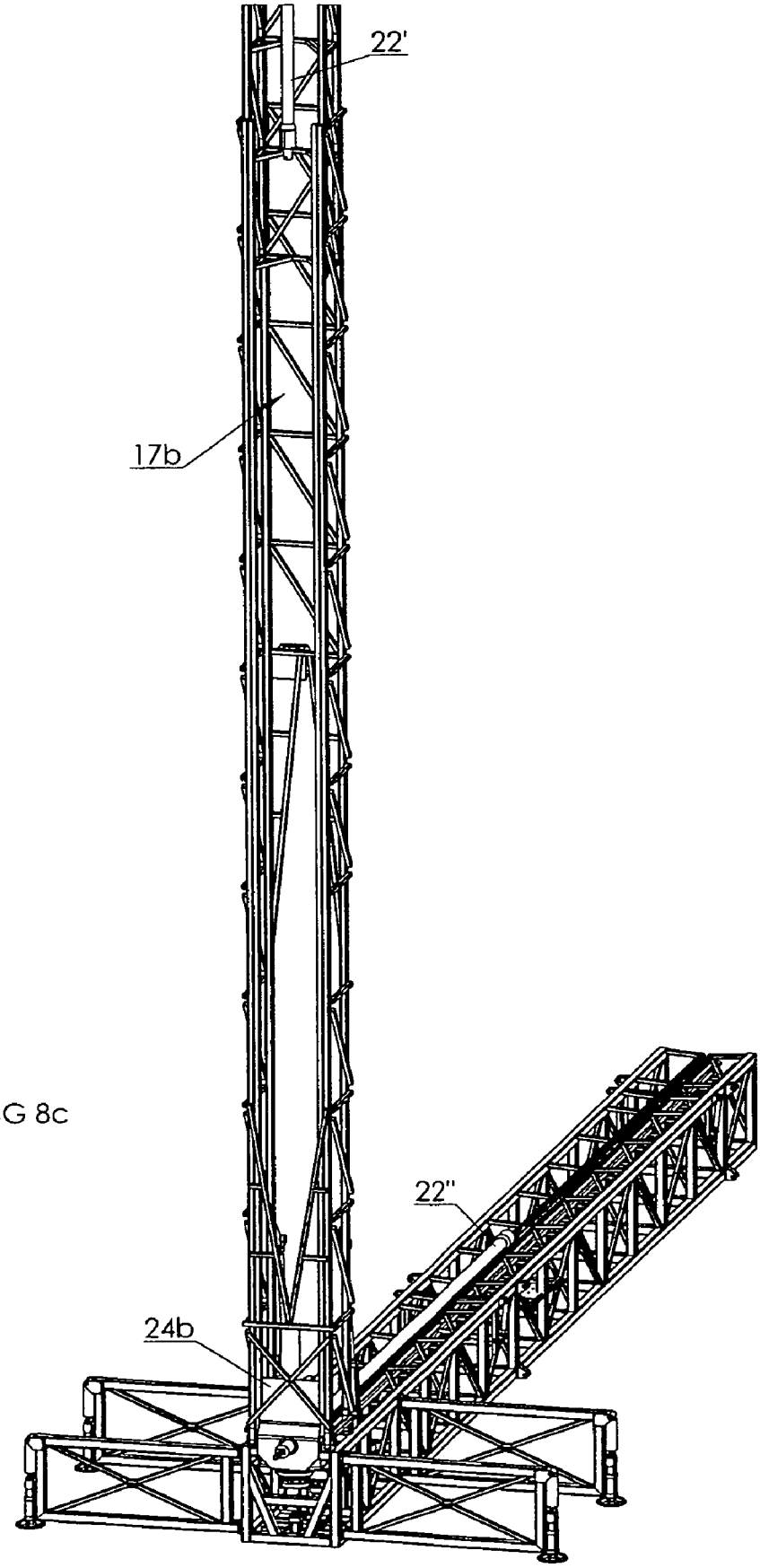
FIG. 8*c* is a rear perspective view of the intersection of the mast and table of FIG. 8*b*.

In the illustrated embodiment, not intended to be limiting, rotating gate collar 122 includes a partial bull gear 160 having a pipe receiving opening 160*a* corresponding to opening 125 of collar 122. A pipe stand 22 is slotted into opening 160*a* in direction F until centered in bull gear 160. The pipe stand is passed from outside the bull gear to its center both from the derrick (or well center) side G when the rotating gate assembly 120 is in its pipe engaging position facing derrick 5, and from the pipe racking assembly or racking board side H when the rotating gate assembly 120 is in its pipe racking position facing pipe racking assembly 110 as seen for example in FIG. 4.

Opening 160*a* is only big enough to receive a pipe stand 22. The length of the toothed circumference 160*b* of bull gear 160 is thereby kept to a maximum to maximize contact of toothed circumference 160*b* with a pair of idler gears 162 mounted on drive base support 164. Idler gears 162 are spaced apart a distance sufficient to span the opening dimension of opening 160*a* for continuous contact of at least one of the idler gears with the bull gear at all times. A drive pinion gear 166 is mounted on base support 164 between, and in contact with the pair of idler gears 162. Drive pinion gear 166 drives bull gear 160 via idler gears 162. A hydraulic motor 168 selectively drives pinion gear 166 via a planetary gear drive 170. The overall drive assembly 128, which may be housed within a cover 172, and may also be provided as a pair of such drives mounted to cross frame member 116*a* on opposite sides of bull gear 160. Either one or such a pair of such drives 128 may be employed to selectively rotate bull gear 160 to thereby simultaneously rotate collar assembly 122 and rotation assembly 124 including rotation tube 174, horseshoe-shaped mounting bracket 176 and its corresponding arms 176*a*. That is, the option exists to utilize one or two drive assemblies based on application torque requirements. With the design arrangement shown the ability to use one only drive motor exists as the opening of the bull gear can be bridged and the drive pinion will not come out of engagement with the bull gear. When two drive motors are used this arrangement ensures synchronization of the driving motors as again the pinions will never come out of engagement when the bull gear split 160*a* is exposed during rotation.

The design of the rotating gate and its drive, once the pipe is held within the rotating gate assembly allows the pipe to continue to move along the pipe path under the manipulated control of the carriage and arm. This is efficient because the device is mounted within the pipe path and not restricted merely to the perimeter of pipe movement.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A Vertical Offline Stand Building System for positioning adjacent to, in co-operation with, a drilling rig platform having a derrick mounted thereover wherein the derrick includes a means of retrieving and handling pipe stands into and from a pipe racking board mounted on the derrick, the system comprising:

a mast having a basal portion and an upper portion mounted atop said basal portion, said basal portion having a base at a lowermost end thereof, an upper pipe elevator mounted in the upper portion of said mast and selectively translatable between upper raised and lowered positions, a lower pipe elevator mounted in the basal portion of said mast and selectively translatable between basal raised and lowered positions, wherein each of said upper and lower pipe elevators are selectively vertically translatable along corresponding upper and lower travel paths along said upper and basal portions of said mast, a horizontal pipe support table for positioning pipe singles adjacent said base, a horizontal pipe translator mounted in said table for translating a pipe single longitudinally along said table so as to engage a first end of the pipe single with said lower pipe elevator when in said basal lowered position, said lower pipe elevator having a pipe engaging means for capturing the first end of the pipe single, a first vertical translator mounted on said mast for selectively hoisting said lower pipe elevator between said basal raised and lowered positions, a second vertical translator mounted on said mast for selectively hoisting said upper pipe elevator between said upper raised and lowered positions, wherein said mast has a pair of oppositely disposed sides, a front, and a rear, wherein said rear is oppositely disposed to said front, and wherein said pipe support table is positionable adjacent said base so as to extend substantially orthogonally from said front of said mast and wherein said rear of said mast is positionable adjacent a drill rig platform and corresponding derrick, wherein said front of said mast has a front opening in at least said basal portion of said mast which is substantially completely open and unobstructed, and wherein said front opening is sized so that the pipe single having its first end elevated by said lower pipe elevator while drawing the opposite second end of the pipe single along said pipe support table, until the pipe single is elevated from its horizontal storage position on said table to a vertical position freely suspended by said lower pipe elevator in said mast will be elevated and drawn through said front opening, wherein said lower pipe elevator is in said basal raised position once the pipe is vertical and suspended by said lower pipe elevator, wherein said basal raised position overlaps said upper lowered position so that, once said lower pipe elevator has elevated the first end of the pipe single to said basal raised position, the first end of the pipe single is engageable by a pipe engaging means on the upper pipe elevator, whereby the first end of the pipe single is handed-off from the lower pipe elevator to the upper pipe elevator, whereupon said upper pipe elevator is selectively vertically translatable upwardly on said second vertical translator so as to elevate the first end of the pipe single to said upper raised position and so as to elevate the second end of the pipe, opposite the first end, above said basal raised position, said lower pipe elevator is selectively vertically translatable downwardly by said first vertical translator so as to lower said lower pipe elevator into said basal lowered position for engaging a first end of a successive pipe single translated on said table to said base, a pipe stand assembly and disassembly device co-operating with said mast and said lower and upper pipe elevators for threading together and unthreading so as to part component pipes singles making up a pipe stand suspended under said upper pipe elevator when in said upper raised position, wherein at least one pipe single is suspended from said upper pipe elevator when in said upper raised position is coupleable to a pipe single suspender from said lower pipe elevator when in said basal raised position, wherein said rear of said mast is substantially completely open and unobstructed for removal therethrough of a pipe-stand from said upper pipe elevator when in said upper raised position, said sides of said mast providing, at least in part, rigidity to said mast, wherein said mast is telescopic and wherein said upper portion translates telescopically relative to said basal portion wherein said lower pipe elevator includes a u-shaped first collar for gripping a box end on the first end of the single, wherein said first collar has an opening for accepting the first end of the single into said u-shaped first collar when engaging the first end of the single at said base and for elevating the first end from said base, wherein said opening is open towards said pipe support table when positioned adjacent said front of said mast.

2. The system of claim 1 wherein said upper pipe elevator includes a u-shaped second collar for gripping the box end on the first end of the single, wherein said second collar has an opening for accepting the first end of the single into said u-shaped second collar when engaging the first end of the single in said overlap between said upper and basal portion and for elevating the single therefrom, wherein said opening is open towards the derrick when said mast is positioned adjacent the derrick.

3. The system of claim 2 wherein said base includes a floor having a pipe receiver therein, wherein said pipe receiver is sized to accept therein the second end of the single, opposite the first end of the single, so as to bear the weight of the single on said receiver when said lower pipe elevator is lowered from said basal raised position substantially as said upper pipe elevator is lowered to said upper lowered position and the box end of the single released by said first collar and engaged by said second collar.

4. The system of claim 3 wherein said receiver includes means for spinning a single about its longitudinal axis when the single is resting in said receiver.

5. The system of claim 4 wherein at least one of said lower pipe elevator, said upper pipe elevator includes a selectively engagable pipe clamp for rigidly clamping an upper single suspended by said upper pipe elevator when the upper single is stabbed into a lower single resting in said receiver, whereby, with the upper single clamped to prevent rotation of the upper single, and with the lower single spun by said receiver, a pipe stand is made-up of the upper and lower singles.

6. The system of claim 1 further comprising a selectively actuable pipe stand positioning arm mountable on the derrick, adjacent said mast, said arm having a pipe stand engaging means on a free end of said arm for supporting and lifting a pipe stand from said mast through said opening in said rear of said mast, whereby the pipe stand is translatable by said arm from said mast for racking adjacent the derrick and for positioning at well center.

7. The system of claim 1 wherein said mast is pivotally mounted on said pipe support table for pivoting between a storage and transportation position substantially flush down on and along said table, and an erected position extending substantially vertically upwardly from said base.

8. A method of forming a stand from singles comprising the steps of:

(a) providing a supply of pipe singles;

(b) providing an elongate mast mounted at its lowermost end on a base said mast when vertical having a top end, a bottom end and a mid section;

(c) providing in co-operation with said mast a lower and an upper hoist means for sequentially hoisting pipe singles upwardly along said mast, (d) loading a first single on the base so as to engage a first end of the first single with said lower hoist means, (e) hoisting the first single from the horizontal to the vertical along said mast so as to position the first end of the first single at said mid section;

(f) lowering the first single so as to engage the opposite second end of the first single with the bottom end of the mast and so as to disengage said lower hoist means from the first end of the first single;

(g) engaging said upper hoist means with the first end of the first single and elevating the first single further upwardly along the mast while lowering the lower hoist means to engage the first end of a second single on the base, (h) loading the second single upwardly along the mast until the second single is positioned generally parallel therewith and wherein the second single is positioned in substantially coaxial alignment with the first single;

(i) lowering the first and second singles so as to engage the opposite second end of the second single, opposite its first end, with a selectively actuable rotating means for rotating the second single onto the first single, wherein said step of providing an elongate telescoping stand forming mast includes providing said mast with a front which faces a supply of horizontally stored singles stored on a horizontal pipe rack side of said mast, an opposite rear or a derrick side of said mast, and sides on opposite sides of said mast between said front and said rear, and wherein said front includes a front opening which is completely open between said mid-section and said base and sized so that the singles as they are hoisted from the horizontal to the vertical within the mast are drawn through said front opening without contacting said mast, and wherein said rear includes a rear opening which is completely open and sized for removal of the made-up pipe stand therethrough while maintaining a vertical orientation, (j) torqueing the first and second singles so as to tighten the first single onto the second single while threadably engaging the second end of the first single down onto the first end of the second single by rotating at least the second single about its longitudinal axis so as to mount the first single to the second single during the rotation whereby co-operating threads on each opposing end of the first and second singles are engaged to form a stand.

9. The method of claim 8 further comprising repeating said steps (d)-(j) to form a three-single pipe stand.

10. The method of claim 9 further comprising repeating said steps (d)-(j) to form a four-single pipe stand.

11. The method of claim 8 further comprising the steps of engaging a racking arm to rack, remove and position the pipe stand from said mast for use in the derrick.

* * * * *